US006638674B2

(12) United States Patent
Komoto et al.

(10) Patent No.: US 6,638,674 B2
(45) Date of Patent: Oct. 28, 2003

(54) MAGNETIC TONER

(75) Inventors: Keiji Komoto, Numazu (JP); Tsuyoshi Takiguchi, Suntoh-gun (JP); Tatsuhiko Chiba, Kaamakura (JP); Michihisa Magome, Suntoh-gun (JP); Akira Hashimoto, Suntoh-gun (JP); Takeshi Kaburagi, Susono (JP); Eriko Yanase, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/911,724

(22) Filed: Jul. 25, 2001

(65) Prior Publication Data

US 2002/0055052 A1 May 9, 2002

(30) Foreign Application Priority Data

Jul. 28, 2000 (JP) ..... 2000-228197

(51) Int. Cl.[7] ..... G03G 9/083

(52) U.S. Cl. ..... 430/106.1; 430/106.2; 430/108.22; 430/108.5; 430/110.4; 430/111.41

(58) Field of Search ..... 430/106.1, 106.2, 430/108.5, 108.22, 110.4, 111.41

(56) References Cited

U.S. PATENT DOCUMENTS

| | | | | |
|---|---|---|---|---|
| 2,297,691 | A | * 10/1942 | Carlson | 430/97 |
| 4,620,987 | A | 11/1986 | Yamashita et al. | 427/131 |
| 4,883,735 | A | 11/1989 | Watanabe et al. | 430/109 |
| 5,014,089 | A | 5/1991 | Sakashita et al. | 355/251 |
| 5,137,796 | A | 8/1992 | Takiguchi et al. | 430/106.6 |
| 5,212,033 | A | 5/1993 | Tsobota et al. | 430/106 |
| 5,219,697 | A | 6/1993 | Mori et al. | 430/110 |
| 5,310,615 | A | 5/1994 | Tanikawa | 430/106.6 |
| 5,464,720 | A | * 11/1995 | Baba et al. | 430/106.1 |
| 5,597,673 | A | * 1/1997 | Watanabe et al. | 430/106 |
| 5,605,778 | A | * 2/1997 | Onuma et al. | 430/108.8 |
| 5,612,161 | A | 3/1997 | Watanabe et al. | 430/110 |
| 5,672,454 | A | 9/1997 | Sasaki et al. | 430/106.6 |
| 5,827,632 | A | * 10/1998 | Inaba et al. | 430/108.6 |
| 6,077,635 | A | 6/2000 | Okado et al. | 430/45 |
| 6,140,003 | A | * 10/2000 | Sacripante et al. | 430/108.22 |
| 6,342,328 | B1 | * 1/2002 | Takasaki et al. | 430/108.22 |
| 2001/0028988 | A1 | * 10/2001 | Magome et al. | 430/106.1 |
| 2002/0009661 | A1 | * 1/2002 | Hashimoto et al. | 430/106.1 |

FOREIGN PATENT DOCUMENTS

| | | | |
|---|---|---|---|
| EP | 0124021 | | 11/1984 |
| EP | 0 314 459 | | 5/1989 |
| EP | 0 430 700 | | 6/1991 |
| EP | 0851307 | | 7/1998 |
| EP | 1058157 | A1 * | 12/2000 |
| JP | 43027 | | 4/1979 |
| JP | 13945 | | 4/1981 |
| JP | 126545 | | 7/1984 |
| JP | 200254 | | 11/1984 |
| JP | 200256 | | 11/1984 |
| JP | 200257 | | 11/1984 |
| JP | 224102 | | 12/1984 |
| JP | 184762 | | 7/1988 |
| JP | 250660 | | 10/1988 |
| JP | 112253 | | 4/1989 |
| JP | 191156 | | 8/1989 |
| JP | 284158 | | 11/1990 |
| JP | 056974 | | 3/1991 |
| JP | 181952 | | 8/1991 |
| JP | 162048 | | 6/1992 |
| JP | 209904 | | 8/1995 |
| JP | 179564 | | 7/1996 |
| JP | 239897 | | 9/1998 |
| JP | 288129 | | 10/1999 |
| JP | 327208 | | 11/1999 |
| WO | WO-99/52019 | A1 * | 3/1999 |

OTHER PUBLICATIONS

Patent Abstracts of Japan, vol. 1995, No. 11, 12/95 for JP 7–199525.

Database WPI, Section Ch, Week 198535, Derwent Publ., AN 1984–216327 (XP 002182012) for JP 59–126545.

* cited by examiner

*Primary Examiner*—Christopher Rodee
(74) *Attorney, Agent, or Firm*—Fitzpatrick, Cella, Harper & Scinto

(57) ABSTRACT

A magnetic toner is formed of magnetic toner particles each comprising a binder resin, an iron oxide, a sulfur-containing polymer, and inorganic fine powder blended with the magnetic toner particles, the toner having a weight-average particle size (D4) of 3–10 $\mu$m, and either (a) an average circularity of at least 0.970, and a magnetization of 10–50 $Am^2/kg$ (emu/g) at a magnetic field of 79.6 kA/m (1000 oersted), or (b) toner particles which retain carbon in an amount of A and iron in an amount of B at surfaces thereof, satisfying: $B/A<0.001$, and containing at least 50% by number of magnetic toner particles of $D/C \leqq 0.02$, wherein C represents a particle projection area-equivalent circle diameter and D represents a minimum distance between a surface of the magnetic toner particle and iron oxide particles contained therein.

63 Claims, 2 Drawing Sheets

MAGNETIC TONER

FIELD OF THE INVENTION AND RELATED ART

The present invention relates to a magnetic toner used in a recording method utilizing electrophotography, electrostatic recording, magnetic recording, toner jet recording, etc.

Hitherto, a large number of electrophotographic processes have been known. Generally, in these processes, an electrostatic latent image is formed on an electrostatic image-bearing member (hereinafter sometimes represented by a "photosensitive member") utilizing ordinarily a photoconductive material, the latent image is then developed with a toner to form a visible toner image, and the toner image, after being transferred as desired onto a transfer-receiving material such as paper, is fixed onto the transfer-receiving material by application of pressure, heat, etc., to provide a product copy or print.

As a method for visualizing the electrostatic latent image, there have been known the cascade developing method, the magnetic brush developing method, the jumping developing method, the pressure developing method, the magnetic brush developing method using a two-component type developer comprising a carrier and a toner, the non-contact mono-component developing method wherein a toner on a toner-carrying member in no contact with a photosensitive member is caused to jump onto the photosensitive member, the contact mono-component developing method wherein a toner is transferred from a toner-carrying member pressed against a photosensitive member onto the photosensitive member under the action of an electric field, and the so-called jumping developing method wherein a magnetic toner carried on a rotating sleeve enclosing a magnetic pole therein is caused to jump from the sleeve onto a photosensitive member under an electric field.

As for the jumping developing method, Japanese Laid-Open Patent Application (JP-A) 54-43027, for example, discloses a developing method wherein an insulating magnetic developer (toner) is applied in a thin layer on a developer-carrying member to be triboelectrically charged thereon, and the charged layer of the magnetic toner is moved under the action of a magnetic field to be opposed in close proximity to but free of contact with an electrostatic latent image to effect a development. According to this method, the magnetic developer is allowed to be sufficiently triboelectrically charged by application in a thin layer on the developer-carrying member, and the developer carried under a magnetic force is used for development in a state free from contact with the electrostatic latent image, so that a high definition image can be obtained with suppression of so-called "fog" caused by transfer of the developer onto non-image parts.

Such a mono-component developing method, does not require carrier particles, such as glass beads or iron powder, so that a developing device therefor can be small-sized and light in weight. Further, while the two-component developing scheme requires devices for detecting a toner concentration in the developer and for replenishing a necessary amount of toner based on the detected result in order to keep a constant toner concentration in the developer, the mono-component developing scheme does not require such devices, thus allowing a small-sized and light developing device also from these points.

As for electrophotographic apparatus such as printer apparatus, higher resolutions are being desired, e.g., from a conventional level of 300 and 600 dpi to 1200 and 2400 dpi as a technical trend. For these reasons, the developing scheme is also required to be adapted for higher resolution. Further, also copying machines are required to comply with high functionality copying, and digital-mode copying apparatus are becoming predominant. Along with this trend, the latent image formation by using laser beam is predominant together with a requirement for higher resolution. Accordingly, similarly as in printers, higher resolution and higher definition developing scheme is being required.

For complying with such demands, smaller particle size toners having a specific particle size distribution have been proposed in, e.g., JP-A 1-112253, JP-A 1-191156, JP-A 2-214156, JP-A 2-284158, JP-A 3-181952, and JP-A 4-162048. However, smaller-size toner particles are liable to have a larger fluctuation in chargeability, and the control thereof becomes important for accomplishment of the above-mentioned desires. The maintenance of a chargeability also becomes difficult, and the control thereof becomes more important.

On the other hand, the toner image formed on the photosensitive member in the developing step is transferred onto a recording material in a transfer step, and a portion of toner image (transfer residual toner) remaining on the photosensitive member without being transferred is recovered in a cleaning step and stored in a waste toner vessel in a cleaning step. In the cleaning step, a cleaning blade, a cleaning fur brush or a cleaning roller has been conventionally used. From the apparatus viewpoint, however, the presence of such a cleaning device has posed an obstacle to provision of a compact apparatus. Further, from the viewpoints of ecology and effective toner utilization, a system with little waste toner is desirable, and a toner showing a high transferability and causing little fog is desired, correspondingly.

It is well known that the above-mentioned transferability or transfer efficiency is associated with a toner shape and is lowered at a lower circularity (or sphericity) of toner which results in a larger contact area with the photosensitive drum (photosensitive member) and a larger unevenness causing a larger image force due to charge concentration at edges leading to a lower releasability of the toner from the drum. Accordingly, in order to improve the transfer efficiency, it is necessary to increase the toner circularity.

A higher toner circularity is achieved by different methods depending on toner production processes. The production processes for commercially available toners are roughly divided into the pulverization process and the polymerization process. In this pulverization process, toner ingredients such as a binder resin and a colorant are melt-kneaded for uniform dispersion and then pulverized by a pulverizer, followed by classification by a classifier, to obtain toner particles having a desired particle size. The toner particles formed through the pulverization process are accompanied with surface unevennesses since the surfaces thereof are composed of breakage sections formed by the pulverization. Accordingly, a sufficient circularity is not given by only the pulverization, and a surface modification as by mechanical impact or heat treatment for sphering is required as a post-treatment. The polymerization process includes an association and agglomeration process wherein resin particles formed by emulsion polymerization and constituting the binder resin are associated and agglomerated with a colorant and a release agent into a desired particle size to form association-agglomeration toner particles, and a suspension polymerization process wherein a colorant, a release agent, a polymerization initiator, etc., are dissolved or dispersed in a polymerizable monomer to form a polymerizable monomer composition, and the composition is sheared into droplets of a desired size in an aqueous medium, followed by polymerization to provide a suspension polymerization toner. The association-agglomeration toner particles are also accompanied with surface unevennesses attributable to the production process, and require a surface modification post-treatment as by heating of the agglomerated toner particles or seed polymerization by adding a fresh polymerizable monomer composition. The suspension polymerization toner particles are caused to have a shape closer to true spheres compared with toner particle formed through other processes because they have been formed by polymerization of liquid droplets, and therefore provide a toner having a high circularity without a post-treatment. Accordingly, the suspension polymerization process is suitable for providing a high circularity (i.e., toner particles having a high circularity or sphericity). However, in the case of producing a magnetic toner by suspension polymerization, the resultant magnetic toner particles are liable to have a remarkably lower flowability and chargeability. This is because magnetic particles are generally hydrophillic and tend to be present at the toner particle surface. For solving the problem, it is important to modify the surface property of magnetic particles.

A number of proposals have been made regarding surface modification of magnetic material for improved dispersion within polymerization toner particles. For example, treatment of magnetic materials with various silane coupling agents has been proposed by JP-A 59-200254, JP-A 59-200256, JP-A 59-200257 and JP-A 59-224102; and treatment of silicon-containing magnetic particles with silane coupling agents has been proposed in JP-A 10-239897.

By such treatments, the dispersibility of magnetic particles is improved to some extent, but it is difficult to uniformly effect the surface modification (hydrophobization) of magnetic particles, so the coalescence of magnetic particles or the occurrence of unhydrophobized magnetic particles is liable to be caused, thus making it difficult to improve the dispersibility of magnetic particles within toner particles to a satisfactory level. Further, the resultant toner particles are liable to contain different amounts of magnetic particles, so that the toner is liable to show a coloring power and an image quality which are liable to vary depending on environmental conditions and continuation of a continuous image forming operation.

On the other hand, JP-A 7-209904 has proposed a toner comprising toner particles, at which surface the exposure of magnetic particles is completely suppressed.

To summarize the toner organization disclosed in JP-A 7-209904, each toner particle has a structure including a surface layer of at least a certain thickness in which no magnetic particles are present. This means that the toner particle includes a substantial surface layer portion containing no magnetic particles. In another expression, this however means that such a toner particle, when in a small average particle size of 10 $\mu$m, for example, includes only a small core volume in which magnetic particles are present, so that it is difficult to incorporate a sufficient amount of magnetic particles. Moreover, in such toner particles, magnetic particles are confined at the core parts and are liable to agglomerate with each other, thus failing to exhibit a sufficient coloring power in fixed toner image.

Further, toners obtained by using monomers having a sulfonyl acid group or similar functional groups have been disclosed in JP-A 63-184762, JP-A 3-56974, JP-A 8-179564, JP-A 11-184165, JP-A 11-288129, JP-A 11-327208 and JP-A 2000-586158. These references however fail to disclose specific examples of magnetic toners at all. JP-A 59-126545 discloses a method of improving the dispersibility of magnetic particles by reaction with a sulfonic acid monomer or a sulfonic acid salt monomer. The resultant toner particles are however accompanied with many magnetic particles present at the surface. As a result of insufficient control of surface magnetic material, the toner particles are liable to have a broad particle size distribution and an insufficient chargeability, so that the toner performances are not satisfactory with respect to image density, image fog and transferability.

JP-A 2000-258953 discloses a method of coating colored particles formed by dispersing a solution of toner ingredients inclusive of a toner binder, a wax and a colorant in an aqueous medium with a resin having an negatively chargeable group, but no specific reference is made to magnetic toners.

SUMMARY OF THE INVENTION

A generic object of the present invention is to provide a magnetic toner having solved the problems of the prior art.

A more specific object of the present invention is to provide a magnetic toner capable of exhibiting stable chargeability regardless of environmental conditions, thereby providing high-quality images.

Another object of the present invention is to provide a magnetic toner capable of exhibiting high developing performance and high transferability regardless of environmental conditions, thus providing high-quality images for a long period.

According to the present invention, there is provided a magnetic toner, comprising: magnetic toner particles each comprising at least, a binder resin, an iron oxide and a a sulfur-containing polymer, and inorganic fine powder blended with the magnetic toner particles; wherein the magnetic toner has a weight-average particle size (D4) of 3–10 $\mu$m, the magnetic toner has an average circularity of at least 0.970, and the magnetic toner has a magnetization of 10–50 $Am^2/kg$ (emu/g) at a magnetic field of 79.6 kA/m (1000 oersted).

According to another aspect of the present invention, there is provided a magnetic toner, comprising: magnetic toner particles each comprising at least a binder resin, an iron oxide and a sulfur-containing polymer, and inorganic fine powder blended with the magnetic toner particles; wherein the magnetic toner has a weight-average particle size (D4) of 3–10 $\mu$m, the magnetic toner particles retain carbon in an amount of A and iron in an amount of B at surfaces thereof as measured by X-ray photoelectron spectroscopy, satisfying: $B/A<0.001$, and the magnetic toner contains at least 50% by number of magnetic toner particles satisfying a relationship of $D/C \leqq 0.02$, wherein C represents a projection area-equivalent circle diameter of each magnetic toner particle, and D represents a minimum distance between a surface of the magnetic toner particle and iron oxide particles contained in the magnetic toner particle.

These and other objects, features and advantages of the present invention will become more apparent upon a consideration of the following description of the preferred embodiments of the present invention taken in conjunction with the accompanying drawings.

DETAILED DESCRIPTION OF THE INVENTION

Figure 1:
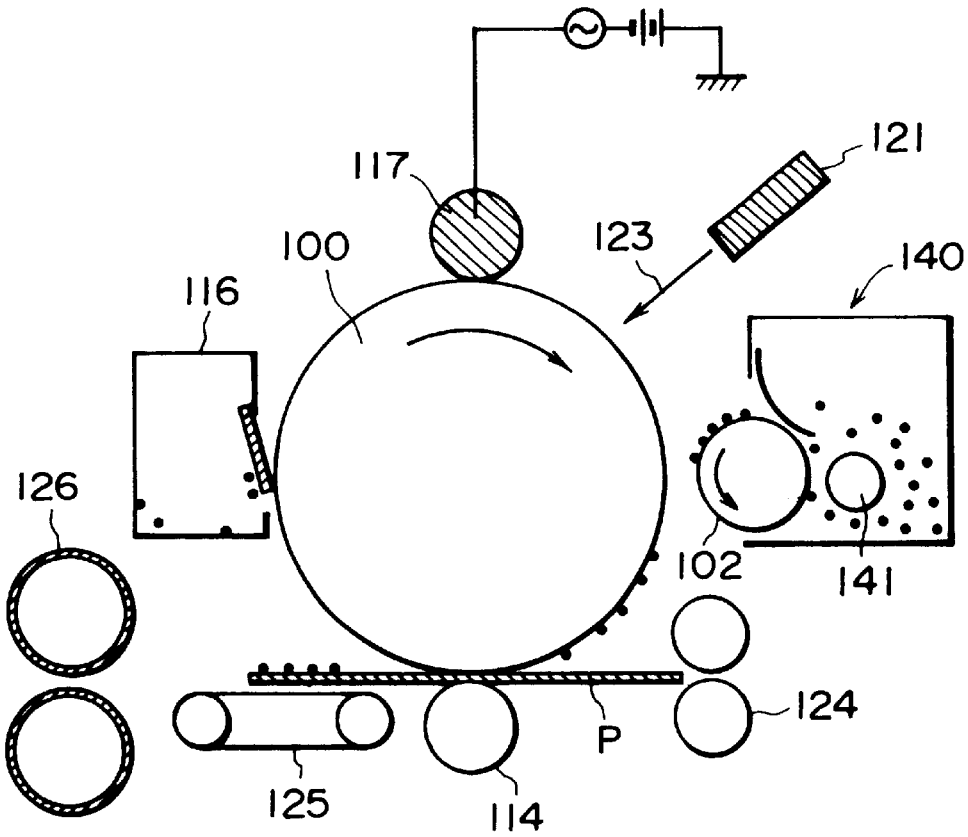
FIG. 1 illustrates an image forming apparatus used in Examples.

The magnetic toner of present invention is characterized by including a sulfur-containing polymer, and having a specifically small particle size, a high circularity and a specific level of magnetization. As a result, the magnetic toner of the present invention is provided with a uniform chargeability and a developing performance of faithfully reproducing latent images to provide a high image density. Further, as a result of the chargeability and a closely spherical shape, the magnetic toner of the present invention exhibits a high transfer efficiency, thus being able to reduce the toner consumption. Further, as a result of the high circularity, the magnetic toner of the present invention can form very narrow ears at the developing zone to provide images with very little fog in combination with uniform chargeability. The addition of the inorganic fine powder as the external additive also promotes a better transferability, leading to a further reduced toner consumption.

As a result of our study, it has been found that the presence of a sulfur at the toner surface as a result of inclusion of a sulfur-containing polymer is effective for providing a uniform chargeability of the toner and an environmental stability thereof. This effect is preferably enhanced by controlling a ratio of another hetero-element, more specifically nitrogen, to the sulfur at the toner surface.

The sulfur-containing polymer suitably used in the present invention refers to a polymer having a molecular weight (polystyrene-equivalent molecular weight) distribution according to gel-permeation chromatography showing a peaktop in a molecular weight region of at least 1000, and containing sulfur (atom) in its THF (tetrahydrofuran)-soluble content. As for the valence and chemical structure of presence of the sulfur, the sulfur may preferably show a peaktop in a bonding energy range of 166–172 eV at the toner surface as measured by X-ray photoeletron spectroscopy (XPS) described hereinafter, given by a valence of 4 or 6, more preferably 6. The sulfur may preferably be present in a form of sulfone, sulfonic acid, sulfonic acid salt, sulfate ester, sulfate ester or sulfate ester salt; more preferably sulfonic acid, sulfonic acid salt, sulfate ester or sulfate ester salt.

It is preferred that the toner particles of the magnetic toner according to the present invention retain an amount of sulfur (E) and an amount of nitrogen (F) at their surfaces as measured by XPS satisfying $0.25 \leqq F/E \leqq 4$. The surface nitrogen may preferably show a peaktop in a bonding energy range of 396–403 eV, preferably given by a nitrogen-containing functional group of amine or amide, more preferably amide.

By satisfying the above-mentioned relationship, the magnetic toner of the present invention can exhibit good developing performance and high transferability without being affected by environmental conditions, thus maintaining high image quality for a long period.

In order for the magnetic toner of the present invention to exhibit good developing performances, the presence of the sulfur-containing polymer is essential, and the presence thereof at the toner surface most contributing to the toner chargeability is essential for exhibition of the effect to the maximum. Further, for maintaining the developing performance in various environments, the co-presence of nitrogen atom has been found preferable. The co-presence of the nitrogen is assumed to promote the charging at the start-up of developing operation due to the action of the unshared electron pair thereof and suppress the charge-up (i.e., excessive charge) by cooperation with the sulfur atom. If the ratio F/E is below 0.25, the effect of promoting the start-up chargeability is scarce, thus being liable to exhibit a lower chargeability in a high humidity environment or a low humidity environment. On the other hand, if F/E exceeds 4, the effect of nitrogen of chargeability suppression is liable to become excessive, thus being liable to cause an insufficient chargeability. The effect can be enhanced in a range of $0.8 \leqq F/E \leqq 3.0$.

As for the control of F/E ratio, the E level can be controlled by adjusting the sulfur content or chemical state of presence thereof in the sulfur-containing polymer, or the amount of the sulfur-containing polymer. On the other hand, the F level can be controlled by adjusting the species of nitrogen-containing functional group or the nitrogen content in the nitrogen-containing substance, or the amount of the nitrogen-containing substance. This can be also accomplished by increasing the polarity of the nitrogen-containing substance to an appropriate degree higher than the other materials. The nitrogen source and the sulfur source may be the same or different for providing a prescribed F/E ratio.

In the magnetic toner of the present invention, the sulfur content at the toner particle surface can be specified by XPS (X-ray photoelectron spectroscopy). More specifically, the sulfur content may preferably be specified such that the sulfur content (E) determined by a peaktop in a bonding energy range of 166–172 eV according to XPS provides a ratio E/A in a range of 0.0003–0.0050 with respect to the carbon content (A) at the toner particle surface also determined by XPS. The ratio can be controlled by adjusting the average particle size of the used (magnetic) iron oxide particles, the sulfur content in the binder resin and the amount of the sulfur-containing polymer. If the E/A ratio is below 0.0003, the effect of enhancing the chargeability is liable to be scarce, and in excess of 0.0050, the chargeability is liable to vary depending on the environmental humidity.

It is also preferred to control the nitrogen content (F) level at the toner particle surface such that the nitrogen content (F) determined by a peaktop in a bonding energy range of 396–403 eV provides a ratio F/A in a range of 0.0005–0.0100 with respect to the carbon content at the toner particle surface, respectively based on XPS. If the F/A ratio is below 0.0005, the effect of enhancing the chargeability is liable to be scarce, and in excess of 0.0100, the chargeability is liable to vary depending on the environmental humidity.

The sulfur-containing polymer used in the present invention may be provided as a polymer or copolymer of a sulfur-containing monomer, examples of which may include: styrenesulfonic acid, 2-acrylamido-2-methylpropanesulfonic acid, vinylsulfonic acid, methacrylsulfonic acid, and maleic acid amide derivative, maleimide derivative and styrene derivative represented by the following formula:

Maleic Acid Amide Derivative

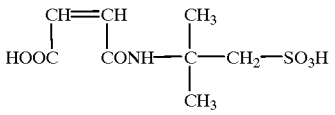

Maleimide Derivative

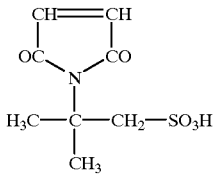

Styrene Derivative

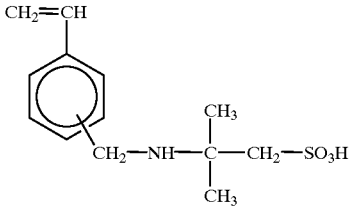

(bonding cite may be ortho or para).

Among the above, sulfonic acid group-containing (meth) acrylamide is particularly preferred as a sulfur-containing monomer.

The comonomer for providing the sulfur-containing copolymer together with the above-mentioned sulfur-containing monomer may be a vinyl monomer, inclusive of a mono-functional monomer, or a poly-functional monomer.

In order to provide a toner with desirable circularity and particle size, it is rather preferred to use a sulfur-containing copolymer, in which the sulfur-containing monomer may preferably occupy 0.01–20 wt. %, more preferably 0.05–10 wt. %, further preferably 0.1–5 wt. %.

Examples of the monofunctional monomer for providing the sulfur-containing copolymer may include: styrene; styrene derivatives, such as α-methylstyrene, β-methylstyrene, o-methylstyrene, m-methylstyrene, p-methylstyrene, 3,4-dichlorostyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxystyrene and p-phenylstyrene; acrylic monomers, such as methyl acrylate, ethyl acrylate, n-propyl acrylate, iso-propyl acrylate, n-butyl acrylate, iso-butyl acrylate, tert-butyl acrylate, n-amyl acrylate, n-hexyl acrylate, 2-ethylhexyl acrylate, n-octyl acrylate n-nonyl acrylate, cyclohexyl acrylate, benzyl acrylate, dimethylphosphateethyl acrylate, diethylphosphateethyl acrylate, dibutylphosphateethyl acrylate, and 2-benzoyloxyethyl acrylate; methacrylate monomers, such as methyl methacrylate, ethyl methacrylate, n-propyl methacrylate, iso-propyl methacrylate, n-butyl methacrylate, iso-butyl methacrylate, tert-butyl methacrylate, n-amyl methacrylate, n-hexyl methacrylate, 2-ethylhexylmethacrylate, diethylphosphateethyl methacrylate, and dibutylphosphateethyl methacrylate; methylemonocarboxylic acid esters; vinyl esters, such as vinyl acetate, vinyl propionate, vinyl lactate, vinylbenzoate, and vinyl formate; vinyl ethers, such as vinyl methyl ether, vinyl ethyl ether, and vinyl isobutyl ether; and vinyl ketones, such as vinyl methyl ketone, vinyl hexyl ketone and vinyl isopropyl ketone.

Examples of the poly-functional monomer may include: diethylene glycol diacrylate, triethylene glycol diacrylate, tetraethylene glycol diacrylate, polyethylene glycol diacrylate, 1,6-hexanediole diacrylate, neopentyl glycol diacrylate, tripropylene glycol diacrylate, polypropylene glycol diacrylate, 2,2'-bis(4-(acryloxy-diethoxy)phenyl) propane, trimethylolpropane triacrylate, tetramethylmethane tetraacrylate, ethylene glycol dimethacrylate, diethylene glycol dimethacrylate, triethylene glycol dimethacrylate, tetraethylene glycol dimethacrylate, polyethylene glycol dimethacrylate, 1,3-butylene glycol dimethacrylate, 1,6-hexanediol dimethacrylate, neopentyl glycol dimethacrylate, polypropylene glycol dimethacrylate, 2,2'-bis(4-methacryloxydiethoxy)-phenyl)propane, 2,2'-dis(4-methacryloxy polyethoxy)-phenyl)propane, trimethylpropane trimethacrylate, tetramethylmethane tetramethacrylate, drivinylbenzene, divinylnaphthalene and divinyl ether.

Among the above comonomers, styrene or styrene derivative may preferably be contained as a comonomer for providing the sulfur-containing copolymer.

For providing the sulfur-containing polymer, bulk polymerization, solution polymerization, suspension polymerization or ionic polymerization may be used, but solution polymerization is preferred in view of the processability.

Among the sulfur-containing polymer, the sulfonic acid group-containing polymer may be represented by the following formula $$X(SO_3^-)_n.mY^{k+},$$

wherein X represents polymer sites originated from the above-mentioned monomers, $Y^+$ denotes a counter ion, k denotes a valence of the counter ion, m and n are integers representing the number of the counter ion and the sulfonic acid group in the polymer and satisfying n=k+m. Preferred examples of the counter ion may include: hydrogen, sodium, potassium, calcium and ammonium.

The sulfur-containing polymer as represented by the sulfonic acid group-containing polymer may preferably have an acid value of 3–80 mgKOH/g, more preferably 5–40 mgKOH/g, further preferably 10–30 mgKOH/g. If the acid value is below 3 mgKOH/g, the charge-controlling function intended by the present invention can be lowered and the environmental stability of the resultant toner can be lowered. In excess of 50 mgKOH/g, the resultant toner particles are liable to have distorted shapes showing a lower circularity and the release agent exposed at the surface, thus showing a lower developing performance, especially when they are formed through suspension polymerization.

The sulfur-containing polymer may preferably be contained in 0.01–20 wt. parts, more preferably 0.01–15 wt. parts, further preferably 0.1–10 wt. parts, per 100 wt. parts of the binder resin. If the content is below 0.01 wt. part, the charge controlling function obtained thereby is scarce, and in excess of 20 wt. parts, the resultant toner particles are liable to have a lower circularity, thus causing lowering in developing performance and transferability. The content of the sulfur-containing polymer may be determined by capillary electrophoresis.

The sulfur-containing polymer may preferably have a weight-average molecular weight (Mw) of $2\times10^3$ to $1\times10^5$. If Mw is below $2\times10^3$ the resultant toner is liable to have a lower flowability, and in excess of $1\times10^5$, the solubility thereof in the polymerizable monomer at the time of toner production through the polymerization process is lowered and the dispersibility of the pigment is lowered to result in a toner having a lower coloring power.

The sulfur-containing polymer may preferably have a glass transition temperature (Tg) of 50–100° C. Below 50° C., the resultant toner is liable to have lower flowability and storage stability and also lower transferability. Above 100° C., the fixability is liable to be lowered in the case of a high toner image ratio.

The sulfur-containing polymer may preferably have a volatile matter content of 0.01 to 2.0 wt. %. A volatile matter content below 0.01% requires a complicated volatile matter removal treatment, and in excess of 2.0%, the resultant toner is liable to have inferior chargeability in a high temperature/high humidity environment, particularly after standing for some period. The volatile matter content is determined by a weight loss after standing at 135° C. for 1 hour. Incidentally, the sulfur-containing polymer can be extracted from the toner by an arbitrary method.

The magnetic toner according to the present invention may preferably show an iron-containing particle isolation percentage of 0.05–3.00% (i.e., containing 50 to 300 isolated iron-containing particles (generally comprising magnetic iron oxide particles) per 10,000 toner particles as measured by a particle analyzer ("PT1000", available from Yokogawa Denki K.K.) utilizing plasma luminance from iron and carbon (according to a principle described Japan Hardcopy '97 Paper Collection, pp. 65–68)). An iron-containing particle isolation percentage of at most 3.00% means that the exposure of magnetic powder to the toner particle surface is substantially suppressed, whereby the toner shows a good flowability and shows a good chargeability even in a high humidity environment by suppressing charge relaxation via the exposed magnetic powder. On the other hand, an iron-containing particle isolation percentage of below 0.05% means substantially no isolation of iron-containing particles and thus meaning substantially no exposure of magnetic powder at the toner particle surface. Such toner particles having substantially no charge leakage site may have a high chargeability but is caused to have an excessively large charge in a low humidity environment, thus being liable to fail in providing satisfactory images. For example, when a toner containing magnetic particles confined at the core of toner particles as disclosed in JP-A 7-209904 is subjected to a continuous printing test in a low humidity environment, the toner results in a low image density and a lower transfer efficiency due to excessive charge. Thus, an iron-containing particle isolation percentage of 0.05–3.00%, more preferably 0.05–2.00%, is another preferable feature of the toner according to the present invention.

Next, an average circularity, another characteristic, of the magnetic toner of the present invention will be described.

A toner composed of particles having an average circularity of at least 0.970 exhibits very excellent transferability. This is presumably because the toner particles contact the photosensitive member at a small contact area so that the forces of attachment of toner particles onto the photosensitive member, such as an image force and a van der Waals force, are lowered. Accordingly, if such a toner showing a high transferability is used, it is possible to reduce the toner consumption. Further, toner particle having an average circularity (Cav) of at least 0.970 are substantially free from surface edges, so that localization of charge in each toner particle is less liable to occur and the charge distribution tends to be narrower to allow faithful development of latent images. These effects are further promoted if the toner satisfies a mode circularity (Cmode) of at least 0.99. A mode circularity of at least 0.99 means that a large proportion of toner particles have a shape close to that of a true sphere, thus enhancing the above effect.

The average circularity herein is used as a quantitative measure for evaluating particle shapes and based on values measured by using a flow-type particle image analyzer ("FPIA-1000", mfd. by Toa Iyou Denshi K.K.). A circularity (Ci) of each individual particle (having a circle equivalent diameter ($D_{CE}$) of at least 3.0 $\mu$m) is determined according to an equation (1) below, and the circularity values (Ci) are totaled and divided by the number of total particles (m) to determine an average circularity (Cav) as shown in an equation (2) below:

$$\text{Circularity } Ci = L_0/L, \tag{1}$$

wherein L denotes a circumferential length of a particle projection image, and $L_0$ denotes a circumferential length of a circle having an area identical to that of the particle projection image.

$$\text{Average circularity } (Cav) = \sum_{i=1}^{m} Ci/m \tag{2}$$

Further, the mode circularity (Cmode) is determined by allotting the measured circularity values of individual toner particles to 61 classes in the circularity range of 0.40–1.00, i.e., from 0.400–0.410, 0.410–0.420, . . . , 0.990–1.000 (for each range, the upper limit is not included) and 1.000, and taking the circularity of a class giving a highest frequency as a mode circularity (Cmode).

Incidentally, for actual calculation of an average circularity (Cav), the measured circularity values of the individual particles were divided into 61 classes in the circularity range of 0.40–1.00, and a central value of circularity of each class was multiplied with the frequency of particles of the class to provide a product, which was then summed up to provide an average circularity. It has been confirmed that the thus-calculated average circularity (Cav) is substantially identical to an average circularity value obtained (according to Equation (2) above) as an arithmetic mean of circularity values directly measured for individual particles without the above-mentioned classification adopted for the convenience of data processing, e.g., for shortening the calculation time.

More specifically, the above-mentioned FPIA measurement is performed in the following manner. Into 10 ml of water containing ca. 0.1 mg of surfactant, ca. 5 mg of magnetic toner sample is dispersed and subjected to 5 min. of dispersion by application of ultrasonic wave (20 kHz, 50 W), to form a sample dispersion liquid containing 5,000–20,000 particles/$\mu$l. The sample dispersion liquid is subjected to the FPIA analysis for measurement of the average circularity (Cav) and mode circularity with respect to particles having $D_{CE} \geqq 3.0$ $\mu$m. Incidentally, the reason of using only particles of $D_{CE} \geqq 3.0$ $\mu$m are used is to obviate the contribution of particles having $D_{CE} < 3.00$ including external additive particles contained in the toner.

The average circularity (Cav) used herein is a measure of roundness, a circularity of 1.00 means that the magnetic toner particles have a shape of a perfect sphere, and a lower circularity represents a complex particle shape of the magnetic toner.

As a preferred feature, the magnetic toner particles may preferably retain carbon in an amount of A and iron in an amount of B at surfaces as measured by ESCA or XPS (X-ray photoelectron spectroscopy), satisfying: B/A<0.001, more preferably B/A<0.0005, further preferably B/A<0.0003.

It is preferred that the toner particles of the magnetic toner according to the present invention have a high chargeability, and therefore the toner particles are free from surface-exposed magnetic powder functioning as charge-leakage sites. In the case where a magnetic toner comprising toner particles at the surface of which magnetic powder is exposed, charge is liberated through the exposed magnetic powder. If the charge liberation is caused before the development, i.e., the charge is remarkably low, non-image parts are developed to provide image fog. On the other hand, the charge liberation is caused after the development, the toner is not transferred to the transfer material but remains on the photosensitive member, to result in an image defect such as hollow image dropout. However, if a magnetic toner satisfying B/A<0.001, i.e., substantially free from surface-exposed magnetic powder, is used, it is possible to obtain high-quality images which are substantially free from fog and are faithful to latent images.

The iron/carbon content ratio (B/A) at the toner particle surfaces described herein is based on values measured through surface composition analysis by ESCA (X-ray photoelectron spectroscopy) according to the following conditions.

Apparatus: X-ray photoelectrospectroscope Model "1606S" (made by PHI Co.) Measurement conditions: X-ray source MgKα (400 W) Spectrum region in a diameter of 800 μm.

From the measured peak intensities of respective elements, the surface atomic concentrations are calculated based on relative sensitivity factors provided from PHI Co. For the measurement, a sample toner is washed with a solvent, such as isopropyl alcohol, under application of ultrasonic wave, to remove the inorganic fine powder attached to the magnetic toner particle surfaces, and then the magnetic toner particles are recovered and dried for ESCA measurement.

Next, the particle size of the magnetic toner of the present invention will be described.

In order to accomplish a higher image quality by faithful reproduction of more minute latent image dots, the magnetic toner of the present invention has a weight-average particle size (D4) of 3–10 μm, preferably 4–8 μm. With a toner having D4<3 μm, the transfer efficiency is lowered to increase the transfer residual toner, thus making it difficult to suppress the abrasion of and the toner melt-sticking onto the photosensitive member in the contact charging step. Further, in addition to the increase in total surface area of the toner, the toner powder is liable to have a lower flowability and stirrability so that it becomes difficult to uniformly charge the individual toner particles to result in inferior fog and transferability leading to image irregularity. If D4>10 μm, toner scattering is liable to occur on character or line images, so that it is difficult to obtain a high-resolution image. In an image forming apparatus pursuing a further high resolution, a toner of D4>8 μm is liable to show a lower dot-reproducibility.

The number-basis and volume-basis particle size distributions and average particle sizes may be measured by using, e.g., Coulter counter Model TA-II or Coulter Multicizer (respectively available from Coulter Electronics, Inc.). Herein, these values are determined based on values measured by using Coulter Multicizer connected to an interface (made by Nikkaki K.K.) and a personal computer ("PC9801", made by NEC K.K.) for providing a number-basis distribution and a volume-basis distribution in the following manner. A 1%-aqueous solution is prepared as an electrolytic solution by sing a reagent-grade sodium chloride (it is also possible to use ISOTON R-II (available from Coulter Scientific Japan K.K.)). For the measurement, 0.1 to 5 ml of a surfactant, preferably a solution of an alkylbenzenesulfonic acid salt, is added a a dispersant into 100 to 150 ml of the electrolytic solution, and 2–20 mg of a sample toner is added thereto. The resultant dispersion of the sample in the electrolytic solution is subjected to a dispersion treatment for ca. 1–3 minutes by means of an ultrasonic disperser, and then subjected to measurement of particle size distribution in the range of 2.00–40.30 μm divided into 13 channels by using the above-mentioned Coulter counter with a 100 μm-aperture to obtain a volume-basis distribution and a number-basis distribution. From the volume-basis distribution, a weight-average particle size (D4) is calculated by using a central value as a representative value channel. From the number-basis distribution, a number-average particle size (D1) is calculated.

As is understood from the above description, a preferred dispersion state of magnetic powder in toner particles is such that magnetic powder is dispersed and evenly present in the entirety of toner particles without causing agglomeration. This is another essential feature of the magnetic toner of the present invention. More specifically, based on an observation of a toner particle section through a transmission electron microscope (TEM), at least 50% by number of toner particles are required to satisfy a relationship of $D/C \leqq 0.02$, wherein C represents a volume-average particle size of the toner, and D represents a minimum distance between a toner particle surface and individual magnetic powder particles on a toner particle sectional picture taken through a TEM.

It is further preferred that at least 65% by number, more preferably at least 75% by number, of toner particles satisfy the relationship of $D/C \leqq 0.02$.

In case where less than 50% by number of toner particles satisfy the relationship of $D/C \leqq 0.02$, more than a half of toner particles contain no magnetic powder at all within a shell region outside a boundary defined by D/C=0.02. If such a toner particle is assumed to have a spherical shape, the magnetic powder-free shell region occupies at least ca. 11.5% of the whole particle volume. Moreover, in such a particle, the magnetic powder is not actually present aligning on the boundary of D/C=0.02 so that (magnetic powder is not substantially present) in a superficial portion of ca. 12%. Such a magnetic toner having a magnetic powder-free shell region is liable to suffer from various difficulties as mentioned below.

(1) The magnetic powder is localized at the inner part of a toner particle to increase the possibility of agglomeration of the magnetic powder. As a result, the coloring power of the toner is lowered.

(2) The specific gravity of a toner particle is increased depending on a content of magnetic powder contained therein, but a resinous component (binder and/or wax) is localized at the surface. As a result, if such toner particles are coated with a surface layer by some method, the toner particles are liable to be met-attached to each or deformed to result in a distribution of toner powdery properties which adversely affect the electrophotographic performances and the anti-blocking property during storage.

(3) Toner particles having a surface layer consisting of the binder resin and wax and an inner part with localized magnetic powder are liable to cause embedding of external additive at the softer toner particle surfaces, thus causing an inferior developing performance in a continuous image formation.

The above difficulties of lower coloring power, lower anti-blocking property and inferior continuous image forming performance are liable to be pronounced if the particles of D/C≦0.02 are lower than 50% by number.

For measurement of D/C ratio by observation through a TEM, sample toner particles are sufficiently dispersed in a room temperature-curable epoxy resin, and the epoxy resin is cured for 2 days in an environment of 40° C. to form a cured product, which is then sliced, as it is or after freezing, into thin flake samples by a microtome equipped with a diamond cutter.

The D/C ratio measurement is more specifically performed as follows.

From sectional picture samples photographed through a TEM, particles having a particle size falling within a range of D1±10% (wherein D1 is a number-average particle size of toner particles measured by using a Coulter counter as described above) are selected for determination of D/C ratios. Thus, for each particle thus selected, a minimum distance between the particle surface and magnetic powder particles contained therein (D) is measured to calculate a D/C ratio (relative to the volume-average particle size represented by C) and calculate the percentage by number of toner particles satisfying D/C≦0.02 from the following equation:

Percentage (%) of toner particles satisfying D/C≦0.02= {[number of toner particles satisfying D/C≦0.02 among the selected toner particles on pictures]/[the number of selected toner particles (i.e., particles having a circle equivalent diameter) falling in a range of D1±10% (D1: number-average particle size) on the pictures]}×100.

The percentage values (of D/C≦0.02) described herein are based on pictures at a magnification of 10,000 photographed through a transmission electron microscope ("H-600", made by Hitachi K.K.) at an acceleration voltage of 100 kV.

The magnetic toner of the present invention has a magnetization of 10–50 $Am^2/kg$ (emu/g) as measured at a magnetic field of 79.6 kA/m (1000 oersted). Below 10 $Am^2/kg$, it is difficult to sufficiently effect fog prevention even if the triboelectric chargeability is improved by the control of the toner shape and addition of the sulfur-containing polymer. Above 50 $Am^2/kg$, it is also difficult to prevent the lowering in developing performance. The magnetic toner may be provided with the above-mentioned level of magnetization by adjusting the amount of magnetic powder added to the toner. The magnetization values described herein are based on values measured by using an oscillation-type magnetometer ("VSMP-1-10", made by Toei Kogyo K.K.) under an external field of 79.6 kA/m at room temperature (25° C.).

It is preferred that the iron oxide particles (magnetic particles) constituting the magnetic toner of the present invention have a volume-average particle size of 0.1–0.3 μm and contain at most 40% by number of particles of 0.03–0.1 μm, based on measurement of particles having particle sizes of at least 0.03 μm.

Iron oxide particles having an average particle size of below 0.1 μm are not generally preferred because they are liable to provide a magnetic toner giving images which are somewhat tinted in red and insufficient in blackness with enhanced reddish tint in halftone images. Such a toner, when used in color image formation is liable to fail in satisfactory color reproduction and result in a distortion of color space. Further, as the iron oxide particles are caused to have an increased surface area, the dispersibility thereof is lowered, and an inefficiently larger energy is consumed for the production. Further, the coloring power of the iron oxide particles can be lowered to result in insufficient image density in some cases.

On the other hand, if the iron oxide particles have an average particle size in excess of 0.3 μm, the weight per one particle is increased to increase the probability of exposure thereof to the toner particle surface due to a specific gravity difference with the binder during the production. Further, the wearing of the production apparatus can be promoted and the dispersion thereof is liable to become unstable.

Further, if particles of 0.1 μm or smaller exceed 4% by number of total particles (having particle sizes of 0.03 μm or larger), the iron oxide particles are liable to have a lower dispersibility because of an increased surface area, liable to form agglomerates in the toner to impair the toner chargeability, and are liable to have a lower coloring power. If the percentage is lowered to at most 30% by number, the difficulties are preferably alleviated.

Incidentally, iron oxide particles having particle sizes of below 0.03 μm receive little stress during the toner production so that the probability of exposure thereof to the toner particle surface is low. Further, even if such minute particles are exposed to the toner particle surface, they do not substantially function as leakage sites lowering the chargeability of the toner particles. Accordingly, the particles of 0.03–0.1 μm are noted herein, and the percentage by number thereof is suppressed to below a certain limit.

On the other hand, if particles of 0.3 μm or larger exceed 10% by number, the iron oxide particles are caused to have a lower coloring power, thus being liable to result in a lower image density. It is further preferred that the percentage be suppressed to at most 5% by number.

In the present invention, it is preferred that the iron oxide production conditions are adjusted so as to satisfy the above-mentioned conditions for the particle size distribution, or the produced iron oxide particles are used for the toner production after adjusting the particle size distribution as by pulverization and/or classification. The classification may suitably be performed by utilizing sedimentation as by a centrifuge or a thickener, or wet classification using, e.g., a cyclone.

The volume-average particle size and particle size distribution of iron oxide particles described herein are based on values measured in the following manner.

Sample magnetic particles above or toner particles containing magnetic particles are sufficiently dispersed in epoxy resin, followed by curing at 40° C. for 2 days, and flake samples sliced by a microtone are photographed at a magnification of $1\times10^4$–$4\times10^4$ through a transmission electron microscope (TEM), whereby 100 particles each having a particle size of at least 0.03 μm selected at random in visual fields of the taken photographs are subjected to measurement of projection areas. The particle size (projection area-equivalent circle diameter) of each particle is determined as a diameter of a circle having an area equal to the measured projection area of the particle. Based on the measured particle sizes of the 100 particles, a volume-average particle size, percentage by number of particles of 0.03 μm–0.1 μm and percentage by number of particles of 0.3 μm or larger are determined.

The iron oxide used as a magnetic material in the toner of the present invention may principally comprise triiron tetroxide or γ-iron oxide optionally containing one or more elements, such as cobalt, nickel, copper, magnesium, manganese, aluminum or silicon. A mixture of two or more species can also be used. It is particularly preferred to use a magnetite-based magnetic material.

The iron oxide particles may have a polygonal shape of octahedron, hexahedron or a polygon having 14 plane faces. This is preferred to provide a higher bulk volume compared with spherical particles, thus lowering the agglomeratability to provide an improved dispersibility during toner production. Such particle shapes may be confirmed by observation through a scanning electron microscope (SEM). A shape giving the largest number-basis percentage is taken as the shape of the sample magnetic powder.

The magnetic powder may preferably be used in a proportion of 20–200 wt. parts per 100 wt. parts of the binder resin.

The magnetic toner of the present invention may preferably be produced through a polymerization process. The magnetic toner according to the present invention can also be produced through the pulverization process, but toner particles produced by the pulverization are generally caused to have indefinite shapes. Accordingly, in order to obtain a circularity of at least 0.970 as an essential requirement of the magnetic toner of the present invention (and preferably also a mode circularity of at least 0.99), the toner particle have to be subjected to some special mechanical or thermal treatment. Further, according to the pulverization process, magnetic powder is inevitably exposed to the surface of the resultant toner particles, so that it is difficult to obtain a ratio (B/A) of below 0.001 between the iron content (A) and the carbon content (A) at the toner particle surfaces as measured by the X-ray photoelectron spectroscopy, thus making it difficult to solve the problem of abrasion of the photosensitive member. For overcoming the above-mentioned problems in production, the magnetic toner according to the present invention may preferably be produced through a polymerization process, particularly a suspension polymerization process.

Examples of the polymerization process or toner production may include direct polymerization, suspension polymerization, emulsion polymerization, emulsion-association polymerization and seed polymerization. Among these, however, suspension polymerization is preferred in view of easiness of attaining a good combination of particle size and particle shape. The suspension polymerization process for producing a magnetic toner according to the present invention is a process of obtaining a monomeric mixture by uniformly dissolving or dispersing a monomer and magnetic powder (and, optionally, other additives, such as wax, a colorant, a crosslinking agent and charge control agent), dispersing the monomeric mixture in an aqueous medium (e.g., water) containing a dispersion stabilizer by means of an appropriate stirrer, and subjecting the dispersed monomeric mixture to suspension polymerization in the presence of a polymerization initiator to obtain toner particles of a desirable particle size.

The toner polymerized through the suspension polymerization process (hereinafter sometimes referred to as a "polymerization toner" is caused to comprise individual toner particles having a uniformly spherical shape, so that it is easy to obtain a toner having a circularity of at least 0.970 as an essential physical requirement of the present invention and also a mode circularity of at least 0.99 as a preferred property, and further such a toner has a relatively uniform chargeability distribution, thus exhibiting a high transferability.

Further, the polymerizate particles can be further coated with a surface layer formed by further adding a polymerizable monomer and a polymerization initiator to form a core-shell structure, as desired.

However, by using a monomeric mixture containing ordinary magnetic powder at the time of suspension polymerization, it is difficult to suppress the exposure of the magnetic powder to the resultant toner particle surface, the resultant toner particles are liable to have remarkably lower flowability and chargeability, and also it is difficult to obtain a toner having a circularity of at least 0.970 because of strong interaction between the magnetic powder and water. This is firstly because magnetic powder particles are generally hydrophilic, thus being liable to be localized at the toner particle surfaces, and secondly because at the time of suspension of the monomeric mixture in an aqueous medium or at the time of stirring the suspension liquid during the polymerization, the magnetic powder is moved at random within the suspended liquid droplets and the suspended liquid droplet surfaces comprising the monomer are pulled by the randomly moving magnetic powder, thereby distorting the liquid droplets from spheres. In order to solve such problems, it is important to modify the surface properties of magnetic powder particles.

Many proposals have been made regarding surface modification of magnetic powder used in polymerization toner production. For example JP-A 59-200254, JP-A 59-200256, JP-A 59-200257 and JP-A 59-224102 have proposed the treatment of magnetic powder with various silane coupling agents. JP-A 63-250660 has disclosed the treatment of silicon-containing magnetic particles with a silane coupling agent.

These treatments are effective to some extent for suppressing the exposure of magnetic powder at the toner particle surfaces, but are accompanied with difficulty in uniform hydrophobization of the magnetic powder surface. As a result, it has been impossible to completely obviate the coalescence of the magnetic powder particles and the occurrence of untreated magnetic powder particles, thus being insufficient to completely suppress the exposure of the magnetic powder. As an example of using hydrophobized magnetic iron oxide, JP-B 60-3181 has proposed a toner containing magnetic iron oxide treated with alkyltrialkoxysilanes. The thus-treated magnetic iron oxide is actually effective for providing a toner exhibiting improved electrophotographic performances. The surface activity of the magnetic iron oxide is inherently low and has caused coalescence of particles or ununiform hydrophobization during the treatment. As a result, the magnetic iron oxide has left a room for further improvement for application to an image forming method as contemplated in the present invention.

Further, if a larger amount of hydrophobization agent is used or a hydrophobization agent of a higher viscosity is used, a higher hydrophobicity can be actually obtained, but the dispersibility of the treated magnetic powder is rather lowered because of increased coalescence of magnetic powder particles. A toner prepared by using such a treated magnetic powder is liable to have an ununiform triboelectric chargeability and is accordingly liable to fail in providing anti-fog property or transferability.

As for magnetic powder used in the magnetic toner of the present invention, it is extremely preferred that the magnetic powder particles are surface-treated for hydrophobization by dispersing magnetic powder particles in an aqueous medium into primary particles thereof, and while maintaining the primary particle dispersion state, hydrolyzing a coupling agent in the aqueous medium to surface-coat the magnetic powder particles. According to this hydrophobization method in an aqueous medium, the magnetic powder particles are less liable to coalesce with each other than in a dry surface-treatment in a gaseous system, and the magnetic powder particles can be surface-treated while maintaining the primary particle dispersion state due to electrical repulsion between hydrophobized magnetic powder particles.

The method of surface-treatment of magnetic powder with a coupling agent while hydrolyzing the coupling agent in an aqueous medium does not require gas-generating coupling agents, such as chlorosilanes or silazanes, and allows the use of a high-viscosity coupling agent which has been difficult to use because of frequent coalescence of magnetic powder particles in a conventional gaseous phase treatment, thus exhibiting a remarkable hydrophobization effect.

As a coupling agent usable for surface-treating the magnetic powder used in the present invention, a silane coupling agent or a titanate coupling agent may be used. A silicone coupling agent is preferred, and examples thereof may be represented by the following formula (I):

$$R_mSiY_n \quad \text{(I)},$$

wherein R denotes an alkoxy group, Y denotes a hydrocarbon group, such as alkyl, vinyl, glycidoxy or methacryl, and m and n are respectively integers of 1–3 satisfying m+n=4.

Examples of the silane coupling agents represented by the formula (I) may include: vinyltrimethoxysilane, vinyltriethoxysilane, gamma-methacryloxypropyltrimethoxysilane, vinyltriacetoxysilane, methyltrimethoxysilane, methyltriethoxysilane, isobutyltrimethoxysilane, dimethyldimethoxysilane, dimethyldiethoxysilane, trimethylmethoxysilane, hydroxypropyltrimethoxysilane, phenyltrimethoxysilane, n-hexadecyltrimethoxysilane, and n-octadecyltrimethoxysilane.

It is particularly preferred to use an alkyltrialkoxysilane coupling agent represented by the following formula (II) to treat the magnetic powder for hydrophobization in an aqueous medium:

$$C_pH_{2p+1}—Si—(OC_qH_{2q+1})_3 \quad \text{(II)},$$

wherein p is an integer of 2–20 and q is an integer of 1–3.

In the above formula (II), if p is smaller than 2, the hydrophobization treatment may become easier, but it is difficult to impart a sufficient hydrophobicity, thus making it difficult to suppress the exposure of the magnetic powder to the toner particle surfaces. On the other hand, if p is larger than 20, the hydrophobization effect is sufficient, but the coalescence of the magnetic powder particles becomes frequent, so that it becomes difficult to sufficiently disperse the treated magnetic powder particles in the toner, thus being liable to result in a toner exhibiting lower fog-prevention effect and transferability.

If q is larger than 3, the reactivity of the silane coupling agent is lowered, so that it becomes difficult to effect sufficient hydrophobization.

In the above formula (II), it is particularly preferred that p is an integer of 3–15, and q is an integer of 1 or 2.

The coupling agent may preferably be used in 0.05–20 wt. parts, more preferably 0.1–10 wt. parts, per 100 wt. parts of the magnetic powder.

Herein, the term "aqueous medium" means a medium principally comprising water. More specifically, the aqueous medium includes water alone, and water containing a small amount of surfactant, a pH adjusting agent or/and an organic solvent. As the surfactant, it is preferred to use a nonionic surfactant, such as polyvinyl alcohol. The surfactant may preferably be added in 0.1–5 wt. parts per 100 wt. parts of water. The pH adjusting agent may include an inorganic acid, such as hydrochloric acid. The organic solvent may include methanol which may preferably be added in a proportion of at most 500 wt. % of water.

For the surface-treatment of magnetic powder with a coupling agent in an aqueous medium, appropriate amounts of magnetic powder and coupling agent may be stirred in an aqueous medium. It is preferred to effect the stirring by means of a mixer having stirring blades, e.g., a high-shearing force mixer (such as an attritor or a TK homomixer) so as to disperse the magnetic powder particles into primary particles in the aqueous medium under sufficient stirring.

The thus-surface treated magnetic powder is free from particle agglomerates and individual particles are uniformly surface-hydrophobized. Accordingly, the magnetic powder is uniformly dispersed in polymerization toner particles to provide almost spherical polymerization toner particles which are free from surface-exposure of the magnetic powder and a very narrow particle size distribution. Accordingly, by using magnetic powder treated in the above-described manner, it becomes possible to obtain a toner having an average circularity (Cav) of at least 0.970, particularly also a mode circularity (Cmode) of at least 0.99, and an iron (B) to carbon (A) content ratio (B/A) at the toner surface of below 0.001 as measured by XPS.

The magnetic powder used in the present invention may preferably exhibit magnetic properties inclusive of a saturation magnetization of 10–200 $Am^2/kg$ at a magnetic field of 795.8 kA/m, a residual magnetization of 1–100 $Am^2/kg$ and a coercive force of 1–30 kA/m.

The magnetic properties of magnetic powder referred to herein are based on values measured by using an oscillation-type magnetometer ("VSMP-1-10", made by Toei Kogyo K.K.) at 25° C. and by applying an external magnetic field of 796 kA/m.

As mentioned above, the magnetic toner of the present invention is required to have a magnetization of 10–50 $Am^2/kg$ (emu/g) as measured at a magnetic field of 79.6 kA/m (1000 oersted).

In contrast with a saturation magnetization (magnetization at magnetic saturation) used for a magnetic material, the magnetization at a magnetic field of 79.6 kA/m is used as a property for defining the magnetic toner of the present invention. The magnetic field has been selected as a magnetic field actually acting on the magnetic toner in image forming apparatus. In case where a magnetic toner is used in an image forming apparatus, the level of magnetic field acting the magnetic toner is on the order of several tens to one hundred and several tens kA/m in the case of currently commercially available most image forming apparatus so as not to increase the leakage of magnetic field of the apparatus or not to incur an increase in cost of the magnetic field generating source. Accordingly, the magnetic field of 79.6 kA/m has been selected.

A magnetic toner is held within a developing device without causing toner leakage by disposing a magnetic force generating means in the developing device. The conveyance and stirring of the magnetic toner are also effected under a magnetic force. By disposing a magnetic force generating means so that the magnetic force acts on the toner-carrying member, the recover of transfer residual toner is further promoted and toner scattering is prevented by forming ears of magnetic toner on the toner-carrying member. If the toner has a magnetization of below 10 $Am^2/kg$ at a magnetic field of 79.6 kA/m, it becomes difficult to attain the above effect, and toner ear formation on the toner-carrying member becomes unstable, thus failing to provide uniform charge to the toner. As a result, image defects, such as fog, image density irregularity and recovery failure of transfer-residual toner are liable to be caused. If the magnetization exceeds 50 $Am^2/kg$, the toner particles are liable to have an increased magnetic agglomeratability, to result in remarkably lower flowability and transferability. As a result, the transfer-residual toner is increased, thus being liable to lower the image quality. Further, an increase of the magnetic material amount for providing an increased magnetization is liable to lower the fixability of the toner. By controlling the appropriate level of magnetization in addition to the increase average circularity (and mode circularity), the magnetic toner of the present invention can form thin and dense ears on the toner-carrying member, so that the toner is uniformly charged to remarkably reduce the fog.

The magnetic toner according to the present invention can also contain another colorant in addition to the magnetic material. Examples of such another colorant may include: magnetic or non-magnetic inorganic compounds and known dyes and pigments. Specific examples thereof may include: particles of ferromagnetic metals, such as cobalt and nickel, alloys of these metals with chromium, manganese, copper, zinc, aluminum and rare earth elements, hematite, titanium black, nigrosine dye/pigment, carbon black and phthalocyanine. Such another colorant can also be surface-treated.

The magnetic toner according to the present invention may preferably further contain 0.5–50 wt. parts of a release agent per 100 wt. parts of the binder resin. Various waxes as described below may for example be used as the release agent.

A toner image transferred onto a transfer material is fixed onto the transfer material under application of energy, such as heat and/or pressure, to form a semipermanent image. In this instance, a hot-roller fixation scheme and a film fixation scheme are frequently used.

As mentioned above, the use of small toner particles having a weight-average particle size of at most 10 $\mu$m provides a very high definition image, but such small toner particles are liable to enter gaps between fibers of paper as a typical transfer material, so that heat supply thereto form a heat fixing roller is liable to be insufficient to cause low-temperature offset. However, the inclusion of an appropriate wax allows to satisfy high resolution and anti-offset property in combination.

Examples of the release agent usable in the magnetic toner of the present invention may include: petroleum waxes and derivatives thereof, such as paraffin wax, microcrystalline wax and petrolactum; montan wax and derivatives thereof; hydrocarbon wax by Fischer-Tropsch process and derivative thereof; polyolefin waxes as represented by polyethylene wax and derivatives thereof; and natural waxes, such as carnauba wax and candelilla wax and derivatives thereof. The derivatives may include oxides, block copolymers with vinyl monomers, and graft-modified products. Further examples may include: higher aliphatic alcohols, fatty acids, such as stearic acid and palmitic acid, and compounds of these, acid amide wax, ester wax, ketones, hardened castor oil and derivatives thereof, negative waxes and animal waxes. Anyway, it is preferred to use a wax showing a heat-absorption peak temperature (Tabs) in a temperature range of 40–110° C., further preferably 45–90° C. Further, in order to provide a magnetic toner showing Tabs in a range of 40–65° C., it is possible to use a wax exhibiting Tabs in a range of 40–65° C.

In the magnetic toner of the present invention, the release agent may preferably be contained in 0.5–50 wt. parts, per 100 wt. parts of the binder resin. Below 0.5 wt. part, the low-temperature offset preventing effect is insufficient, and above 50 wt. parts, the storability for a long period of the toner becomes inferior, and the dispersibility of other toner ingredients is impaired to result in lower flowability of the toner and lower image qualities.

The heat-absorption peak temperature (Tabs) of a release agent may be measured by differential thermal analysis similarly as a heat-absorption peak of a wax as described hereinafter. More specifically, the glass transition temperature may be measured by using a differential scanning calorimeter (DSC) (e.g., "DSC-7", available from Perkin-Elmer Corp.) according to ASTM D3418-8. Temperature correction of the detector may be effected based on melting points of indium and zinc, and calorie correction may be affected based on heat of fusion of indium. A sample is placed on an aluminum pan and subjected to heat at an increasing rate of 10° C./min in parallel with a blank aluminum pan as a control. The apparatus may also be used for measurement of glass transition temperature (Tg) of a binder resin, and the sulfur-containing polymer.

For determining the glass transition temperature (Tg), a second heat-increase curve of DSC is used and a middle line is drawn between and a parallel to base lines before and after a heat-absorption peak to determine a temperature of intersection of the middle line and a rising curve giving the peak.

The magnetic toner of the present invention can further contain a charge control agent so as to stabilize the chargeability. Known charge control agents can be used. It is preferred to use a charge control agent providing a quick charging speed and stably providing a constant charge. In the case of polymerization toner production, it is particularly preferred to use a charge control agent showing low polymerization inhibition effect and substantially no solubility in aqueous dispersion medium. However, it is not essential for the magnetic toner of the present invention to contain a charge control agent, but the toner need not necessarily contain a charge control agent by positively utilizing the triboelectrification with a toner layer thickness-regulating member and a toner-carrying member.

Next, a process for producing the magnetic toner of the present invention according to suspension polymerization will now be described.

Examples of polymerizable monomers constituting a polymerizable monomer mixture in the suspension polymerization system may include: styrene monomers, such as styrene, o-methylstyrene, m-methylstyrene, p-methylstyrene, p-methoxystyrene and p-ethylstyrene; acrylate esters, such as methyl acrylate, ethyl acrylate, n-butyl acrylate, isobutyl acrylate, n-propyl acrylate, n-octyl acrylate, dodecyl acrylate, 2-ethylhexyl acrylate, stearyl acrylate, 2-chloroethyl acrylate and phenyl acrylate; methacrylate esters, such as methyl methacrylate, ethyl methacrylate, n-propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate, and diethylaminoethyl methacrylate; acrylonitrile, methacrylonitrile and acrylamide. These monomers may be used singly or in mixture. Among these, styrene or a styrene derivative may preferably be used singly or in mixture with another monomer so as to provide a toner with good developing performances and continuous image forming performances.

In preparation of the toner of the present invention by polymerization, it is possible to incorporate a resin in the monomer mixture. For example, in order to introduce a polymer having a hydrophillic functional group, such as amino, carboxyl, hydroxyl, sulfonic acid, glicidyl or nitrile, of which the monomer is unsuitable to be used in an aqueous suspension system because of its water-solubility resulting in emulsion polymerization, such a polymer unit may be incorporated in the monomer mixture in the form of a copolymer (random, block or graft-copolymer) of the monomer with another vinyl monomer, such as styrene or ethylene; or a polycondensate, such as polyester or polyamide; or polyaddition-type polymer, such as polyether or polyimine. If a polymer having such a polar functional group is included in the monomer mixture to be incorporated in the product toner particles, the phase separation of the wax is promoted to enhance the encapsulation of the wax, thus providing a toner with better anti-offset property, anti-blocking property, and low-temperature fixability.

Further, for the purpose of improving the dispersibility of ingredients and the fixability and image forming performance of the resultant toner, it is possible to add a resin other than the above in the monomeric mixture. Examples of such another resin may include: homopolymers of styrene and its substituted derivatives, such as polystyrene and polyvinyltoluene; styrene copolymers, such as styrene-propylene copolymer, styrene-vinyltoluene copolymer, styrene-vinylnaphthalene copolymer, styrene-methyl acrylate copolymer, styrene-ethyl acrylate copolymer, styrene-butyl acrylate copolymer, styrene-octyl acrylate copolymer, styrene-dimethylaminoethyl acrylate copolymer, styrene-methyl methacrylate copolymer, styrene-ethyl methacrylate copolymer, styrene-butyl methacrylate copolymer, styrene-dimethylaminoethyl methacrylate copolymer, styrene-vinyl methyl ether copolymer, styrene-vinyl ethyl ether copolymer, styrene-vinyl methyl ketone copolymer, styrene-butadiene copolymer, styrene-isoprene copolymer, styrene-maleic acid copolymer, and styrene-maleic acid ester copolymers; polymethyl methacrylate, polybutyl methacrylate, polyvinyl acetate, polyethylene, polypropylene, polyvinyl butyral, silicone resin, polyester resin, polyamide resin, epoxy resin, polyacrylic acid resin, rosin, modified rosin, terpene resin, phenolic resin, aliphatic or alicyclic hydrocarbon resins, and aromatic petroleum resin. These resins may be used singly or in combination of two or more species.

Such a resin may preferably be added in 1–20 wt. parts per 100 wt. parts of the monomer. Below 1 wt. part, the addition effect thereof is scarce, and above 20 wt. parts, the designing of various properties of the resultant polymerization toner becomes difficult.

Further, if a polymer having a molecular weight which is different from that of the polymer obtained by the polymerization is dissolved in the monomer for polymerization, it is possible to obtain a toner having a broad molecular weight distribution and thus showing a high anti-offset property.

For the preparation of a polymerization toner, a polymerization initiator exhibiting a halflife of 0.5–30 hours at the polymerization temperature may be added in an amount of 0.5–20 wt. % of the polymerizable monomer so as to obtain a polymer exhibiting a maximum in a molecular weight range of $1\times10^4$–$1\times10^5$, thereby providing the toner with a desirable strength and appropriate melt-characteristics. Examples of the polymerization initiator may include: azo- or diazo-type polymerization initiators, such as 2,2'-azobis-(2,4-dimethylvaleronitrile), 2,2'-azobisisobutyronitrile, 1,1'-azobis(cyclohexane-2-carbonitrile), 2,2'-azobis-4-methoxy-2,4-dimethylvaleronitrile, azobisisobutyronitrile; and peroxide-type polymerization initiators such as benzoyl peroxide, t-butyl peroxy-2-ethylhexanoate, t-butyl peroxypivolate, t-butyl peroxyisobutyrate, t-butyl peroxyneodecanoate, methyl ethyl ketone peroxide, diisopropyl peroxycarbonate, cumene hydroperoxide, 2,4-dichlorobenzoyl peroxide, and lauroyl peroxide.

The polymerizable monomer mixture can further contain a crosslinking agent in a proportion of preferably 0.001–15 wt. % of the polymerizable monomer.

In the polymerization toner production, it is possible to use a molecular weight-adjusting agent, examples of which may include: mercaptans, such as t-dodecyl mercaptan, n-dodecyl mercaptan, and n-octyl mercaptan; halogenated hydrocarbons, such as carbon tetrachloride, and carbon tetrabromide; and α-methylstyrene dimer. Such a molecular weight-adjusting agent may be added either before or during the polymerization in an amount of ordinarily 0.01–10 wt. parts, preferably 0.1–5 wt. parts, per 100 wt. parts of the polymerizable monomer.

In the toner production by suspension polymerization, a polymerizable monomer mixture is formed by mixing the polymerizable monomer and the iron oxide with other toner ingredients, as desired, such as a colorant, a release agent, a plasticizer, another polymer and a crosslinking agent, and further adding thereto other additives, such as an organic solvent for lowering the viscosity of the polymer produced in the polymerization, a dispersing agent, etc. The thus-obtained polymerizable monomer mixture is further subjected to uniform dissolution or dispersion by a dispersing means, such as a homogenizer, a ball mill, a colloid mill or an ultrasonic disperser, and then charged into and suspended in an aqueous medium containing a dispersion stabilizer. In this instance, if the suspension system is subjected to dispersion into a desired toner size without a break by using a high-speed dispersing machine, such as a high-speed stirrer or an ultrasonic disperser, the resultant toner particles are provided with a sharper particle size distribution. The polymerization initiator may be added to the polymerizable monomer together with other ingredients as described above or immediately before suspension into the aqueous medium. Alternatively, it is also possible to add the polymerization initiator as a solution thereof in the polymerizable monomer or a solvent to the suspension system immediately before the initiation of the polymerization.

After the particle or droplet formation by suspension in the above-described manner using a high-speed dispersion means, the system is stirred by an ordinary stirring device so as to retain the dispersed particle state and prevent the floating or sedimentation of the particles.

In the suspension polymerization process, a known surfactant, or organic or inorganic dispersant, may be used as the dispersion stabilizer. Among these, an inorganic dispersant may preferably be used because it is less liable to result in deleterious ultrafine powder, the resultant dispersion stability is less liable to be broken even at a reaction temperature change because the dispersion stabilization effect is attained by its stearic hindrance, and it is easily washed to be free from leaving adverse effect to the toner. Examples of the inorganic dispersant may include: polyvalent metal phosphates, such as calcium phosphate, magnesium phosphate, aluminum phosphate and zinc phosphate; carbonates, such as calcium carbonate and magnesium carbonate; inorganic salts, such as calcium metasilicate, calcium sulfate and barium sulfate; and inorganic oxides, such as calcium hydroxide, magnesium hydroxide, aluminum hydroxide, silica, bentonite and alumina.

These inorganic dispersant may be used singly or in combination of two or more species in 0.2–20 wt. parts per 100 wt. parts of the polymerizable monomer. In order to obtain toner particles having a further small average size of, e.g., at most 5 μm, it is also possible to use 0.001–0.1 wt. part of a surfactant in combination. Examples of the surfactant may include: sodium dodecylbenzene sulfate, sodium tetradecyl sulfate, sodium pentadecyl sulfate, sodium octyl sulfate, sodium oleate, sodium laurate, sodium stearate, and potassium stearate.

Such an inorganic dispersant as described above may be used in a commercially available state as it is, but in order to obtain fine particles thereof, such an inorganic dispersant may be produced in an aqueous medium prior to dispersion of the polymerizable monomer mixture in the aqueous system. For example, in the case of calcium phosphate, sodium phosphate aqueous solution and calcium aqueous chloride aqueous solution may be blended under high-speed stirring to form water-insoluble calcium phosphate allowing more uniform and finer dispersion. At this time, water-soluble sodium chloride is by-produced, but the presence of a water-soluble salt is effective for suppressing the dissolution of a polymerizable monomer in the aqueous medium, thus suppressing the production of ultrafine toner particles due to emulsion polymerization, and thus being more convenient. The presence of a water-soluble salt however can obstruct the removal of the residual polymerizable monomer in the final stage of polymerization, so that it is advisable to exchange the aqueous medium or effect desalting with ion-exchange resin. The inorganic dispersant can be removed substantially completely by dissolution with acid or alkali after the polymerization.

In the polymerization step, the polymerization temperature may be set to at least 40° C., generally in the range of 50–90° C. By polymerization in this temperature range, the release agent or wax to be enclosed inside the toner particles may be precipitated by phase separation to allow a more complete enclosure. In order to consume a remaining portion of the polymerizable monomer, the reaction temperature may possibly be raised up to 90–150° C. in the final stage of polymerization.

The toner particles of the present invention may preferably be blended with inorganic fine powder for surface attachment onto the toner particles to provide the toner according to the present invention.

It is also a preferred mode of modification to subject the recovered polymerizate toner particles to a classification step for removal of a coarse and a fine powder fraction.

In the case of producing the toner of the present invention through a pulverization process, a known process may be adopted. For example, essential ingredients of the toner including the binder resin, the iron oxide, a release agent, a charge control agent, and optionally, a colorant, and other additives, may be sufficiently blended in a mixing means, such as a Henschel mixer or a ball mill, and then melt-kneaded by a hot heating means, such as hot rollers, a kneader or an extruder, to melt-mixing the resins and disperse or dissolve other ingredients including the iron oxide in the resin. After cooling, the melt-kneaded product is pulverized, classified and optionally surface-treated to obtain toner particles, which are then blended with external additives such as a flowability improver to obtain the toner according to the present invention. The classification and the surface treatment can be performed in this order or in a reverse order. The classification may preferably be performed by using a multi-division classifier in view of the production efficiency. The pulverization may be performed by using known pulverizing apparatus of the mechanical impact type or the jetting type. In order to attain a specific circularity of the toner of the present invention, it is preferred to effect the pulverization under heating or apply a supplementary mechanical impact. It is also possible to subject the toner particles after pulverization (and optionally further classification) to dispersion in a hot water bath or passage through a hot gas stream.

The application of a mechanical impact may be effected by using, e.g., "Kryptron" system (available from Kawasaki Jukogyo K.K.) or "Turbo Mill" (available from Turbo Kogyo K.K.). It is also possible to use a system wherein toner particles are directed toward a casing inner wall by blades rotating at a high speed so as apply a mechanical impact as by compression and friction to the toner particles, such as "Mechano-Fusion" system (available from Hosokawa Micron K.K.) or "Hybridization" system (available from Nara Kikai Seisakusho K.K.).

In the case of applying a mechanical impact as a surface treatment, the environment temperature for the treatment may preferably be set in the neighborhood of the glass transition point Tg of the toner (i.e., in a range of Tg±10° C.) from the viewpoint of prevention of agglomeration and productivity. The treatment in the temperature range of Tg±5° C. is further preferred so as to particularly effectively increase the transfer efficiency.

It is also possible to produce the toner of the present invention according to a method of using a disk or a multi-fluid nozzle for spraying the melt-mixture into the air to form spherical toner particles as disclosed in JP-B 56-13945; a method of directly producing toner particles through polymerization in an aqueous organic solvent wherein the monomer is soluble but the resultant polymer is insoluble; or an emulsion polymerization method as represented by a soap-free polymerization wherein toner particles are directly produced by polymerization in the presence of a water-soluble polymerization initiator.

Examples of the binder resin for producing the toner according to the present invention through the pulverization process may include: homopolymers of styrene and its substitution derivatives, such as polystyrene and polyvinyltoluene; styrene copolymers, such as styrene-propylene copolymer, styrene-vinyltoluene copolymer, styrene-vinylnaphthalene copolymer, styrene-methyl acrylate copolymer, styrene-ethyl acrylate copolymer, styrene-butyl acrylate copolymer, styrene-octyl acrylate copolymer, styrene-dimethylaminoethyl acrylate copolymer, styrene-methyl methacrylate copolymer, styrene-ethyl methacrylate copolymer, styrene-butyl methacrylate copolymer, styrene-dimethylaminoethyl methacrylate copolymer, styrene-vinyl methyl ether copolymer, styrene-vinyl ethyl ether copolymer, styrene-vinyl methyl ketone copolymer, styrene-butadiene copolymer, styrene-isoprene copolymer, styrene-maleic acid copolymer, and styrene-maleic acid ester copolymer; polymethyl methacrylate, polybutyl methacrylate, polyvinyl acetate, polyethylene, polypropylene, polyvinyl butyral, silicone resin, polyester resin, polyamide resin, epoxy resin, polyacrylic acid resin, rosin, modified rosin, terpene resin, phenolic resin, aliphatic or alicyclic hydrocarbon resin, aromatic petroleum resin, paraffin wax, and carnauba resin. These resins may be used singly or in mixture of two or more species. Styrene copolymers and polyester resins are particularly preferred in view of developing performances and fixability.

For preparation of the magnetic toner of the present invention, it is also possible to blend a charge control agent in mixture with toner particles for providing a chargeability optimum for the developing system.

It is also very preferred that the magnetic toner of the present invention contains inorganic fine powder having an average primary particle size of 4–80 nm as a flowability-improving agent in a proportion of 0.1–4 wt. % of the toner. The inorganic fine powder is added principally for the purpose of improving the toner flowability and charge uniformization of toner particles but may preferably exhibit function of adjustment of chargeability and environmental stability of the toner by treatments such as hydrophobization.

In case where the inorganic fine powder has a number-average primary particle size larger than 80 nm, the transfer-residual toner particles, when attached to the charging member, are liable to stick to the charging member, so that it becomes difficult to stably attain good uniform chargeability of the image-bearing member. Further, it becomes difficult to attain good toner flowability, and the toner particles are liable to be ununiformly charged to result in problems, such as increased fog, image density lowering and toner scattering. In case where the inorganic fine powder has a number-average primary particle size below 4 nm, the inorganic fine powder is caused to have strong agglomeratability, so that the inorganic fine powder is liable to have a broad particle size distribution including agglomerates of which the disintegration is difficult, rather than the primary particles, thus being liable to result in image defects such as image dropout due development with the agglomerates of the inorganic fine powder and defects attributable to damages on the image-bearing member, developer-carrying member or contact charging member, by the agglomerates. In order to provide a more uniform charge distribution of toner particles, it is further preferred that the number-average primary particle size of the inorganic fine powder is in the range of 6–35 nm.

The number-average primary particle size of inorganic fine powder described herein is based on the values measured in the following manner. A developer sample is photographed in an enlarged form through a scanning electron microscope (SEM) equipped with an elementary analyzer such as an X-ray microanalyzer (XMA) to provide an ordinary SEM picture and also an XMA picture mapped with elements contained in the inorganic fine powder. Then, by comparing these pictures, the sizes of 100 or more inorganic fine powder primary particles attached onto or isolated from the toner particles are measured to provide a number-average particle size.

The content of the inorganic fine powder may be determined by fluorescent X-ray analysis while referring to calibration curve prepared by using standard samples.

The inorganic fine powder used in the present invention may preferably comprise fine powder of at least one species selected from the group consisting of silica, titania and alumina.

For example, silica fine powder may be dry process silica (sometimes called fumed silica) formed by vapor phase oxidation of a silicon halide or wet process silica formed from water glass. However, dry process silica is preferred because of fewer silanol groups at the surface and inside thereof and also fewer production residues such as $Na_2O$ and $SO_3^{2-}$. The dry process silica can be in the form of complex metal oxide powder with other metal oxides for example by using another metal halide, such as aluminum chloride or titanium chloride together with silicon halide in the production process.

It is preferred that the inorganic fine powder having a number-average primary particle size of 4–80 nm is added in 0.1–4.0 wt. parts per 100 wt. parts of the toner particles. Below 0.1 wt. part, the effect is insufficient, and above 4.0 wt. parts, the fixability is liable to be lowered.

The inorganic fine powder used in the present invention may preferably have been hydrophobized. By hydrophobizing the inorganic fine powder, the lowering in chargeability of the inorganic fine powder in a high humidity environment is prevented, and the environmental stability of the triboelectric chargeability of the toner particles is improved. If the inorganic fine powder added to the magnetic toner absorbs moisture, the chargeability of the toner particles is remarkably lowered, thus being liable to cause toner scattering.

As the hydrophobization agents for the inorganic fine powder, it is possible to use silicone varnish, various modified silicone varnish, silicone oil, various modified silicone oil, silane compounds, silane coupling agents, other organic silicon compounds and organic titanate compounds singly or in combination.

Among these, it particularly preferred that the inorganic fine powder has been treated with at least silicone oil, more preferably, has been treated with silicone oil simultaneously with or after hydrophobization treatment with a silane compound for retaining the chargeability at a high level and reduce the selective development phenomenon.

In such a preferred form of the treatment of the inorganic fine powder, silylation is performed in a first step to remove a hydrophilic site, such as a silanol group of silica, by a chemical bonding, and then a hydrophobic film is formed of silicone oil in a second step. The silylation agent may preferably be used in a proportion of 5–50 wt. parts per 100 wt. parts of the inorganic fine powder. Below 5 wt. parts, the active hydrogen sites of the inorganic fine powder may not be sufficiently removed, and in excess of 50 wt. parts, an excessive amount of the silylation agent is liable to form a siloxane compound functioning as a glue to agglomerate the inorganic fine particles to result in image defects.

The silicone oil may preferably have a viscosity at 25° C. of 10–200,000 $mm^2/s$, more preferably 3,000–80,000 $mm^2/s$. If the viscosity is below 10 $mm^2/s$, the silicone oil is liable to lack in stable treatability of the inorganic fine powder, so that the silicone oil coating the inorganic fine powder for the treatment is liable to be separated, transferred or deteriorated due to heat or mechanical stress, thus resulting in inferior image quality. On the other hand, if the viscosity is larger than 200,000 $mm^2/s$, the treatment of the inorganic fine powder with the silicone oil is liable to become difficult.

The silicone oil treatment may be performed e.g., by directly blending the inorganic fine powder (optionally preliminarily treated with e.g., silane coupling agent) with silicone oil by means of a blender such as a Henschel mixer; by spraying silicone oil onto the inorganic fine powder; or by dissolving or dispersing silicone oil in an appropriate solvent and adding thereto the inorganic fine powder for blending, followed by removal of the solvent. In view of less by-production of the agglomerates, the spraying is particularly preferred.

The silicone oil may be used in 1–23 wt. parts, preferably 5–20 wt. parts, per 100 wt. parts of the inorganic fine powder before the treatment. Below 1 wt. part, good hydrophobicity cannot be attained, and above 23 wt. parts, difficulties, such as the occurrence of fog, are liable to be caused.

The magnetic toner according to the present invention can contain electroconductive fine powder having a volume-average particle size smaller than that of the toner so as to exhibit better image forming performances and continuous image forming performances. The improved performances may be attributable to a narrower toner triboelectric charge distribution. In the magnetic toner of the present invention, the isolation of iron-containing particles is suppressed. However, in some image forming system, a promotion of charge transfer in a low humidity environment can be preferred. In this instance, the inclusion of charge transfer may promote desirable charge transfer from a highly charged toner particle to a low charge toner particle to provide a more uniform triboelectric charge distribution.

The electroconductive fine powder may preferably be added in a proportion of 0.05–10 wt. parts per 100 wt. parts of the toner. Below 0.05 wt. part, the charge uniformization in a low humidity environment may be insufficient. In excess of 10 wt. parts, it becomes difficult to retain a sufficient charge in a high-humidity environment, thus being liable to increase fog, lower transferability and result in inferior continuous image forming performance. A proportion of 0.05–5 wt. parts is further preferred.

The conductive fine powder may preferably have a volume resistivity of at most $10^9$ ohm.cm. Above $10^9$ ohm.cm, the charge uniformization speed is liable to be insufficient. A volume resistivity of $10^6$ ohm.cm or below allows a very sharp charge distribution even in a low-humidity environment. On the other hand, an excessively low resistivity is liable to lower the triboelectric charge in a high humidity environment, so that a volume resistivity of at least $10^{-1}$ ohm.cm is preferred.

The resistivity of electroconductive fine powder may be measured by the tablet method and normalized. More specifically, ca. 0.5 g of a powdery sample is placed in a cylinder having a bottom area of 2.26 $cm^2$ and sandwiched between an upper and a lower electrode under a load of 147N (15 kg). In this state, a voltage of 100 volts is applied between the electrodes to measure a resistance value, from which a resistivity value is calculated by normalization.

The conductive fine powder may preferably have a volume-average particle size of 0.05–5 $\mu$m. Below 0.05 $\mu$m, the charge uniformization promotion effect is low. It is further preferred that the particles of below 0.5 $\mu$m are at most 70% by volume. On the other hand, the average particle size of the conductive fine powder is larger than 5 $\mu$m, the van der Waals force acting with toner particles is lowered, so that the conductive fine particles are liable to be liberated from the toner particles and attach to the toner-carrying member, thus obstructing the triboelectrification of the toner particles. It is preferred that particles larger than 5 $\mu$m are at most 7% by number.

From the above viewpoints, it is further preferred that the electroconductive fine powder has a volume-average particle size of 0.1–4 $\mu$m. Moreover, the conductive fine powder may preferably comprise a non-magnetic material so as to suppress the attachment thereof onto the toner-carrying member. Further, it is also preferred that the electroconductive fine powder is transparent, white or only pale-colored, so that it is not noticeable as fog even when transferred onto the transfer material. This is also preferred so as to prevent the obstruction of exposure light in the latent image-step. It is preferred that the electroconductive fine powder shows a transmittance of at least 30%, with respect to imagewise exposure light used for latent image formation, as measured in the following manner.

A sample of electroconductive fine powder is attached onto an adhesive layer of a one-side adhesive plastic film to form a mono-particle densest layer. Light flux for measurement is incident vertically to the powder layer, and light transmitted through to the backside is condensed to measure the transmitted quantity. A ratio of the transmitted light to a transmitted light quantity through an adhesive plastic film alone is measured as a net transmittance. The light quantity measurement may be performed by using a transmission-type densitometer (e.g., "310T", available from X-Rite K.K.). The transmittance value may typically be measure with respect to light having a wavelength of, e.g., 740 $\mu$m, identical to exposure light wavelength used in a laser beam scanner.

The electroconductive fine powder used in the present invention may for example comprise: carbon fine powder, such as carbon black and graphite powder; and fine powders of metals, such as copper, gold, silver, aluminum and nickel; metal oxides, such as zinc oxide, titanium oxide, tin oxide, aluminum oxide, indium oxide, silicon oxide, magnesium oxide, barium oxide, molybdenum oxide, iron oxide, and tungsten oxide; and metal compounds, such as molybdenum sulfide, cadmium sulfide, and potassium titanate; an complex oxides of these. The electroconductive fine powders may be used after adjustment of particle size and particle size distribution, as desired. Among the above, it is preferred that the electroconductive fine powder comprises at least one species of oxide selected from the group consisting of zinc oxide, tin oxide and titanium oxide.

It is also possible to use an electroconductive fine powder comprising a metal oxide doped with an element such as antimony or aluminum, or fine particles surface-coated with an electroconductive material. Examples of these are zinc oxide particles containing aluminum, titanium oxide fine particles surface coated with antimony tin oxide, stannic oxide fine particles containing antimony, and stannic oxide fine particles.

Commercially available examples of electroconductive titanium oxide fine powder coated with antimony-tin oxide may include: "EC-300" (Titan Kogyo K.K.); "ET-300", "HJ-1" and "HI-2" (Ishihara Sangyo K.K.) and "W-P" (Mitsubishi Material K.K.).

Commercially available examples of antimony-doped electroconductive tin oxide fine powder may include: "T-1" (Mitsubishi Material K.K.) and "SN-100P" (Ishihara Sangyo K.K.).

Commercially available examples of stannic oxide fine powder may include: "SM-S" (Nippon Kagaku Sangyo K.K.).

The volume-average particle size and particle size distribution of the electroconductive fine powder described herein are based on values measured in the following manner. A laser diffraction-type particle size distribution measurement apparatus ("Model LS-230", available from Coulter Electronics Inc.) is equipped with a liquid module, and the measurement is performed in a particle size range of 0.04–2000 $\mu$m to obtain a volume-basis particle size distribution. For the measurement, a minor amount of surfactant is added to 10 cc of pure water and 10 mg of a sample electroconductive fine powder is added thereto, followed by 10 min. of dispersion by means of an ultrasonic disperser (ultrasonic homogenizer) to obtain a sample dispersion liquid, which is subjected to a single time of measurement for 90 sec.

In the case of using a toner as a starting sample, the above-mentioned particle size measurement may be applied to electroconductive fine powder recovered from toner particles. More specifically, 2–10 g of a sample toner is added to 100 g of pure water containing a minute amount of surfactant, and the mixture is subjected to dispersion for 10 min. by means of an ultrasonic disperser (or ultrasonic homogenizer), following by, e.g., centrifugal separation into toner particles and electroconductive fine powder. As the toner of the present invention is a magnetic toner, the separation may also be conveniently be performed by application of a magnetic field. The liquid dispersion containing the separated electroconductive fine powder may be subjected the above-mentioned single time of measurement for 90 sec.

The particle size and particle size distribution of the electroconductive fine powder used in the present invention may for example be adjusted by setting the production method and conditions so as to produce primary particles of the electroconductive fine powder having desired particle size and its distribution. In addition, it is also possible to agglomerate smaller primary particles or pulverize larger primary particles or effect classification. It is further possible to obtain such electroconductive fine powder by attaching or fixing electroconductive fine particles onto a portion or the whole of base particles having a desired particle size and its distribution, or by using particles of desired particle size and distribution containing an electroconductive component dispersed therein. It is also possible to provide electroconductive fine powder with a desired particle size and its distribution by combining these methods.

In the case where the electroconductive fine powder is composed of agglomerate particles, the particle size of the electroconductive fine powder is determined as the particle size of the agglomerate. The electroconductive fine powder in the form of agglomerated secondary particles can be used as well as that in the form of primary particles.

It is also a preferred mode to add to the magnetic toner of the present invention inorganic or organic fine particles having a shape close to a sphere and a primary particle size exceeding 30 nm (preferably $S_{BET}$ (BET specific surface area)<5 $m^2/g$), more preferably a primary particle size exceeding 50 nm (preferably $S_{BET}$<30 $m^2/g$) so as to enhance the cleaning characteristic. Preferred examples thereof may include: spherical silica particles, spherical polymethylsilsesquioxane particles, and spherical resin particles.

Within an extent of not adversely affecting the toner of the present invention, it is also possible to include other additives, inclusive of lubricant powder, such as teflon powder, zinc stearate powder, and polyvinylidene fluoride powder; abrasives, such as cerium oxide powder, silicon carbide powder, and strontium titanate powder; flowability-imparting agents, or anti-caking agents such as titanium oxide powder, and aluminum oxide powder. It is also possible to add a small amount of reverse-polarity organic and/or inorganic fine particle as a developing performance improver. Such additives may also be added after surface hydrophobization.

Magnetite as a representative of iron oxide (magnetic powder) used in the magnetic toner of the present invention may for example be produced in the following manner.

Into an aqueous solution of a ferrous salt, an alkali in an amount of 1.0 equivalent or more with respect to the ferrous content is added, and 0.05–5.0 wt. % based on the iron of a non-iron element, such as phosphorous or silicon, in the form of an aqueous solution of a water-soluble salt thereof (e.g., phosphates inclusive of orthophosphates and metaphosphates, such as sodium hexametaphosphate and ammonium primary phosphate, for phosphorus, or silicates such as water glass, sodium silicate and potassium silicate) is added thereto to form an aqueous liquid containing ferrous hydroxide. While maintaining the pH of the aqueous liquid at 7 or higher (preferably pH 7–10), air is blown thereinto, and the oxidation of the ferrous hydroxide is caused while warming the aqueous liquid at a temperature of 70° C. or higher, thereby providing magnetic iron oxide particles.

At the final stage of the oxidation reaction, the liquid is adjusted, the system is sufficiently stirred so as to disperse the magnetic iron oxide into primary particles and a coupling agent is added thereto under sufficient stirring, followed by recovery by flirtation, drying and slight disintegration to obtain surface-treated magnetic iron oxide particles. Alternatively, the iron oxide particles after oxidation, washing and recovery by flirtation may be re-dispersed, without drying, into another aqueous medium, and the re-dispersion liquid is pH-adjusted and sufficiently stirred, followed by additon of a silane coupling agent to effect the surface-treatment with the coupling agent.

As the ferrous salt used in the above-mentioned production process, it is generally possible to use ferrous sulfate by-produced in the sulfuric acid process for titanium production or ferrous sulfate by-produced during surface washing of steel sheets. It is also possible to use ferrous chloride.

In the above-mentioned process for producing magnetic iron oxide from a ferrous salt aqueous solution, a ferrous salt concentration of 0.5–2 mol/liter is generally used so as to obviate an excessive viscosity increase accompanying the reaction and in view of the solubility of a ferrous salt, particularly of ferrous sulfate. A lower ferrous salt concentration generally tends to provide finer magnetic iron oxide particles. Further, as for the reaction conditions, a higher rate of air supply, and a lower reaction temperature, tend to provide finer product particles.

By using the thus-produced hydrophobic magnetic iron oxide particles for toner production, it becomes possible to obtain the toner exhibiting excellent image forming performances and stability according to the present invention.

Next, some description will be made regarding an image forming method in which the magnetic toner of the present invention suitably used.

A photosensitive member may suitably used in combination with the magnetic toner of the present invention may comprise a photosensitive drum or a photosensitive drum having a layer of photoconductive insulating material, such as a-Si, CdS, $ZnO_2$, OPC (organic photoconductor) or a-Si (amorphous silicon).

In the present invention, it is particularly preferred to use a photosensitive member having a surface layer principally comprising a polymeric binder. Examples thereof may include: an inorganic photoconductor, such as selenium or a-Si coated with a protective film (protective layer) principally comprising a resin; and a function-separation type organic photoconductor having a charge transport layer comprising a charge-transporting material and a resin as a surface layer, optionally further coated with a resinous protective layer. In these cases, the surface layer (or protective layer) may preferably be provided with a releasability, which is imparted by, e.g., (i) using a layer-forming resin having a low surface energy, (ii) adding an additive imparting water-repellency or lipophilicity, or (iii) dispersing powder of a material exhibiting a high reliability.

For (i), a functional group, such as a fluorine-containing group or a silicone-containing group may be introduced into the resin constituting unit. For (ii), e.g., a surfactant may be added as such an additive imparting water-repellency or lipophilicity. For (iii), the material exhibiting a higher releasability may include: fluorine-containing compounds, such as polytetrafluoroethylene, polyvinylidene fluoride and fluorinated carbon.

By adopting a means as described above, the photosensitive member may be provided with a surface exhibiting a contact angle with water of at least 85 deg., thereby further improving its durability and toner transferability. It is further preferred that the photosensitive member surface exhibits a contact angle with water of 90 deg. or higher. In the present invention, among the above-mentioned means (i)–(iii), the means (iii) of dispersing releasable powder of a fluorine-containing resin into the surface most layer is preferred, and it is particularly preferred to use release powder of polytetrafluoroethylene.

The inclusion of such release powder into the surface layer may be accomplished by forming a layer of binder resin containing such release powder dispersed therein as a surfacemost layer, or incorporating such release powder in an already contemplated surface layer in the case of an organic photosensitive member already having a resinous surface layer. The release powder may preferably be added in such an amount as to occupy 1–60 wt. %, more preferably 2–50 wt. %, of the resultant surface layer. Below 1 wt. %, the effects of improving toner transferability and durability may be insufficient. Above 60 wt. %, the surface or protective layer may have a lower strength or cause a remarkable lowering in effective light quantity incident to the photosensitive member.

Figure 2:
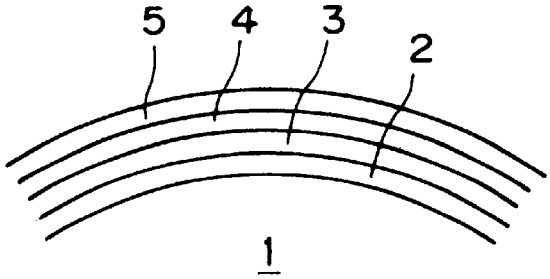
FIG. 2 illustrates a laminar structure of an image-bearing member (photosensitive member).

According to a preferred embodiment, the photosensitive member may have a function-separation type OPC photosensitive member having a laminar structure as shown in FIG. 2.

Referring to FIG. 2, an electroconductive support 1 may generally comprise a metal, such as aluminum or stainless steel, a plastic coated with a layer of aluminum alloy or indium oxide-tin oxide alloy, paper or a plastic sheet impregnated with electroconductive particles, or a plastic comprising an electroconductive polymer in a shape of a cylinder or a sheet or film, or an endless belt, optionally further coated with an electroconductive coating layer 2.

Between the electroconductive support 1 and a photosensitive layer (4 and 5), it is possible to dispose an undercoating layer 3 for the purpose of providing an improved adhesion and applicability of the photosensitive layer, protection of the support, coverage of defects on the support, an improved charge injection from the support, and protection of the photosensitive layer from electrical breakage. The undercoating layer may comprise polyvinyl alcohol, poly-N-vinylimidazole, polyethylene oxide, ethyl cellulose, methyl cellulose, nitrocellulose, ethylene-acrylic acid copolymer, polyvinyl butyral, phenolic resin, casein, polyamide, copolymer nylon, glue, gelatin, polyurethane, or aluminum oxide. The thickness may preferably be ca. 0.1–10 $\mu$m, particularly ca. 0.1–3 $\mu$m.

The photosensitive layer may comprise a single layer (not shown) containing both a charge-generation substance and a charge-transporting substance, or a laminated structure (as shown) including a charge generation layer 4 containing a charger generation substance, and a charge transport layer 5 containing a charge transporting substance, in lamination.

The charge generation layer 4 may comprise a charge generation substance, examples of which may include: organic substances, such as azo pigments, phthalocyanine pigments, indigo pigments, perylene pigments, polycyclic quinone pigments, pyrylium salts, thiopyrilium salts, and triphenylmethane dyes; and inorganic substances, such as selenium and amorphous silicon, in the form of a dispersion in a film of an appropriate binder resin or a vapor deposition film thereof. The binder may be selected from a wide variety of resins, examples of which may include polycarbonate resin, polyester resin, polyvinyl butyral resin, polystyrene resin, acrylic resin, methacrylic resin, phenolic resin, silicone resin, epoxy resin, and vinyl acetate resin. The binder resin may be contained in an amount of at most 80 wt. %, preferably 0–40 wt. %, of the charge generation layer. The charge generation layer may preferably have a thickness of at most 5 $\mu$m, preferably 0.05–2 $\mu$m.

The charge transport layer 5 has a function of receiving charge carriers from the charge generation layer and transporting the carriers under an electric field. The charge transport layer may be formed by dissolving a charge transporting substance optionally together with a binder resin in an appropriate solvent to form a coating liquid and applying the coating liquid. The thickness may preferably be 5–40 $\mu$m. Examples of the charge transporting substance may include: polycyclic aromatic compounds having in their main chain or side chain a structure such as biphenylene, anthracene, pyrene or phenanthrene; nitrogen-containing cyclic compounds, such as indole, carbazole, oxadiazole, and pyrazoline; hydrazones, styryl compounds, selenium, selenium-tellurium, amorphous silicon and cadmium sulfide. Examples of the binder resin for dissolving or dispersing therein the charge transporting substance may include: resins, such as polycarbonate resin, polyester resin, polystyrene resin, acrylic resins, and polyamide resins; and organic photoconductive polymers, such as poly-N-vinylcarbozole and polyvinyl-anthracene.

The photosensitive layer (4 and 5) can be further coated with a protective layer comprising one or more species of a resin, such as polyester, polycarbonate, acrylic resin, epoxy resin, or phenolic resin together with its hardening agent, as desired.

Such a protective layer may further contain electroconductive fine particles of metal or metal oxide, preferred examples of which may include ultrafine particles of zinc oxide, titanium oxide, tin oxide, antimony oxide, indium oxide, bismuth oxide, tin oxide-coated titanium oxide, tin-coated indium oxide, antimony-coated tin oxide, and zirconium oxide. These may be used singly or in mixture of two or more species. The electroconductive particles dispersed in the protective layer may preferably have a particle size smaller than the wavelength of light incident thereto so as to prevent scattering of the incident light due to the dispersed particles. More specifically, the electroconductive particles dispersed in the present invention may preferably have a particle size of at most 0.5 $\mu$m. The content thereof may preferably be 2–90 wt. %, further preferably 5–80 wt. %, of the total solid matter in the protective layer. The protective layer may preferably have a thickness of 0.1–10 $\mu$m, more preferably 1–7 $\mu$m.

The above-mentioned layers may be formed, e.g., by spray coating, beam coating or dip coating.

The magnetic toner of the present invention may preferably be used also in an image forming method including a contact transfer step, a preferred example of which will now be described. The recording medium receiving a transfer of toner image from the image-bearing member can also be an intermediate transfer member, such as a transfer drum. In this case, the toner image once transferred onto the intermediate transfer member is re-transferred onto a transfer material, such as paper, to be fixed thereon.

In the present invention, it is preferred to adopt a contact transfer step wherein a toner image on the image-bearing member is transferred onto a transfer(-receiving) material while abutting a transfer(-promoting) member against the image-bearing member via the transfer material, and the abutting pressure of the transfer member may preferably be a linear pressure of at least 2.9 N/m (3 g/cm), more preferably at least 19.6 N/m (20 g/cm). If the abutting pressure is below 2.9 N/m, difficulties, such as deviation in conveyance of the transfer material and transfer failure, are liable to occur.

Figure 3:
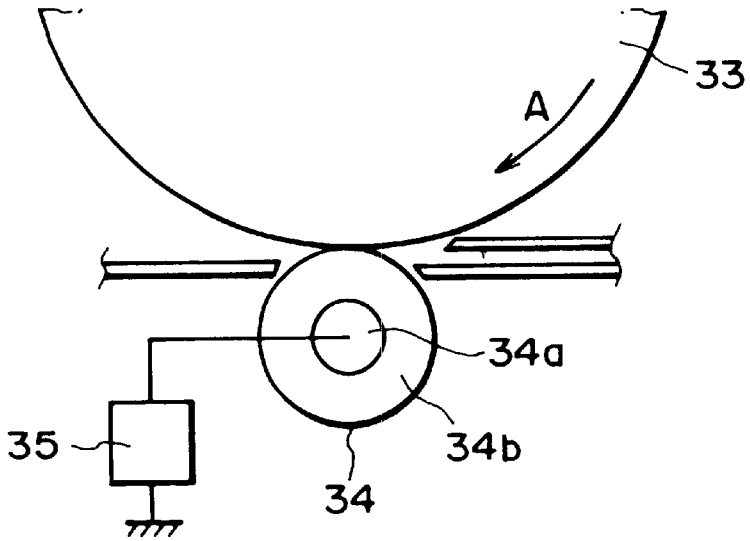
FIG. 3 illustrates an organization of a contact transfer member.

The transfer member used in the contact transfer step may preferably be a transfer roller as illustrated in FIG. 3 or a transfer belt. Referring to FIG. 3, a transfer roller 34 may comprise a core metal 34*a* and a conductive elastic layer 34*b* coating the core metal 34*a* and is abutted against a photosensitive member 33 so as to be rotated following the rotation of the photosensitive member 33 rotated in an indicated arrow A direction. The conductive elastic layer 34*b* may comprise an elastic material, such as polyurethane rubber or ethylene-propylenediene rubber (EPDM), and an electroconductivity-imparting agent, such as carbon black, dispersed in the elastic material so as to provide a medium level of electrical resistivity (volume resistivity) of $1\times10^{6}$–$1\times10^{10}$ ohm.cm. The conductive elastic layer may be formed as a solid or foam rubber layer. The transfer roller 34 is supplied with a transfer bias voltage from a transfer bias voltage supply.

The magnetic toner according to the present invention is particularly effectively used in the case where such a contact transfer step is applied to a photosensitive member having a surface layer comprising an organic compound wherein the photosensitive member is liable to exhibit a stronger affinity with the binder resin of the toner particles than the other types of photosensitive member having an inorganic surface material, thus being liable to show a lower transferability.

The surface layer of the photosensitive member may for example comprise: silicone resin, vinylidene chloride resin, ethylene-vinyl chloride copolymer resin, styrene-acrylonitrile copolymer resin, styrene-methyl methacrylate copolymer resin, styrene resin, polyethylene terephthalate, polycarbonate resin, etc. These are however not exhaustive, and other polymers, copolymers or blends may also be used.

The image forming method including such a contact transfer step may be particularly advantageously applicable to an image forming apparatus including a small-dia. photosensitive member having a diameter of at most 50 mm as an electrostatic latent image-bearing member. This is because in the case of using a small-diameter photosensitive member, an identical linear pressure exerts an increased pressure at the abutted position because of an enhanced curvature. This is also effective for an image forming apparatus including a belt-form photosensitive member having a curvature radius at an abutting position of at most 25 mm.

For providing fog-free high-quality images, it is also preferred that the toner of the present invention is used in a developing step wherein a magnetic toner is applied in a thin layer thickness smaller than a closest gap between the toner-carryingmember and a photosensitive member to effect a development under application of an alternating bias electric field. Such a thin toner layer may be formed by using a toner layer thickness regulation member disposed above the toner-carrying member. In a preferred embodiment, an elastic toner layer thickness regulating means is abutted against the toner carrying member so as to uniformly charge the magnetic toner.

The toner-carrying member may preferably comprise an electroconductive cylindrical sleeve made of a metal or alloy, such as aluminum or stainless steel, but can be composed a resin composition having a sufficient mechanical strength and electroconductivity or can be in the form of an electroconductive rubber roller. Instead of such a cylindrical shape, a rotatively driven endless belt may also be used.

The toner layer may preferably be formed at a rate of 5–30 $g/m^2$ on the toner-carrying member. Below 5 $g/m^2$, it becomes difficult to attain a sufficient image density, and because of excessie toner charge, the toner layer is liable to be accompanied with a coating irregularity. Above 30 $g/m^2$, toner scattering is liable to be caused.

The toner carrying member may preferably have a surface roughness (in terms of JIS center line-average surface roughness (Ra)) in the range of 0.2–3.5 $\mu$m.

If Ra is below 0.2 $\mu$m, the toner on the toner-carrying member is liable to be charged excessively to have an insufficient developing performance. If Ra exceeds 3.5 $\mu$m, the toner coating layer on the toner-carrying member is liable to be accompanied with irregularities, thus resulting images with density irregularity. Ra is further preferably in the range of 0.5–3.0 $\mu$m.

More specifically, the surface roughness (Ra) values described herein are based on values measured as center line-average roughness values by using a surface roughness meter ("Surfcorder SE-3OH", available from K.K. Kosaka Kenkyusho) according to JIS B-0601. More specifically, based on a surface roughness curve obtained for a sample surface, a length of a is taken along a center line of the roughness curve. The roughness curve is represented by a function Y=f(x) while setting the X-axis on the center line and a roughness scale (y) on the Y-axis along the length x portion. A center line-average roughness Ra of the roughness curve is determined by the following formula:

$$Ra = (1/a)\cdot\int_0^a |f(x)|dx.$$

The toner-carrying member may be provided with a surface roughness Ra in the above-mentioned range, e.g., by adjusting an abrasion state of the surface layer. More specifically, a coarse abrasion of the toner-carrying member surface provides a larger roughness, and a finer abrasion provides a smaller roughness.

As the magnetic toner of the present invention has a high chargeability, it is desirable to control the total charge thereof for use in actual development, so that the toner-carrying member used in the present invention may preferably be surfaced with a resin layer containing electroconductive fine particles and/or lubricating particles dispersed therein.

The electroconductive fine particles dispersed in the coating resin layer of the toner-carrying member may preferably exhibit a resistivity of at most 0.5 ohm.cm as measured under a pressure of 11.7 MPa (120 $kg/cm^2$).

The electroconductive fine particles may preferably comprise carbon fine particles, crystalline graphite particles or a mixture of these, and may preferably have a particle size of 0.005–10 $\mu$m.

Examples of the resin constituting the surface layer of the developer-carrying member may include: thermoplastic resin, such as styrene resin, vinyl resin polyethersulfone resin, polycarbonate resin, polyphenylene oxide resin, polyamide resin, fluorine-containing resin, cellulose resin, and acrylic resin; thermosetting resins, such as epoxy resin, polyester resin, alkyd resin, phenolic resin, urea resin, silicone resin and polyimide resin; an thermosetting resins.

Among the above, it is preferred to use a resin showing a releasability, such as silicone resin or fluorine-containing resin; or a resin having excellent mechanical properties, such as polyethersulfone, polycarbonate, polyphenylene oxide, polyamide, phenolic resin, polyester, polyurethane resin or styrene resin. Phenolic resin is particularly preferred.

The electroconductive fine particles may preferably be used in 3–20 wt. parts per 10 wt. parts of the resin. In the case of using a mixture of carbon particles and graphite particles, the carbon particles may preferably be used in 1 to 50 wt. parts per 10 wt. parts of the graphite particles.

The coating layer containing the electroconductive fine particles of the toner-carrying member may preferably have a volume resistivity of $1\times10^{-6}$ to $1\times10^{6}$ ohm.cm.

In the present invention, it is particularly preferred that the toner coating rate is controlled by a regulating member which is disposed above the toner-carrying member and abutted against the toner-carrying member via the toner carried thereon, so as to provide the toner with a uniform turboelectric charge which is less liable to be affected in changes in environmental conditions and is thus less liable to cause toner scattering.

In the present invention, the toner-carrying member surface may be moved in a direction which is identical to or opposite to the moving direction of the image-bearing member surface at the developing section. In the case of movement in the identical direction, the toner-carrying member may preferably be moved at a surface velocity which is at least 100% of that of the image-bearing member. Below 100%, the image quality can be lowered in some cases. A higher surface speed ratio supplies a larger amount of toner to the developing section, thus increasing the frequency of attachment onto and returning from the latent image on the image-bearing member of the toner, i.e., more frequent repetition of removal from an unnecessary part and attachment onto a necessary part of the toner, to provide a toner image more faithful to a latent image. A surface speed ratio of 1.05–3.00 between the toner-carrying member and the image-bearing member is further preferred.

More specifically, it is preferred that the toner-carrying member is disposed with a spacing of 100–1000 $\mu$m from the image-bearing member. If the spacing is below 100 $\mu$m, the developing performance with the toner is liable to be fluctuated depending on a fluctuation of the spacing, so that it becomes difficult to mass-produce image-forming apparatus satisfying stable image qualities. If the spacing exceeds 100 $\mu$m, the followability of toner onto the latent image on the image-bearing member is lowered, thus being liable to cause image quality lowering, such as lower resolution and lower image density. A spacing of 120–500 $\mu$m is further preferred.

In the present invention, it is preferred to operate the developing step under application of an alternating electric field (AC electric field) between the toner-carrying member and the image-bearing member. The alternating developing bias voltage may be a superposition of a DC voltage with an alternating voltage (AC voltage).

The alternating bias voltage may have a waveform which may be a sine wave, a rectangular wave, a triangular wave, etc., as appropriately be selected. It is also possible to use pulse voltages formed by periodically turning on and off a DC power supply. Thus, it is possible to use an alternating voltage waveform having periodically changing voltage values.

It is preferred to form an AC electric field at a peak-to-peak intensity of $3\times10^6$–$10\times10^6$ V/m and a frequency of 100 to 5000 Hz between the toner-carrying member and the image-bearing member by applying a developing bias voltage.

In a preferred embodiment, the magnetic toner of the present invention is used in an image forming method adopting a contact charging scheme wherein a charging member is abutted against the photosensitive member. The scheme is ecologically preferred because the occurrence of ozone is well suppressed.

In a preferred embodiment, the charging step using a charging roller may preferably be performed while abutting the roller at a pressure of 4.9–49 N/m (5–500 g/cm). The voltage applied to the roller may be a DC voltage alone or a DC/AC-superposed voltage. For example, it is suitable to apply an AC/DC superposed voltage comprising an AC voltage of 0.5 to 5 kvpp and a frequency of 50 to 5 kHz and a DC voltage of ±0.2 to ±5 kV.

Other charging means may include those using a charging blade or an electroconductive brush. These contact charging means are effective in omitting a high voltage or decreasing the occurrence of ozone. The charging roller and charging blade each used as a contact charging means may preferably comprise an electroconductive rubber and may optionally comprise a releasing film on the surface thereof. The releasing film may comprise, e.g., a nylon-based resin, polyvinylidene fluoride (PVDF) or polyvinylidene chloride (PVDC).

Next, a preferred embodiment of the image forming method suitable for using a magnetic toner of the present invention will be described while referring to drawing.

Referring to FIG. 1, surrounding a photosensitive member 100 as an image-bearing member, a charging roller 117 (contact charging member), a developing device 140 (developing means), a transfer roller 114 (transfer means), a cleaner 116, and paper supply rollers 124, are disposed. The photosensitive member 100 is charged to −700 volts by the charging roller 117 supplied with an AC voltage of peak-to-peak 2.0 kV superposed with DC −200 volts and is exposed to imagewise laser light 123 from a laser beam scanner 121 to form an electrostatic latent image thereon, which is then developed with a mono-component magnetic toner by the developing device 140 to form a toner image. The toner image on the photosensitive member 100 is then transferred onto a transfer(-receiving) material P by means of the transfer roller 114 abutted against the photosensitive member 100 via the transfer material P. The transfer material P carrying the toner image is then conveyed by a conveyer belt 125, etc., to a fixing device 126, where the toner image is fixed onto the transfer material P. A portion of the toner P remaining on the photosensitive member 100 is removed by the cleaner 116 (cleaning means).

Figure 4:
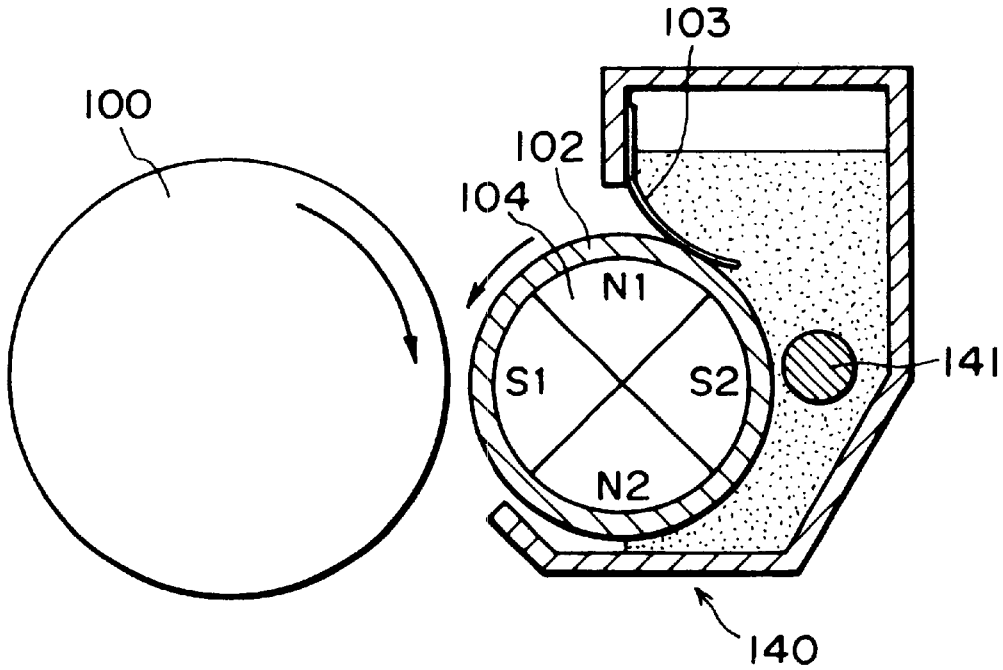
FIG. 4 illustrates an organization of a developing device wherein a magnetic toner of the invention is used.

As shown in more detail in FIG. 4, the developing device 140 includes a cylindrical toner-carrying member (hereinafter called a "developing sleeve") 102 formed of a non-magnetic metal, such a aluminum or stainless steel, and disposed in proximity to the photosensitive member 100, and a toner vessel containing the toner. The gap between the photosensitive member 100 and the developing sleeve 102 is set at ca. 300 $\mu$m by a sleeve/photosensitive member gap-retaining member (not shown), etc. The gap can be varied as desired. Within the developing sleeve 102, a magnet roller 104 is disposed fixedly and concentrically with the developing sleeve 102, while allowing the rotation of the developing sleeve 102. The magnet roller 104 is provided with a plurality of magnetic poles as shown, including a pole S1 associated with developing, a pole N1 associated with regulation of a toner coating amount, a pole S2 associated with toner take-in and conveyance, and a pole N2 associated with prevention of toner blowing-out. Within the toner reservoir, a stirring member 141 is disposed to stir the toner therein.

The developing device 140 is further equipped with an elastic blade 103 as a toner layer thickness-regulating member for regulating the amount of toner conveyed while being carried on the developing sleeve 2, by adjusting an abutting pressure at which the elastic blade 103 is abutted against the photosensitive member 102. In the developing region, a developing bias voltage comprising a DC voltage and/or an AC voltage is applied between the photosensitive member and the developing sleeve 102, so that the toner on the developing sleeve 102 is caused to jump onto the photosensitive member 100 corresponding to an electrostatic latent image formed thereon.

Hereinbelow, the present invention will be described more specifically with reference to Production Examples and Examples which should not be however construed to restrict the scope of the present invention in any way, "Part(s)" used hereinbelow for describing relative amounts of ingredients are "part(s) by weight".

Polar Polymer

Production Example 1 for Polar Polymer

Into a pressurizable reaction vessel equipped with a reflux pipe, a stirrer, a thermometer, a nitrogen-intake pipe, a droplet addition device and a vacuum means, 250 parts of methanol, 150 parts of 2-butanone and 100 parts of 2-propanol as solvents, and 72 parts of styrene, 18 parts of 2-ethylhexyl acrylate and 10 parts of 2-acrylamido-2-methylpropanesulfonic acid as monomers, were added and heated under stirring to a reflux temperature. Then, a solution of 1 part of t-butylperoxy-2-ethylhexanoate (polymerization initiator) in 20 parts of 2-butanone was added dropwise thereto in 30 min., followed by 5 hours of continued stirring, dropwise addition in 30 min. of a solution of 1 part of t-butyl peroxy-2-ethylhexanoate in 20 parts of 2-butanone and further 5 hours of stirring, to complete the polymerization.

After distilling off the solvent, the polymerizate was coarsely crushed to below 100 $\mu$m by a cutter mill equipped with a 150 mesh-screen, to obtain Polar polymer 1, which exhibited a glass transition temperature (Tg) of ca. 54° C.

Production Examples 2–4

Polar polymers 2–4 were prepared in the same manner as in Production Example 1 except for changing the monomer compositions as shown in Table 1 below.

Comparative Production Example

Polar polymer 5 was prepared in the same manner as in Production Example 1 except for changing the monomer composition as shown in Table 1.

TABLE 1

| Polar polymer | Polar polymers: Monomers* (parts) AMPS | styrene | other/parts | Tg (° C.) |
|---|---|---|---|---|
| 1 | 10 | 72 | 2-EHA/18 | 54 |
| 2 | 1 | 80 | 2-EHA/19 | 42 |
| 3 | 10 | 0 | MMA/90 | 118 |
| 4 | 10 | 30 | 2-EHA/18 MMA/42 | 55 |
| 5 (comp.) | 0 | 85 | 2-EHA/15 | 52 |

*AMPS = 2-acrylamido-2-methylpropanesulfonic acid,
2-EHA = 2-ethylhexyl acrylate
MMA = methyl methacrylate

Magnetic Powder

Production Example 1 for Magnetic Powder

Into a ferrous sulfate aqueous solution, a caustic solution in an amount of 1.0–1.1 equivalent of the ferrous ion was added and mixed therewith to form an aqueous solution containing ferrous hydroxide.

While maintaining the pH of the aqueous system at ca. 9, air was blown thereinto to cause oxidation at 80–90° C., thereby obtaining a slurry of magnetic particles. After washing and filtration, the wet magnetic particles were once taken out to determine the water content by using a small portion thereof. The wet magnetic particles without drying were than re-dispersed in another aqueous medium. While adjusting the pH of the re-dispersion liquid at ca. 6 under sufficient stirring, a silane coupling agent (n-$C_{10}H_{21}Si(OCH_3)_3$) in an amount of 2.0 parts per 100 parts of the magnetic particles (as solid by subtracting the water content) was added to the re-dispersion liquid to effect a coupling treatment (hydrophobization). The resultant hydrophobized magnetic particles were then washed with water, filtered out and dried, followed by disintegration of slightly agglomerated particles, in an ordinary manner, to obtain Magnetic powder 1 (surface-treated).

Some particle size data of Magnetic powder 1 are shown in Table 2 appearing hereinafter together with those of magnetic powders prepared in the following Production Examples.

Comparative Production Example for Magnetic Powder

Production Example 1 was repeated up to the oxidation, and the resultant magnetic particles were washed with water, filtered out and dried, followed by disintegration of agglomerated particles, in an ordinary manner, to obtain Magnetic powder 9 (untreated).

Production Example 2 for Magnetic Powder

Magnetic powder 9 (untreated) in Comparative Production Example above was re-dispersed in another adjusting the pH of the re-dispersion liquid at ca. 6 under sufficient stirring, a silane coupling agent (n-$C_{10}H_{21}Si(OCH_3)_3$) in an amount of 2.0 parts per 100 parts of Magnetic powder 9 was added to the re-dispersion liquid to effect a coupling treatment (hydrophobization). The resultant hydrophobized magnetic particles were then washed with water, filtered out and dried, followed by disintegration of slightly agglomerated particles, in an ordinary manner, to obtain Magnetic powder 2 (surface-treated).

Production Example 3

Magnetic powder 3 (surface-treated) was prepared by surface-treating 100 parts of Magnetic powder 9 (untreated) with 2.0 parts of a silane coupling agent (n-$C_{10}H_{21}Si(OCH_3)_3$) in gaseous phase.

Production Example 4

Magnetic powder 4 (surface-treated) was prepared in the same manner as in Production Example 1 except for decreasing the amount of the ferrous sulfate aqueous solution and increasing the air blowing rate for the oxidation.

Production Example 5

Magnetic powder 5 (surface-treated) was prepared in the same manner as in Production Example 1 except for increasing the amount of the ferrous sulfate aqueous solution and decreasing the air blowing rate for the oxidation.

Production Example 6

Magnetic powder 6 (surface-treated) was prepared in the same manner as in Production Example 1 except for increasing the air blowing rate for the oxidation.

Production Example 7

Magnetic powder 7 (surface-treated) was prepared in the same manner as in Production Example 1 except for using a silane coupling gent ($n\text{-}C_6H_{13}Si(OCH_3)_3$) instead of the silane coupling agent ($n\text{-}C_{10}H_{21}Si(OCH_3)_3$).

Production Example 8

Magnetic powder 8 (surface-treated) was prepared in the same manner as in Production Example 1 except for decreasing the amount of the silane coupling agent ($n\text{-}C_{10}H_{21}Si(OCH_3)_3$) to 0.1 part.

TABLE 2

| Magnetic powder | Particle size (Dv) (μm) | Time*1 powder (N. %) | Coarse*2 powder (N. %) |
|---|---|---|---|
| 1 | 0.19 | 20 | 2 |
| 2 | 0.21 | 13 | 4 |
| 3 | 0.24 | 9 | 9 |
| 4 | 0.31 | 9 | 13 |
| 5 | 0.14 | 41 | 1 |
| 6 | 0.25 | 6 | 8 |
| 7 | 0.18 | 21 | 2 |
| 8 | 0.22 | 16 | 5 |
| 9 (untreated) | 0.28 | 4 | 16 |

*1% by number of particles of 0.03 μm to below 0.1 μm.
*2% by number of particles of larger than 0.3 μm.

Electroconductive Fine Powder

Electroconductive Fine Powder 1

Zinc oxide primary particles having a primary particle size of 0.1–0.3 μm were agglomerated under pressure to obtain Electroconductive fine powder 1, which was white in color, and exhibited a volume-average particle size (Dv) of 3.7 μm, a particle size distribution including 6.6% by volume of particles of 0.5 μm or smaller (V % (D<0.5 μm)=6.6% by volume) and 8% by number of particles of 5 μm or larger (N % (D>5 μm)=8% by number), and a resistivity (Rs) of 80 ohm.cm.

As a result of observation through a scanning electron microscope (SEM) at magnifications of $3\times10^3$ and $3\times10^4$, Electroconductive fine powder 1 was found to include zinc oxide primary particles of 0.1–0.3 μm in primary particle size and agglomerated particles of 1–10 μm.

Electroconductive fine powder 1 also exhibited a transmittance of a mono-particle densest paked layer with respect to light of 740 nm in wavelength ($T_{740}$ (%)) of ca. 35% as measured by a transmission densitometer ("310%", available from X-Rite K.K.).

Some representative properties of Electroconductive powder 1 are shown in Table 3 appearing hereinafter together with those of Electroconductive fine powders 2–5 prepared in the following manner.

Electroconductive Fine Powder 2

Electroconductive fine powder 1 was pneumatically classified to obtain Electroconductive fine powder 2, which exhibited Dv=2.4 μm, V % (D<0.5 μm)=4.1% by volume, N % (D>5 μm)=1% by number, Rs=440 ohm.cm and $T_{740}$ (%)=35%.

As a result of the SEM observation, Electroconductive fine powder 2 was found to include zinc oxide primary particles of 0.1–0.3 μm in primary particle size and agglomerate particles of 1–5 μm, but the amount of the primary particles was reduced than in Electroconductive fine powder 1.

Electroconductive Fine Powder 3

Electroconductive fine powder 1 was pneumatically classified to obtain Electroconductive fine powder 3, which exhibited Dv=1.5 μm, V % (D<0.5 μm)=35% by volume, N % (D>5 μm)=0% by number, Rs=1500 ohm.cm and $T_{740}$ (%)=35%.

As a result of the SEM observation, Electroconductive fine powder 3 was found to include zinc oxide primary particles of 0.1–0.3 μm in primary particle size and agglomerate particles of 1–4 μm, but the amount of the primary particles was increased than in Electroconductive powder 1.

Electroconductive Fine Powder 4

White zinc oxide fine particles were used as Electroconductive fine powder 4, which exhibited Dv=0.3 μm, V % (<0.5 μm)=80% by volume, N % (>5 μm)=0% by number, primary particle sizes (Dp)=0.1–0.3 μm, Rs=100 ohm.cm and $T_{740}$ (%)=35%.

As a result of the TEM observation, Electroconductive fine powder 4 was found to comprise zinc oxide primary particles of Dp=0.1–0.3 μm and contain little agglomerate particles.

Electroconductive Fine Powder 5

Aluminum borate powder surface-coated with antimony tin oxide and having Dv=2.8 μm was pneumatically classified to remove coarse particles, and then subjected to a repetition of dispersion in aqueous medium and filtration to remove fine particles to recover Electroconductive fine powder 5, which was grayish-white electroconductive fine powder and exhibited Dv=3.2 μm, V % (D<0.5 μm)=0.4% by volume, and N % (D>5 μm)=1% by number.

Representative properties of Electroconductive fine powders 1–5 are inclusively shown in Table 3 below.

TABLE 3

| Electroconductive fine powder | | | | | | |
|---|---|---|---|---|---|---|
| | | Particle size distribution | | | Rs | |
| Name | Material * | Dv (μm) | V % (<0.5 μm) (% vol.) | N % (>5 μm) (%. num.) | (ohm. cm) | $T_{740}$ (%) |
| 1 | zinc oxide | 3.7 | 6.6 | 8 | 80 | 35 |
| 2 | zinc oxide | 2.4 | 4.1 | 1 | 440 | 35 |
| 3 | zinc oxide | 1.5 | 35 | 0 | 1500 | 35 |
| 4 | zinc oxide | 0.3 | 80 | 0 | 100 | 35 |
| 5 | C.A.B. | 3.2 | 0.4 | 1 | 40 | — |

*: C.A.B. means coated aluminum borate.

Magnetic Toner Particles

Hereinbelow, some production examples for magnetic toner particles are described, wherein the product magnetic toner particles are referred to as Black powder for the sake of convenience.

Production Example 1 for Magnetic Toner Particles

Into 709 parts of deionized water, 451 parts of 0.1 mol/l-$Na_3PO_4$ aqueous solution was added, and after heating to 60° C., 67.7 parts of 1.0 mol/l-$CaCl_2$ aqueous solution was gradually added thereto, to form an aqueous medium containing calcium phosphate.

| | |
|---|---|
| Styrene | 80 part(s) |
| n-Butyl acrylate | 20 part(s) |
| Unsaturated polyester resin** | 0.5 part(s) |
| Polar polymer 1 | 2 part(s) |
| Monoazo dye Fe compound (negative charge control agent) | 1 part(s) |
| Magnetic powder 1 (surface-treated) | 90 part(s) |

**A condensation product between propylene oxide and ethylene oxide-adduct of bisphenol A and fumaric acid.

The above ingredients were uniformly dispersed and mixed by means of an attritor (made by Mitsui Miike Kakoki K.K.) to form a monomeric mixture. The mixture was heated to 60° C., and 6 parts of an ester wax principally comprising behenyl behenate and having a DSC heat-absorption peak temperature (Tabs) of 72° C., 7 parts of 2,2'-azobis(2,4-dimethylvaleronitrile) (polymerization initiator, $T_{1/2}$=140 min. at 60° C.) and 2 parts of dimethyl-2,2'-azobisisobutyrate (polymerization initiator, $t_{1/2}$=270 min. at 60° C., $t_{1/2}$=80 min. at 80° C.) were added thereto and mixed with each other to form a polymerizable composition.

The polymerizable composition was charged into the above-prepared aqueous medium and stirred at 60° C. in an $N_2$ atmosphere for 15 min. at 10,000 rpm by a TK homomixer (made by Tokushu Kika Kogyo K.K.) to disperse the droplets of the polymerizable composition in the aqueous medium. Then, the system was further stirred by a paddle stirrer and subjected to 7 hours of reaction at 60° C., followed by further 3 hours of stirring at an elevated temperature of 80° C. After the reaction, the suspension liquid was cooled, and hydrochloric acid was added thereto to dissolve the calcium phosphate. Then, the polymerizate was filtered out, washed with water and dried to obtain Black powder 1 having a weight-average particle size (D4) of 6.7 μm.

Some characterization and physical properties of Black powder 1 are inclusively shown in Table 4 together with those of Black powders prepared in the following Production Examples.

Production Examples 2–4

Black powders 2–4 were prepared in the same manner as in Production Example 1 except for using Polar polymers 2–4, respectively, instead of Polar polymer 1.

Comparative Production Example 1

Black powder 5 was prepared in the same manner as in Production Example 1 except for using Polar polymer 5 instead of Polar polymer 1.

Comparative Production Example 2

Black powder 6 was prepared in the same manner as in Production Example 1 except for omitting the use of Polar polymer 1.

Production Example 5

Black powder 7 was prepared in the same manner as in Production Example 1 except for increasing Polar polymer 1 to 16 parts.

Production Examples 6–10

Black powders 8–12 were prepared in the same manner as in Production Example except for using Magnetic powders 2–6 (surface-treated), respectively, instead of Magnetic powder 1.

Comparative Production Example 3

Black powder 13 was prepared in the same manner as in Production Example 1 except for using Magnetic powder 9 (untreated) instead of Magnetic powder 1.

Comparative Production Example 4

Black powder 14 having a weight-average particle size (D4) of 2.9 μm was prepared in the same manner as in Production Example 1 except for increasing the amounts of the $Na_3PO_4$ aqueous solution and the $CaCl_2$ aqueous solution so as to increase the amount of the calcium phosphate in the aqueous medium and further adding sodium dodecylbenzenesulfonate thereto.

Comparative Production Example 5

Black powder 15 was prepared in the same manner as in Production Example 1 except for reducing Magnetic powder 1 to 9 parts.

Production Example 11

Black powder 16 was prepared in the same manner as in Production Example 1 except for increasing magnetic powder 1 to 202 parts.

Production Examples 12 and 13

Black powders 17 and 18 were prepared in the same manner as in Production Example 1 except for changing the amount of the ester wax to 0.45 part and 50.5 parts, respectively.

Production Example 14

Black powder 19 was prepared in the same manner as in Production Example 1 except for using a polyethylene-based wax (Tabs=115° C.) instead of the ester wax.

Production Example 15

Into 709 parts of deionized water, 451 parts of 0.1 mol/l-$Na_3PO_4$ aqueous solution was added, and after heating to 60° C., 67.7 parts of 1.0 mol/l-$CaCl_2$ aqueous solution was gradually added thereto, to form an aqueous medium containing calcium phosphate.

| | |
|---|---|
| Styrene | 80 part(s) |
| n-Butyl acrylate | 20 part(s) |
| Unsaturated polyester resin (the same as in Production Example 1) | 0.6 part(s) |
| Monoazo dye Fe compound (negative charge control agent) | 1.2 part(s) |
| Magnetic powder 1 (surface-treated) | 107 part(s) |

The above ingredients were uniformly dispersed and mixed by means of an attritor (made by Mitsui Miike Kakoki K.K.) to form a monomeric mixture. The mixture was heated to 60° C., and 6 parts of the same ester wax as used in Production Example 1, 7.2 parts of 2,2'-azobis(2,4-dimethylvaleronitrile) and 2 parts of dimethyl-2,2'-azobisisobutyrate were added thereto and mixed with each other to form a polymerizable composition.

The polymerizable composition was charged into the above-prepared aqueous medium and stirred at 60° C. in an $N_2$ atmosphere for 15 min. at 10,000 rpm by a TK homomixer (made by Tokushu Kika Kogyo K.K.) to disperse the droplets of the polymerizable composition in the aqueous medium. Then, the system was further stirred by a paddle stirrer and subjected to 3 hours of reaction at 60° C., followed by further 1 hour of stirring at an elevated temperature of 80° C.

Then, into the above suspension liquid, a mixture of

| | |
|---|---|
| Styrene | 16 part(s) |
| n-Butyl acrylate | 4 part(s) |
| Polar polymer 1 | 2.4 part(s) |
| 2,2'-Azobis(2,4-dimethyl-valeronitrile) | 0.4 part(s) |
| Sodium behenate | 0.1 part(s) |
| Water | 20 part(s) |

was added, and the system was heated to 80° C. and stirred for 6 hours at that temperature.

After the reaction, the suspension liquid was cooled, and hydrochloric acid was added thereto to dissolve the calcium phosphate. Then, the polymerizate was filtered out, washed with water and dried to obtain Black powder 20 (D4=7.5 μm).

Comparative Production Example 6

| | |
|---|---|
| Styrene-n-butyl acrylate copolymer (=80/20 by weight) | 100 part(s) |
| Unsaturated polyester resin (the same as in Production Example 1) | 0.5 part(s) |
| Monoazo dye Fe compound (negative charge control agent) | 1 part(s) |
| Magnetic powder 1 (surface-treated) | 90 part(s) |
| Ester wax | 6 part(s) |

(the same as in Production Example 1)

The above ingredients were blended by a blender and melt-kneaded by a twin-screw extruder heated at 110° C. After being cooled, the melt-kneaded product was coarsely crushed by a hammer mill and then pulverized by a turbo mill (made by Turbo Kogyo K.K.), followed by pneumatic classification to obtain Black powder 21 (D4=7.6 μm).

Production Example 16

Black powder 21 prepared in Comparative Production Example 6 above was subjected to a sphering treatment by means of an impact-type surface-treating apparatus at a treating temperature of 55° C. and a rotating blade circumferential speed of 90 m/sec to obtain Black powder 22.

The properties of the above-prepared Black powders 1–22 are inclusively shown in Table 4 appearing hereinafter.

Magnetic Toners

Production Example 1 for Magnetic Toner

To 100 parts of Black powder 1, 1 part of hydrophobic silica fine powder ($S_{BET}$=140 $m^2/g$) obtained by treating silica having a primary particle size (Dp1) of 12 nm successively with hexamethyldisilazane and then silicone oil was added and mixed therewith by a Henschel mixer (made by Mitsui Miike Kakoki K.K.) to obtain Magnetic toner 1.

The prescription of Magnetic toner 1 is shown in Table 5 appearing hereinafter together with those of Magnetic toners obtained in the following Production Examples.

Production Examples 2–5

100 parts each of Black powders 2–4 and 7 were respectively blended with 1 part of the same hydrophobic silica fine powder as used in Production Example 1 to obtain Magnetic toners 2–5, respectively.

Production Example 6

100 parts of Black powder 8 was blended with 0.6 part of the same hydrophobic silica fine powder as used in Production Example 1 to obtain Magnetic toner 6.

Production Examples 7–10

100 parts each of Black powders 9–12 were respectively blended with 1 part of the same hydrophobic silica fine powder as used in Production Example 1 to obtain Magnetic toners 7–10, respectively.

Production Example 11

100 parts of Black powder 16 was blended with 0.5 part of the same hydrophobic silica fine powder as used in Production Example 1 to obtain Magnetic toner 11.

Production Example 12

100 parts of Black powder 17 was blended with 1 part of the same hydrophobic silica fine powder as used in Production Example 1 to obtain Magnetic toner 12.

Production Examples 13 and 14

100 parts each of Black powders 18 and 19 were respectively blended with 0.6 part of the same hydrophobic silica fine powder as used in Production Example 1 to obtain Magnetic toners 13 and 14, respectively.

Production Examples 15 and 16

100 parts each of Black powders 20 and 22 were respectively blended with 1 part of the same hydrophobic silica fine powder as used in Production Example 1 to obtain Magnetic toners 15 and 16, respectively.

Production Examples 17–19

100 parts each of Black powder 1 was separately blended with 1 part of hydrophobic silica fine powder ($S_{BET}$=200 $m^2/g$) treated with hexamethyldisilazane, 1 part of hydrophobic titanium oxide ($S_{BET}$=100 $m^2/g$) treated with isobutyltrimethoxysilane or 1 part of hydrophobic alumina fine powder ($S_{BET}$=150 $m^2/g$) treated with isobutyltrimethoxysilane to obtain Magnetic toners 17–19, respectively.

Production Example 20

100 parts of Black powder 1 was blended with 1 part of the same hydrophobic silica fine powder as used in Production Example 1 and 2 parts of Electroconductive fine powder 1 to obtain Magnetic toner 20.

Production Examples 21–24

100 parts each of Black powder 1 was blended with 1 part of the same hydrophobic silica fine powder as used in Production Example 1 and also with 2 parts of one of Electroconductive fine powders 2 to 5 to obtain Magnetic toners 21 and 24, respectively.

Comparative Production Examples 1–3

100 parts each of Black powders 5, 6 and 13 were respectively blended with 0.6 part of the same hydrophobic silica fine powder as used in Production Example 1 to obtain Comparative Magnetic toners 1–3, respectively.

Comparative Production Examples 1–3

100 parts each of Black powders 5, 6 and 13 were respectively blended with 1 part of the same hydrophobic silica fine powder as used in Production Example 1 to obtain Comparative Magnetic toners 1–3, respectively.

Comparative Production Examples 4 and 5

100 parts each of Black powders 14 and 15 were respectively blended with 1.5 parts of the same hydrophobic silica fine powder as used in Production Example 1 to obtain Comparative Magnetic toners 4 and 5, respectively.

Comparative Production Example 6

100 parts of Black powder 21 was blended with 1 part of the same hydrophobic silica fine powder as used in Production Example 1 to obtain Comparative Magnetic toner 6.

Photosensitive Member

A photosensitive member having a laminar structure as shown in FIG. 2 was prepared by successively forming the following layers by dipping on a 30 mm-dia. aluminum cylinder support 1.

(1) First layer 2 was a 15 μm-thick electroconductive coating layer (electroconductive) layer, principally comprising phenolic resin with powder of tin oxide and titanium oxide dispersed therein.

(2) Second layer 3 was a 0.6 μm-thick undercoating layer comprising principally modified nylon and copolymer nylon.

(3) Third layer 4 was a 0.6 μm-thick charge generation layer comprising principally an azo pigment having an absorption peak in a long-wavelength region dispersed within butyral resin.

(4) Fourth layer was a 25 μm-thick charge transport layer comprising principally a hole-transporting triphenylamine compound dissolved in polycarbonate resin (having a molecular weight of $2\times10^4$ according to the Ostwald viscosity method) in a weight ratio of 8:10 and further containing 10 wt. % based on total solid of polytetrafluoroethylene powder (volume-average particle size (Dv)=0.2 μm) dispersed therein. The layer surface exhibited a contact angle with pure water of 95 deg. as measured by a contact angle meter ("CA-X", available from Kyowa Kaimen Kagaku K.K.).

EXAMPLE 1

An image forming apparatus having an organization generally as illustrated in FIG. 1 and obtained by remodeling a commercially available laser beam printer ("LBP-1760", made by Canon K.K.) was used.

As a photosensitive member 100 (image-bearing member), the photosensitive member (organic photoconductive (OPC) drum) prepared above was used. The photosensitive member 100 was uniformly charged to a dark part potential (Vd) of −700 volts by applying a charging bias voltage comprising a superposition of a DC voltage of −700 volts and an AC voltage of 1.5 kVpp from a rubber roller charger 117 containing electroconductive carbon dispersed therein and coated with nylon resin abutted against the photosensitive member 100. The charged photosensitive member was then exposed at an image part to imagewise laser light 123 from a laser scanner 121 so as to provide a light-part potential ($V_L$) of −160 volts in contrast with a dark-part potential (Vd) of −700 volts.

A developing sleeve 102 (toner-carrying member) was formed of a surface-blasted 16 mm-dia. aluminum cylinder coated with a ca. 7 μm-thick resin layer of the following composition exhibiting a roughness (JIS center line-average roughness Ra) of 1.0 μm. The developing sleeve 102 was equipped with a developing magnetic pole of 85 mT (850 Gauss) and a silicone rubber blade of 1.2 mm in thickness and 1.0 mm in free length as a toner layer thickness-regulating member. The developing sleeve 102 was disposed with a gap of 310 μm from the photosensitive member 100.

| | |
|---|---|
| Phenolic resin | 100 wt. parts |
| Graphite (Dv = ca. 7 μm) | 90 wt. parts |
| Carbon black | 10 wt. parts |

Then, a developing bias voltage of DC −500 volts superposed with an AC voltage of peak-to-peak 1500 volts and frequency of 1900 Hz was applied, and the developing sleeve was rotated at a peripheral speed of 103 mm/sec which was 110% of the photosensitive member peripheral speed (94 mm/sec) moved in identical directions.

A transfer roller 114 used was one identical to a roller 34 as shown in FIG. 3. More specifically, the transfer roller 34 had a core metal 34*a* and an electroconductive elastic layer 34*b* formed thereon comprising conductive carbon-dispersed ethylene-propylene rubber. The conductive elastic layer 34*b* exhibited a volume resistivity of $1\times10^8$ ohm.cm and a surface rubber hardness of 24 deg. The transfer roller 34 having a diameter of 20 mm was abutted against a photosensitive member 33 (photosensitive member 100 in FIG. 1) at a pressure of 59 N/m (60 g/cm) and rotated at an identical speed as that (70 mm/sec) of the photosensitive member 33 rotating in an indicated arrow A direction while being supplied with a transfer bias voltage of DC 1.5 kV.

A fixing device 126 was an oil-less heat-pressing type device for heating via a film (of "LBP-1760", unlike a roller-type one as illustrated). The pressure roller was one having a surface layer of fluorine-containing resin and a diameter of 30 mm. The fixing device was operated at a fixing temperature of 180° C. and a nip width set to 7 mm.

In this example (Example 1), magnetic toner 1 was first subjected to a continuous image forming test on 2000 sheets in an environment of 15° C./10%RH on plain paper of 90 g/m$^2$ as a transfer material. As a result, the toner exhibited good initial stage image forming performances including a high transfer efficiency free from transfer failure such as hollow image dropout of characters and lines and resulted in fog-free images.

Further, continuous image forming performances were evaluated based on a pattern of 1 cm-wide lateral lines which were arranged with a spacing of 3 cm at a halftone image density of a low latent image potential.

The performance evaluation was performed with respect to the following items.

For evaluation of Transfer efficiency ($E_{TF}$) (%), a solid black image was formed on the photosensitive member and transferred onto white paper. Then, a transfer residual toner on the photosensitive member after the transfer was peeled off by a polyester adhesive tape and applied on the white paper to measure a Macbeth (reflection) density C, and the same polyester tape was applied onto the solid toner image transferred but yet unfixed onto the white paper to measure a Macbeth density D. Further, the same polyester adhesive tape was applied onto blank white paper to measure a Macbeth density E. From these values, a transfer efficiency was calculated according to the following formula:

$$\text{Transfer efficiency } T_{EF}(\%)=((D-C)/(D-E))\times 100.$$

An image giving a transfer efficiency of 90% or higher is judged to be satisfactory.

Resolution was evaluated at the initial stage based on a reproducibility of isolated 100 dots at a resolution of 600 dpi (which are generally difficult to reproduce because of latent image electric field closure) according to the following standard:

A: At most 5 dots (among 100 dots) caused lacks.

B: 6–10 dots caused lacks.

C: 11–20 dots caused lacks.

D: More than 20 dots caused lacks.

Fog was evaluated by measuring a reflectance Rs (%) on a white background portion of a printed image on a white transfer paper and a reflectance Rr (%) of the white transfer paper before the printing by using a reflecto-meter ("Model TC 6DS", made by Tokyo Denshoku K.K.) with a green filter. Fog (%) was determined as Dr–Ds (%).

A fog value of 2.0% or lower generally represents a good image.

Image density (I.D.) was measured with respect to a solid image on a 20th-sheet as an initial stage performance) by using a Macbeth densitometer ("RD 918", made by Macbeth Co.).

Fixing offset (Back soil) was evaluated by number of sheets having caused back-soil on the back side of images among continuously formed 100 image sample sheets taken at the initial stage.

Chargeability was evaluated by occurrence of image failure (inclusive of soil on nonimage portion and density irregularity on halftone images) in the continuous image formation. Evaluation was made based on the number of sheets when the image failure was first recognized.

The results are inclusively shown in Table 1 together with the results obtained in the following Examples and Comparative Examples. As shown in Table 6, Magnetic toner 1 exhibited good image forming performances not only at the initial stage but also throughout the continuous image formation on 2000 sheets.

Magnetic toner 1 also exhibited good image forming performances in an environment of 30° C./80%RH.

EXAMPLES 2–24

Image forming tests were performed by using Magnetic toners 2–24, respectively, otherwise in the same manner.

The results are also shown in Table 6.

Comparative Examples 1–6

Image forming tests were performed in the same manner as in Example 1 except for using Comparative Magnetic toner 1–6. The results are also inclusively shown in Table 6. As shown in Table 6, the image forming performances were generally inferior from the initial stage, and the continuous image formation was interrupted in some cases.

TABLE 4

Black powder (magnetic toner particles)

| Black powder | Process *1 | Magnetic powder No./parts (per 100 parts of resin) | Wax $T_{abs}$/parts | $D_4$ (μm) | Circularity $C_{av}/C_{mode}$ | B/A | N % of D/C ≦ 0.02 | Polar polymer No/parts | E/A | F/A | F/E | Isolated iron | σ79.6 ($Am^2/kg$) |
|---|---|---|---|---|---|---|---|---|---|---|---|---|---|
| 1 | Pmn. | 1/90 | 72° C./6.0 | 6.7 | 0.982/1.00 | 0.0000 | 82 | 1/2 | 0.0034 | 0.0119 | 3.50 | 0.45% | 25.1 |
| 2 | ↑ | ↑ | ↑ | 7.8 | 0.971/1.00 | 0.0001 | 80 | 2/2 | 0.0024 | 0.0122 | 5.09 | 0.71 | 25.1 |
| 3 | ↑ | ↑ | ↑ | 8.3 | 0.970/1.00 | 0.0002 | 81 | 3/2 | 0.0030 | 0.0110 | 3.67 | 1.21 | 25.1 |
| 4 | ↑ | ↑ | ↑ | 6.8 | 0.981/1.00 | 0.0001 | 82 | 4/2 | 0.0032 | 0.0107 | 3.34 | 0.51 | 25.1 |
| 5 | ↑ | ↑ | ↑ | 9.4 | 0.982/0.99 | 0.0001 | 83 | 5/2 | N.D. *2 | N.D. *2 | — | 3.30 | 25.1 |
| 6 | ↑ | ↑ | ↑ | 9.8 | 0.968/0.99 | 0.0002 | 81 | none | N.D. *2 | N.D. *2 | — | 3.52 | 25.1 |
| 7 | ↑ | ↑ | ↑ | 5.9 | 0.986/1.00 | 0.0002 | 82 | 1/16 | 0.0049 | 0.0078 | 1.59 | 0.28 | 25.1 |
| 8 | ↑ | 2/90 | ↑ | 6.1 | 0.971/1.00 | 0.0004 | 87 | 1/2 | 0.0035 | 0.0133 | 3.76 | 2.12 | 26.0 |
| 9 | ↑ | 3/90 | ↑ | 6.0 | 0.970/1.00 | 0.0006 | 90 | 1/2 | 0.0031 | 0.0117 | 3.80 | 3.03 | 28.1 |
| 10 | ↑ | 4/90 | ↑ | 7.1 | 0.972/1.00 | 0.0002 | 81 | 1/2 | 0.0029 | 0.0112 | 3.86 | 0.97 | 29.4 |
| 11 | ↑ | 5/90 | ↑ | 6.6 | 0.979/1.00 | 0.0004 | 83 | 1/2 | 0.0029 | 0.0114 | 3.92 | 0.66 | 24.9 |
| 12 | ↑ | 6/90 | ↑ | 7.0 | 0.973/1.00 | 0.0002 | 72 | 1/2 | 0.0032 | 0.0125 | 3.88 | 0.91 | 25.5 |
| 13 | ↑ | 9(untreated)/90 | ↑ | 10.9 | 0.962/0.99 | 0.0071 | 100 | 1/2 | 0.0035 | 0.0160 | 4.60 | 4.11 | 23.0 |
| 14 | ↑ | 1/90 | ↑ | 2.9 | 0.985/1.00 | 0.0000 | 76 | 1/2 | 0.0035 | 0.0178 | 5.15 | 4.24 | 23.8 |
| 15 | ↑ | 1/9 | ↑ | 7.2 | 0.987/1.00 | 0.0000 | 35 | 1/2 | 0.0034 | 0.0118 | 3.47 | 0.05 | 4.8 |
| 16 | ↑ | 1/202 | ↑ | 9.8 | 0.970/1.00 | 0.0008 | 91 | 1/2 | 0.0033 | 0.0147 | 4.39 | 3.06 | 43.6 |
| 17 | ↑ | 1/90 | 72° C./0.46 | 7.1 | 0.989/1.00 | 0.0000 | 79 | 1/2 | 0.0034 | 0.0127 | 3.77 | 0.32 | 25.2 |
| 18 | ↑ | ↑ | 72° C./50.5 | 8.0 | 0.970/1.00 | 0.0004 | 85 | 1/2 | 0.0033 | 0.0120 | 3.67 | 2.03 | 21.8 |
| 19 | ↑ | ↑ | 115° C./6.0 | 9.3 | 0.970/1.00 | 0.0001 | 83 | 1/2 | 0.0032 | 0.0118 | 3.71 | 0.97 | 24.0 |
| 20 | ↑ | ↑ | 72° C./6.0 | 7.5 | 0.971/1.00 | 0.0001 | 76 | 1/2 | 0.0034 | 0.0144 | 4.29 | 0.00 | 23.1 |
| 21 | Pvz. | ↑ | ↑ | 7.6 | 0.960/0.97 | 0.0018 | 100 | 1/2 | 0.0004 | N.D. *2 | — | 4.59 | 25.0 |
| 22 | ↑ | ↑ | ↑ | 7.5 | 0.970/0.98 | 0.0021 | 97 | 1/2 | 0.0003 | N.D. *2 | — | 3.11 | 25.0 |

*1: Pmn. = polymerization, Pvz. = pulverization

*2: N.D. = not detected

TABLE 5

Magnetic Toner

| Magnetic toner | Black powder | External additive*: silica (agent): part(s) other additive: part(s) |
|---|---|---|
| 1 | 1 | silica(HMDS → SO) ; 1 |
| 2 | 2 | ↑ ; 1 |
| 3 | 3 | ↑ ; 1 |

TABLE 5-continued

| Magnetic toner | Black powder | External additive*: silica (agent): part(s) other additive: part(s) | |
|---|---|---|---|
| 4 | 4 | ↑ | ; 1 |
| 5 | 7 | ↑ | ; 1 |
| 6 | 8 | ↑ | ; 0.6 |
| 7 | 9 | ↑ | ; 1 |
| 8 | 10 | ↑ | ; 1 |
| 9 | 11 | ↑ | ; 1 |
| 10 | 12 | ↑ | ; 1 |
| 11 | 16 | ↑ | ; 0.5 |
| 12 | 17 | ↑ | ; 1 |
| 13 | 18 | ↑ | ; 0.6 |
| 14 | 19 | ↑ | ; 0.6 |
| 15 | 20 | ↑ | ; 1 |
| 16 | 22 | ↑ | ; 1 |
| 17 | 1 | silica(HMDS) | ; 1 |
| 18 | 1 | titania (i-BTMS) | ; 1 |
| 19 | 1 | alumina (i-BTMS) | ; 1 |
| 20 | 1 | silica (HMDS→SO) | ; 1 |
| | | Conductive powder 1 | ; 2 |
| 21 | 1 | silica (HMDS→SO) | ; 1 |
| | | Conductive powder 2 | ; 2 |
| 22 | 1 | silica (HMDS→SO) | ; 1 |
| | | Conductive powder 3 | ; 2 |
| 23 | 1 | silica (HMDS→SO) | ; 1 |
| | | Conductive powder 4 | ; 2 |
| 24 | 1 | silica (HMDS→SO) | ; 1 |
| | | Conductive powder 5 | ; 2 |
| Comp. 1 | 5 | silica (HMDS→SO) | ; 0.6 |
| Comp. 2 | 6 | ↑ | ; 0.6 |
| Comp. 3 | 13 | ↑ | ; 0.6 |
| Comp. 4 | 14 | ↑ | ; 1.5 |
| Comp. 5 | 15 | ↑ | ; 1.5 |
| Comp. 6 | 21 | ↑ | ; 1 |

*: HMDS = hexamethyldisilazane
SO = silicone oil, i-BTMS = iso-buthyltrimethoxysilane
silica (HMDS → SO) means silica treated first with HMDS and then with SO.
Conductive powder = Electroconductive fine powder (1,2 . . . )

TABLE 6

Image forming performances in 15° C./10% RH

| Example | Magnetic Toner | Initial I.D. | Initial Fog | Initial Transfer | Initial Resolution | After 2000 sheets *1 I.D. | After 2000 sheets *1 Fog | Offset *2 (Back-soil) | Image failure *3 |
|---|---|---|---|---|---|---|---|---|---|
| 1 | 1 | 1.48 | 0.6% | 97% | A | 1.46 | 0.8 | none | N.O. |
| 2 | 2 | 1.42 | 1.2 | 92 | B | 1.38 | 1.6 | none | 1800/s |
| 3 | 3 | 1.47 | 0.6 | 97 | A | 1.46 | 0.7 | 1/100 | 1700/s |
| 4 | 4 | 1.48 | 0.6 | 97 | A | 1.46 | 0.8 | none | N.O. |
| 5 | 5 | 1.43 | 1.1 | 94 | B | 1.39 | 1.3 | none | 1900/s |
| 6 | 6 | 1.42 | 1.3 | 91 | B | 1.37 | 1.7 | none | 1600/s |
| 7 | 7 | 1.40 | 1.4 | 90 | C | 1.34 | 2.0 | none | 1400/s |
| 8 | 8 | 1.40 | 1.3 | 93 | B | 1.36 | 1.8 | none | 1700/s |
| 9 | 9 | 1.42 | 1.2 | 92 | B | 1.38 | 1.7 | none | 1800/s |
| 10 | 10 | 1.41 | 1.3 | 93 | B | 1.37 | 1.8 | none | 1800/s |
| 11 | 11 | 1.37 | 1.0 | 92 | B | 1.30 | 1.4 | 5/100 | 1900/s |
| 12 | 12 | 1.47 | 0.6 | 97 | A | 1.45 | 0.8 | 4/100 | N.O. |
| 13 | 13 | 1.42 | 1.3 | 90 | C | 1.34 | 2.0 | none | 1600/s |
| 14 | 14 | 1.45 | 1.2 | 97 | A | 1.40 | 1.8 | 5/100 | 1700/s |
| 15 | 15 | 1.17 | 1.2 | 90 | C | 1.08 | 1.9 | none | 1600/s |
| 16 | 16 | 1.37 | 1.5 | 90 | B | 1.28 | 2.0 | 5/100 | 1500/s |
| 17 | 17 | 1.44 | 0.8 | 95 | B | 1.40 | 1.2 | none | 1900/s |
| 18 | 18 | 1.43 | 0.9 | 94 | B | 1.39 | 1.3 | none | 1800/s |
| 19 | 19 | 1.43 | 0.9 | 95 | B | 1.38 | 1.4 | none | 1800/s |
| 20 | 20 | 1.50 | 0.5 | 98 | A | 1.49 | 0.7 | none | N.O. |
| 21 | 21 | 1.50 | 0.5 | 98 | A | 1.49 | 0.7 | none | N.O. |
| 22 | 22 | 1.51 | 0.4 | 99 | A | 1.51 | 0.5 | none | N.O. |
| 23 | 23 | 1.50 | 0.5 | 98 | A | 1.49 | 0.7 | none | N.O. |
| 24 | 24 | 1.50 | 0.5 | 98 | A | 1.49 | 0.7 | none | N.O. |
| Comp. 1 | Comp. 1 | 1.19 | 3.6 | 84 | D | N.E. | | none | 300 interrupted |
| Comp. 2 | Comp. 2 | 1.18 | 3.7 | 83 | D | N.E. | | none | 300 interrupted |
| Comp. 3 | Comp. 3 | 1.21 | 2.9 | 82 | D | N.E. | | none | 700 interrupted |
| Comp. 4 | Comp. 4 | 1.16 | 2.3 | 88 | B | N.E. | | none | 1100 interrupted |
| Comp. 5 | Comp. 5 | 0.99 | 2.0 | 90 | C | 0.75 | 4.1 | none | 1200 interrupted |
| Comp. 6 | Comp. 6 | 1.32 | 2.4 | 81 | D | N.E. | | 11/100 | 800 interrupted |

*1: "N.E." = not evaluated
*2: "5/100" = means back soil was observed on 5 sheets among 100 sheets.
*3: "N.O." means not observed.
"1800/s" means slight image failure was observed from ca. 1800-th sheet
"300, interrupted" means image failure occurred since ca. 300 sheets, and the continuous image formation was interrupted.

Polar Polymer

Production Example 6 for Polar Polymer

Into a pressurizable reaction vessel equipped with a reflux pipe, a stirrer, a thermometer, a nitrogen-intake pipe, a droplet addition device and a vacuum means, 150 parts of methanol, 250 parts of 2-butanone and 100 parts of 2-propanol as solvents, and 84 parts of styrene, 13 parts of 2-ethylhexyl acrylate and 3 parts of 2-acrylamido-2-methylpropanesulfonic acid as monomers, were added and heated under stirring to a reflux temperature. Then, a solution of 2 parts of t-butylperoxy-2-ethylhexanoate (polymerization initiator) in 20 parts of 2-butanone was added dropwise thereto in 30 min., followed by 5 hours of continued stirring, dropwise addition in 30 min. of a solution of 1 part of t-butyl peroxy-2-ethylhexanoate in 20 parts of 2-butanone and further 5 hours of stirring, to complete the polymerization.

After distilling off the solvent, the polymerizate was coarsely crushed to below 100 $\mu$m by a cutter mill equipped with a 150 mesh-screen, to obtain Polar polymer 6, which exhibited a glass transition temperature (Tg) of ca. 70° C.

Production Examples 7–16

Polar polymers 7–16 were prepared in the same manner as in Production Example 6 except for changing the monomer compositions as shown in Table 7 below.

Comparative Production Example 2

Polar polymer 17 was prepared in the same manner as in Production Example 6 except for changing the monomer composition as shown in Table 7.

TABLE 7

| Polar polymers | | | | | | |
|---|---|---|---|---|---|---|
| Polar | Monomers* (parts) | | | | Tg | Mw |
| polymer | AMPS | styrene | 2-EHA | DMAA | (° C.) | (×10$^4$) |
| 6 | 3 | 84 | 13 | 0 | 70 | 2.0 |
| 7 | 5 | 78 | 17 | 0 | 61 | 1.5 |
| 8 | 0.03 | 91.47 | 8.5 | 0 | 80 | 5.5 |
| 9 | 0.2 | 86.8 | 13 | 0 | 70 | 4.5 |
| 10 | 1 | 88 | 11 | 0 | 72 | 3.0 |
| 11 | 10 | 75 | 15 | 0 | 62 | 1.0 |
| 12 | 15 | 68 | 17 | 0 | 60 | 1.0 |
| 13 | 3 | 95 | 2 | 0 | 95 | 3.0 |
| 14 | 3 | 84 | 12 | 1 | 70 | 2.0 |
| 15 | 3 | 84 | 10 | 3 | 71 | 2.0 |
| 16 | 3 | 81 | 5 | 5 | 72 | 2.0 |
| 17 | 0 | 87 | 13 | 0 | 70 | 2.0 |

*: AMPS = 2-acrylamido-2-methylpropanesulfonic acid
2-EHA = 2-ethylhexyl acrylate
DMAA = N,N-dimethylacrylamide Magnetic Toner Particles Production Example A1 for Magnetic Toner Particles Into 709 parts of deionized water, 451 parts of 0.1 mol/l-$Na_3PO_4$ aqueous solution was added, and after heating to 60° C., 67.7 parts of 1.0 mol/l -$CaCl_2$ aqueous solution was gradually added thereto, to form an aqueous medium containing calcium phosphate.

| | |
|---|---|
| Styrene | 80 part(s) |
| 2-Ethylhexyl acrylate | 20 part(s) |
| Divinylbenzene | 0.5 part(s) |
| Polar polymer 6 | 5 part(s) |
| Magnetic powder 1 (surface-treated) | 85 part(s) |

The above ingredients were uniformly dispersed and mixed by means of an attritor (made by Mitsui Miike Kakoki K.K.) to form a monomeric mixture. The mixture was heated to 60° C., and 6 parts of an ester wax principally comprising behenyl behenate and having a DSC heat-absorption peak temperature (Tabs) of 72° C., 7 parts of 2,2'-azobis(2,4-dimethylvaleronitrile) (polymerization initiator, $T_{1/2}$=140 min. at 60° C.) and 2 parts of dimethyl-2,2'-azobisisobutyrate (polymerization initiator, $t_{1/2}$=270 min. at 60° C., $t_{1/2}$=80 min. at 80° C.) were added thereto and mixed with each other to form a polymerizable composition.

The polymerizable composition was charged into the above-prepared aqueous medium and stirred at 60° C. in an $N_2$ atmosphere for 12 min. at 10,000 rpm by a TK homomixer (made by Tokushu Kika Kogyo K.K.) to disperse the droplets of the polymerizable composition in the aqueous medium. Then, the system was further stirred by a paddle stirrer and subjected to 7 hours of reaction at 60° C., followed by further 3 hours of stirring at an elevated temperature of 80° C. After the reaction, the suspension liquid was cooled, and hydrochloric acid was added thereto to dissolve the calcium phosphate. Then, the polymerizate was filtered out, washed with water and dried to obtain Black powder A1 having a weight-average particle size (D4) of 7.0 $\mu$m.

Some characterization and physical properties of Black powder A1 are inclusively shown in Table 8 together with those of Black powders prepared in the following Production Examples.

Production Examples A2–A11

Black powders A2–A11 were prepared in the same manner as in Production Example A1 except for using Polar polymers 7–16, respectively, instead of Polar polymer 6.

Production Examples A12–A16

Black powders A12–A16 were prepared in the same manner as in Production Example A1 except for changing the amounts of Polar polymer 6 as shown iN Table 8.

Production Examples A17–A22

Black powders A17–A22 were prepared in the same manner as in Production Example A1 except for using magnetic powders 2–6 (surface-treated), respectively, instead of Magnetic powder 1.

Production Example A23

Into 709 parts of deionized water, 451 parts of 0.1 mol/l-$Na_3PO_4$ aqueous solution was added, and after heating to 60° C., 67.7 parts of 1.0 mol/l-$CaCl_2$ aqueous solution was gradually added thereto, to form an aqueous medium containing calcium phosphate.

| | |
|---|---|
| Styrene | 80 part(s) |
| 2-Ethylhexyl acrylate | 20 part(s) |
| Polar polymer 6 | 5 part(s) |
| Magnetic powder 1 (surface-treated) | 90 part(s) |

The above ingredients were uniformly dispersed and mixed by means of an attritor (made by Mitsui Miike Kakoki) to form a monomeric mixture. The mixture was heated to 60° C., and 6 parts of the same ester wax as used in Production Example A1, 7.2 parts of 2,2'-azobis(2,4-dimethylvaleronitrile) and 2 parts of dimethyl-2,2'-azobisisobutyrate were added thereto and mixed with each other to form a polymerizable composition.

The polymerizable composition was charged into the above-prepared aqueous medium and stirred at 60° C. in an $N_2$ atmosphere for 15 min. at 10,000 rpm by a TK homomixer (made by Tokushu Kika Kogyo K.K.) to disperse the droplets of the polymerizable composition in the aqueous medium. Then, the system was further stirred by a paddle stirrer and subjected to 3 hours of reaction at 60° C., followed by further 1 hour of stirring at an elevated temperature of 80° C.

Then, into the above suspension liquid, a mixture of

| | |
|---|---|
| Styrene | 15 part(s) |
| Potassium persulfate | 1 part(s) |
| Sodium dodecylbenzenesulfonate | 0.1 part(s) |
| Deionized water | 100 part(s) |

was added after dispersion by an ultrasonic disperser, and the system was heated to 80° C. and stirred for 6 hours at least temperature.

After the reaction, the suspension liquid was cooled, and hydrochloric acid was added thereto to dissolve the calcium phosphate. Then, the polymerizate was filtered out, washed with water and dried to obtain Black powder A23 (D4=7.1 μm).

Production Example A24

Black powder A24 was prepared in the same manner as in Production Example A1 except for increasing Magnetic powder 1 to 202 parts.

Production Example A25

Black powder A25 was prepared in the same manner as in Production Example A1 except for using a polyethylene-based wax (Tabs=115° C.) instead of the ester wax.

Production Examples A26 and A27

Black powder A26 and A27 were prepared in the same manner as in Production Example A1 except for changing the amounts of the ester wax as shown in Table 8.

Comparative Production Example B1

Black powder A28 was prepared in the same manner as in Production Example A1 except for using Polar polymer A17 instead of Polar polymer 6.

Comparative Production Example B2

Black powder A29 was prepared in the same manner as in Production Example A1 except for using Magnetic polymer 8 (surface-treated) instead of Magnetic polymer 1.

Comparative Production Example B3

Black powder A30 having a weight-average particle size (D4) of 2.9 μm was prepared in the same manner as in Production Example A1 except for increasing the amounts of the $Na_3PO_4$ aqueous solution and the $CaCl_2$ aqueous solution so as to increase the amount of the calcium phosphate in the aqueous medium and further adding sodium dodecylbenzenesulfonate thereto.

Comparative Production Example B4

Black powder A31 having a weight-average particle size (D4) of 10.6 μm was prepared in the same manner as in Production Example A1 except for decreasing the amounts of the $Na_3PO_4$ aqueous solution and the $CaCl_2$ aqueous solution so as to decrease the amount of the calcium phosphate in the aqueous medium.

Comparative Production Example B5

Black powder A32 was prepared in the same manner as in Production Example A1 except for reducing magnetic particle 1 to 9 parts.

Comparative Production Example B6

| | |
|---|---|
| Styrene-n-butyl acrylate copolymer (= 80/20 by weight) | 100 part(s) |
| Polar polymer 6 | 2 part(s) |
| Magnetic particle 1 (surface-treated) | 90 part(s) |
| Ester wax (the same as in Production Example A1) | 6 part(s) |

The above ingredients were blended by a blender and melt-kneaded by a twin-screw heated at 110° C. After being cooled, the melt-kneaded product was coarsely crushed by a hammer mill and then pulverized by a turbo mill (made by Turbo Kogyo K.K.), followed by pneumatic classification to obtain Black powder A33 (D4=7.2 μm).

Magnetic Toners

Production Example A1 for Magnetic Toner

To 100 parts of Black powder A1, 1 part of hydrophobic silica fine powder ($S_{BET}$=120 $m^2/g$) obtained by treating silica having a primary particle size (Dp1) of 12 nm successively with hexamethyldisilazane and then silicone oil was added and mixed therewith by a Henschel mixer (made by Mitsui Miike Kakoki K.K.) to obtain Magnetic toner A1.

The prescription of Magnetic toner 1 is shown in Table 9 appearing hereinafter together with those of magnetic toners obtained in the following Production Examples.

Production Example A2

100 parts of Black powder A2 was blended with 1 part of the same hydrophobic silica fine powder as used in Production Example A1 to obtain Magnetic toner A2.

Production Example A3

100 parts of Black powder A3 was blended with 0.6 part of the same hydrophobic silica fine powder as used in Production Example A1 to obtain Magnetic toner A3.

Production Examples A4–A5

100 parts each of Black powders A4 and A5 were respectively blended with 1 part of the same hydrophobic silica fine powder as used in Production Example A1 to obtain Magnetic toners A4 and A5, respectively.

Production Example A6

100 parts of Black powder A6 was blended with 1.2 parts of the same hydrophobic silica fine powder as used in Production Example A1 to obtain Magnetic toner A6.

Production Examples A7–A27

100 parts each of Black powders A7–A27 were respectively blended with 1 part of the same hydrophobic silica fine powder as used in Production Example 1 to obtain Magnetic toners A7–A27, respectively.

Production Examples A28–A30

100 parts each of Black powder A1 was separately blended with 1 part of hydrophobic silica fine powder ($S_{BET}$=180 $m^2/g$) treated with hexamethyldisilazane, 1 part of hydrophobic titanium oxide ($S_{BET}$=90 $m^2/g$) treated with isobutyltrimethoxysilane or 1 part of hydrophobic alumina fine powder ($S_{BET}$=140 $m^2/g$) treated with isobutyltrimethoxysilane to obtain Magnetic toners A28–A30, respectively.

Production Example A31

100 parts of Black powder A1 was blended with 1 part of the same hydrophobic silica fine powder as used in Production Example A1 and 2 parts of Electroconductive fine powder 1 to obtain Magnetic toner A31.

Production Examples A32–A35

100 parts each of Black powder A1 blended with 1 part of the same hydrophobic silica fine powder as used in Production Example 1 and also with 2 parts of one of Electroconductive fine powders 2 to 5 to obtain Magnetic toners A32 and A35, respectively.

Production Example A36

100 parts of Black powder A1 was blended with 1 part of hydrophobic silica fine powder ($S_{BET}$=120 $m^2/g$) obtained by treating silica (Dp1=12 nm) successively with hexamethyldisilazane and silicone oil, and 0.2 part of hydrophobic silica fine powder obtained by treating silica (Dp1=80 nm) with hexamethyldisilazane by means of a Henschel mixer (made by Mitsui Miike Kakoki K.K.) to obtain Magnetic toner A36.

Comparative Production Examples B1–B2

100 parts each of Black powders A28 and A29 were respectively blended with 1 part of the same hydrophobic silica fine powder as used in Production Example A1 to obtain Comparative Magnetic toners B1 and B2, respectively.

Comparative Production Example B3

100 parts of Black powder A30 was blended with 1.5 part of the same hydrophobic silica fine powder as used in Production Example A1 to obtain Comparative Magnetic toner B3.

Comparative Production Example B4

100 parts of Black powder A31 was blended with 0.7 part of the same hydrophobic silica fine powder as used in Production Example A1 to obtain Comparative Magnetic toner B4.

Production Examples B5–B6

100 parts each of Black powders A32 and A33 were respectively blended with 1 part of the same hydrophobic silica fine powder as used in Production Example A1 to obtain Comparative Magnetic toners B5 and B6, respectively.

EXAMPLES 25–59

Similar image forming tests as in Example 1 were performed by using Magnetic toners A1–A35, and after changing the apparatus and operation conditions including: the gap between the developing sleeve 102 and the photosensitive drum 100 from 310 $\mu$m to 280 $\mu$m, the silicon rubber blade to a urethane rubber blade, the AC component of the developing bias voltage from 1.5 kVpp to 2.1 kVpp, the photosensitive peripheral speed from 94 mm/sec to 140 mm/sec, and the developing sleeve peripheral speed from 103 mm/sec to 154 mm/sec (1.1×140 mm/sec).

The results are inclusively shown in Table 10.

Comparative Examples 7–12

Image forming tests were performed in the same manner as in Example 25 except for using Comparative Magnetic toner B1–B6. The results are also inclusively shown in Table 10. As shown in Table 10, the image forming performances were generally inferior from the initial stage, and became worse on continuation of the image formation so that the continuous image formation was interrupted in some cases.

TABLE 8

| | | | | | | Black powder (magnetic toner particles) | | | | | | | |
|---|---|---|---|---|---|---|---|---|---|---|---|---|---|
| Black powder | Process *1 | Magnetic powder No./parts (per 100 parts of resin) | Wax $T_{abs}$/parts | $D_4$ ($\mu$m) | Circularity $C_{av}/C_{mode}$ | B/A | N% of D/C ≦ 0.02 | Polar polymer No/parts | E/A | F/A | F/E | Isolated iron | σ79.6 ($Am^2/kg$) |
| A1 | Pmn. | 1/85 | 72° C./6.0 | 7.0 | 0.987/1.00 | 0.0000 | 84 | 6/5 | 0.0032 | 0.0039 | 1.22 | 0.21 | 23.7 |
| A2 | ↑ | ↑ | ↑ | 6.9 | 0.977/1.00 | 0.0001 | 83 | 7/5 | 0.0036 | 0.0052 | 1.44 | 0.18 | 23.7 |
| A3 | ↑ | ↑ | ↑ | 9.5 | 0.979/1.00 | 0.0002 | 81 | 8/10 | 0.0026 | 0.0025 | 0.96 | 0.22 | 23.7 |
| A4 | ↑ | ↑ | ↑ | 8.2 | 0.987/1.00 | 0.0001 | 82 | 9/5 | 0.0026 | 0.0021 | 0.81 | 0.52 | 23.7 |
| A5 | ↑ | ↑ | ↑ | 7.7 | 0.980/1.00 | 0.0001 | 83 | 10/5 | 0.0028 | 0.0026 | 0.83 | 0.46 | 23.7 |
| A6 | ↑ | ↑ | ↑ | 4.8 | 0.976/1.00 | 0.0004 | 78 | 11/5 | 0.0046 | 0.0093 | 2.02 | 0.17 | 23.7 |
| A7 | ↑ | ↑ | ↑ | 6.6 | 0.985/1.00 | 0.0003 | 80 | 12/2 | 0.0040 | 0.0052 | 1.30 | 0.34 | 23.7 |
| A8 | ↑ | ↑ | ↑ | 7.0 | 0.979/1.00 | 0.0000 | 84 | 13/5 | 0.0029 | 0.0039 | 1.34 | 0.22 | 23.7 |
| A9 | ↑ | ↑ | ↑ | 6.7 | 0.977/1.00 | 0.0001 | 81 | 14/5 | 0.0027 | 0.0060 | 2.22 | 0.25 | 23.7 |
| A10 | ↑ | ↑ | ↑ | 6.3 | 0.978/1.00 | 0.0002 | 79 | 15/5 | 0.0025 | 0.0066 | 2.64 | 0.20 | 23.7 |

TABLE 8-continued

Black powder (magnetic toner particles)

| Black powder | Process *1 | Magnetic powder No./parts (per 100 parts of resin) | Wax $T_{abs}$/parts | $D_4$ (μm) | Circularity $C_{av}/C_{mode}$ | B/A | N% of D/C ≦ 0.02 | Polar polymer No/parts | E/A | F/A | F/E | Isolated iron | σ79.6 ($Am^2/kg$) |
|---|---|---|---|---|---|---|---|---|---|---|---|---|---|
| A11 | ↑ | ↑ | ↑ | 6.0 | 0.986/1.00 | 0.0001 | 78 | 16/5 | 0.0010 | 0.0072 | 7.20 | 0.33 | 23.7 |
| A12 | ↑ | ↑ | ↑ | 6.6 | 0.972/1.00 | 0.0008 | 93 | 6/0.007 | 0.0015 | 0.0039 | 2.60 | 2.60 | 23.7 |
| A13 | ↑ | ↑ | ↑ | 8.0 | 0.978/1.00 | 0.0004 | 89 | 6/1 | 0.0024 | 0.0039 | 1.63 | 1.95 | 23.7 |
| A14 | ↑ | ↑ | ↑ | 7.1 | 0.975/1.00 | 0.0000 | 84 | 6/10 | 0.0039 | 0.0039 | 1.00 | 1.30 | 23.7 |
| A15 | ↑ | ↑ | ↑ | 6.5 | 0.974/1.00 | 0.0000 | 83 | 6/18 | 0.0046 | 0.0039 | 0.85 | 0.65 | 23.7 |
| A16 | ↑ | ↑ | ↑ | 6.3 | 0.971/1.00 | 0.0000 | 84 | 6/25 | 0.0056 | 0.0096 | 1.71 | 0.32 | 23.7 |
| A17 | ↑ | 2/85 | ↑ | 6.3 | 0.981/1.00 | 0.0004 | 87 | 6/5 | 0.0026 | 0.0032 | 1.23 | 0.78 | 23.4 |
| A18 | ↑ | 3/85 | ↑ | 6.5 | 0.982/1.00 | 0.0008 | 91 | 6/5 | 0.0020 | 0.0024 | 1.20 | 1.42 | 23.1 |
| A19 | ↑ | 4/85 | ↑ | 8.6 | 0.974/1.00 | 0.0002 | 87 | 6/5 | 0.0028 | 0.0034 | 1.21 | 0.40 | 28.0 |
| A20 | ↑ | 5/85 | ↑ | 6.6 | 0.982/1.00 | 0.0004 | 86 | 6/5 | 0.0027 | 0.0033 | 1.22 | 0.68 | 23.5 |
| A21 | ↑ | 6/85 | ↑ | 8.4 | 0.987/1.00 | 0.0002 | 83 | 6/5 | 0.0031 | 0.0038 | 1.23 | 0.32 | 24.2 |
| A22 | ↑ | 7/85 | ↑ | 6.9 | 0.983/1.00 | 0.0000 | 85 | 6/5 | 0.0033 | 0.0040 | 1.21 | 0.23 | 23.8 |
| A23 | ↑ | 1/90 | ↑ | 7.1 | 0.976/1.00 | 0.0000 | 80 | 6/5 | 0.0048 | N.D. *2 | 0.00 | 0.31 | 23.7 |
| A24 | ↑ | 1/202 | ↑ | 7.6 | 0.971/1.00 | 0.0007 | 83 | 6/5 | 0.0022 | 0.0028 | 1.27 | 1.18 | 45.1 |
| A25 | ↑ | 1/85 | 115° C./6.0 | 6.5 | 0.978/1.00 | 0.0004 | 82 | 6/5 | 0.0029 | 0.0043 | 1.48 | 0.91 | 23.5 |
| A26 | ↑ | ↑ | 72° C./0.46 | 7.6 | 0.986/1.00 | 0.0000 | 72 | 6/5 | 0.0036 | 0.0043 | 1.19 | 4.11 | 24.2 |
| A27 | ↑ | ↑ | 72° C./50.5 | 6.4 | 0.974/1.00 | 0.0007 | 91 | 6/5 | 0.0026 | 0.0042 | 1.62 | 4.24 | 23.0 |
| A28 | ↑ | ↑ | 72° C./6.0 | 5.3 | 0.986/1.00 | 0.0015 | 92 | 17/5 | N.D. *2 | N.D. *2 | — | 3.42 | 23.7 |
| A29 | ↑ | 8/85 | ↑ | 7.2 | 0.968/1.00 | 0.0051 | 100 | 6/5 | 0.0015 | 0.0018 | 1.20 | 3.84 | 22.8 |
| A30 | ↑ | 1/85 | ↑ | 2.8 | 0.982/1.00 | 0.0001 | 86 | 6/5 | 0.0027 | 0.0035 | 1.30 | 0.30 | 23.0 |
| A31 | ↑ | ↑ | ↑ | 10.6 | 0.986/1.00 | 0.0000 | 68 | 6/5 | 0.0035 | 0.0051 | 1.46 | 0.28 | 23.2 |
| A32 | ↑ | 1/9 | ↑ | 7.1 | 0.985/1.00 | 0.0000 | 45 | 6/5 | 0.0037 | 0.0046 | 1.24 | 0.18 | 3.3 |
| A33 | Pvz. | 1/85 | ↑ | 7.2 | 0.963/1.00 | 0.0021 | 100 | 6/5 | 0.0004 | N.D. *2 | 0.00 | 4.59 | 23.8 |

*1: Pmn = polymerization, Pvz. = pulverization
*2: N.D. = not detected

TABLE 9

Magnetic Toner

| Magnetic toner | Black powder | External additive*: silica (agent): part(s) other additive: part(s) | |
|---|---|---|---|
| A1 | A1 | silica(HMDS→SO) | ; 1 |
| A2 | A2 | ↑ | |
| A3 | A3 | silica (HMDS→SO) | ; 0.6 |
| A4 | A4 | silica (HMDS→SO) | ; 1 |
| A5 | A5 | ↑ | |
| A6 | A6 | silica (HMDS→SO) | ; 1.5 |
| A7 | A7 | silica (HMDS→SO) | ; 1 |
| A8 | A8 | ↑ | |
| A9 | A9 | ↑ | |
| A10 | A10 | ↑ | |
| A11 | A11 | ↑ | |
| A12 | A12 | ↑ | |
| A13 | A13 | ↑ | |
| A14 | A14 | ↑ | |
| A15 | A15 | ↑ | |
| A16 | A16 | ↑ | |
| A17 | A17 | ↑ | |
| A18 | A18 | ↑ | |
| A19 | A19 | ↑ | |
| A20 | A20 | ↑ | |
| A21 | A21 | ↑ | |
| A22 | A22 | ↑ | |
| A23 | A23 | ↑ | |
| A24 | A24 | ↑ | |
| A25 | A25 | ↑ | |
| A26 | A26 | ↑ | |
| A27 | A27 | ↑ | |
| A28 | A1 | silica (HMDS) | ; 1 |
| A29 | A1 | titania (i-BTMS) | ; 1 |
| A30 | A1 | alumina (i-BTMS) | ; 1 |
| A31 | A1 | silica (HMDS→SO) | ; 1 |
| | | Conductive powder 1 | ; 2 |

TABLE 9-continued

Magnetic Toner

| Magnetic toner | Black powder | External additive*: silica (agent): part(s) other additive: part(s) | |
|---|---|---|---|
| A32 | A1 | silica (HMDS→SO) | ; 1 |
| | | Conductive powder 2 | ; 2 |
| A33 | A1 | silica (HMDS→SO) | ; 1 |
| | | Conductive powder 3 | ; 2 |
| A34 | A1 | silica (HMDS→SO) | ; 1 |
| | | Conductive powder 4 | ; 2 |
| A35 | A1 | silica (HMDS→SO) | ; 1 |
| | | Conductive powder 5 | ; 2 |
| A36 | A1 | silica (HMDS→SO) | ; 1 |
| | | silica (HMDS) | ; 0.2 |
| Comp. B1 | A28 | silica (HMDS→SO) | ; 1 |
| Comp. B2 | A29 | ↑ | |
| Comp. B3 | A30 | silica (HMDS→SO) | ; 1.5 |
| Comp. B4 | A31 | silica (HMDS→SO) | ; 0.7 |
| Comp. B5 | A32 | silica (HMDS→SO) | ; 1 |
| Comp. B6 | A33 | ↑ | |

*: HMDS = hexamethyldisilazane

SO = silicone oil, i-BTMS = iso-buthyltrimethoxysilane silica (HMDS→SO) means silica treated first with HMDS and then with SO.

Conductive powder = Electroconductive fine powder (1,2 . . . )

TABLE 10

| | | Image forming performances in 15° C./10% RH | | | | | | | |
|---|---|---|---|---|---|---|---|---|---|
| | Magnetic | Initial | | | | After 2000 sheets *1 | | Offset *2 | Image |
| Example | Toner | I.D. | Fog | Transfer | Resolution | I.D. | Fog | (Back-soil) | failure *3 |
| 25 | A1 | 1.47 | 0.5% | 97% | A | 1.46 | 0.7 | none | N.O. |
| 26 | A2 | 1.45 | 0.7 | 96 | A | 1.45 | 0.7 | none | N.O. |
| 27 | A3 | 1.46 | 1 | 94 | B | 1.45 | 1.2 | 1/100 | 1800/s |
| 28 | A4 | 1.43 | 0.9 | 95 | B | 1.46 | 1.1 | none | 1900/s |
| 29 | A5 | 1.46 | 0.7 | 96 | A | 1.45 | 0.9 | none | N.O. |
| 30 | A6 | 1.44 | 1.8 | 93 | C | 1.42 | 2.3 | none | 1600/s |
| 31 | A7 | 1.45 | 2.1 | 94 | C | 1.42 | 2.5 | 2/100 | 1500/s |
| 32 | A8 | 1.47 | 0.6 | 97 | A | 1.46 | 0.7 | 1/100 | N.O. |
| 33 | A9 | 1.43 | 0.9 | 95 | A | 1.42 | 1.4 | none | 1900/s |
| 34 | A10 | 1.42 | 1 | 94 | B | 1.4 | 1.4 | none | 1800/s |
| 35 | A11 | 1.4 | 1.1 | 93 | B | 1.38 | 1.5 | none | 1800/s |
| 36 | A12 | 1.35 | 1.2 | 90 | C | 1.34 | 1.8 | none | 1600/s |
| 37 | A13 | 1.4 | 0.8 | 95 | B | 1.4 | 1.2 | none | 1900/s |
| 38 | A14 | 1.47 | 1.2 | 97 | C | 1.46 | 1.7 | 3/100 | 1900/s |
| 39 | A15 | 1.47 | 2.3 | 97 | C | 1.46 | 3.4 | 4/100 | 1700/s |
| 40 | A16 | 1.47 | 3.5 | 97 | C | 1.46 | 4.6 | 5/100 | 1500/s |
| 41 | A17 | 1.42 | 1.2 | 92 | B | 1.4 | 1.5 | none | 1600/s |
| 42 | A18 | 1.4 | 1.3 | 91 | C | 1.38 | 1.5 | none | 1400/s |
| 43 | A19 | 1.41 | 1.3 | 93 | B | 1.4 | 1.5 | none | 1700/s |
| 44 | A20 | 1.42 | 1.4 | 93 | B | 1.4 | 1.6 | none | 1800/s |
| 45 | A21 | 1.41 | 1.3 | 92 | B | 1.39 | 1.6 | none | 1800/s |
| 46 | A22 | 1.48 | 0.5 | 98 | A | 1.47 | 0.7 | none | N.O. |
| 47 | A23 | 1.25 | 2.2 | 90 | C | 1.2 | 3.4 | none | 1200/s |
| 48 | A24 | 1.35 | 1.8 | 90 | C | 1.28 | 2.4 | 5/100 | 1400/s |
| 49 | A25 | 1.46 | 1.4 | 97 | A | 1.41 | 1.8 | 4/100 | 1600/s |
| 50 | A26 | 1.47 | 0.6 | 97 | A | 1.45 | 0.8 | 5/100 | N.O. |
| 51 | A27 | 1.41 | 1.4 | 90 | C | 1.33 | 1.9 | none | 1600/s |
| 52 | A28 | 1.45 | 0.8 | 95 | B | 1.41 | 1.2 | none | 1900/s |
| 53 | A29 | 1.43 | 0.9 | 93 | B | 1.38 | 1.3 | none | 1800/s |
| 54 | A30 | 1.43 | 0.9 | 94 | B | 1.38 | 1.4 | none | 1800/s |
| 55 | A31 | 1.51 | 0.5 | 98 | A | 1.49 | 0.7 | none | N.O. |
| 56 | A32 | 1.5 | 0.5 | 98 | A | 1.49 | 0.7 | none | N.O. |
| 57 | A33 | 1.52 | 0.3 | 99 | A | 1.51 | 0.5 | none | N.O. |
| 58 | A34 | 1.51 | 0.5 | 98 | A | 1.49 | 0.7 | none | N.O. |
| 59 | A35 | 1.51 | 0.5 | 98 | A | 1.49 | 0.7 | none | N.O. |
| Comp. 7 | Comp. B1 | 1.12 | 4.1 | 82 | D | N.E. | | none | 300 interrupted |
| Comp. 8 | Comp. B2 | 1.18 | 4.2 | 82 | D | N.E. | | none | 300 interrupted |
| Comp. 9 | Comp. B3 | 1.15 | 2.6 | 84 | B | N.E. | | none | 500 interrupted |
| Comp. 10 | Comp. B4 | 1.18 | 1.8 | 86 | D | N.E. | | none | 1200 interrupted |
| Comp. 11 | Comp. B5 | 0.92 | 2.2 | 90 | C | 0.69 | 3.0 | none | 1300 interrupted |
| Comp. 12 | Comp. B6 | 1.34 | 2.3 | 83 | D | N.E. | | 10/100 | 800 interrupted |

*1: "N.E." = not evaluated
*2: "5/100" = means back soil was observed on 5 sheets among 100 sheets.
*3: "N.O." means not observed.
"1800/s" means slight image failure was observed from ca. 1800-th sheet
"300, interrupted" means image failure occurred since ca. 300 sheets, and the continuous image formation was interrupted.

EXAMPLES 60–91

Image formation was performed under similar condition as in Example 25 except for using Magnetic toners 1–4, 20–24, A1–A16, A22, A26 and A31–A35; changing the environment from 15° C./10%RH to 30° C./80%RH, changing the transfer material from paper of 90 g/m$^2$ to paper of 75 g/cm$^2$; and changing the printing pattern to lateral line images at an image areal percentage of 4%.

The results are inclusively shown in Table 12 together with those of the following Examples.

EXAMPLE 92

Magnetic toner A1 was first subjected to blank rotation for 60 min. without printing and then subjected to the same image formation test as in Example 60.

EXAMPLE 93

The same evaluation as in Example 92 was performed by using Magnetic toner A36 instead of Magnetic toner A1.

Image evaluation was performed with respect to the following items.

(1) Image Density (I.D.)

Solid images were printed out from the initial stage at intervals of 500 sheets up to 2000 sheets, and the reflection densities thereof relative to that (0.00) of the white background portion were measured by Macbeth reflection densitometer ("RD918", available from Macbeth Co.) and evaluated according to the following standard:

A: I.D.≧1.40
B: 1.35≦I.D.<1.40
C: 1.00≦I.D.<1.35
D: I.D.<1.00

(2) Fog

Whiteness of a white background portion of printed image and a blank white paper were measured by using a reflectometer ("MODEL:TC-6DS", made by Tokyo denshoku K.K.) together with a green filter to determine a fog (%) as a difference therebetween, and the evaluation was performed according to the following standard:

A: Below 1.0%

B: 1.0% to below 2.0%

C: 2.0% to below 3.0%

D: 3.0% or higher (3) Transfer Efficiency $T_{EF}$ (%)

Measured in the same manner as above and calculated according to the following formula:

$$T_{EF}(\%)=((D-C)/(D-E))\times 100,$$

wherein D: transferred solid image density, C: transfer residual toner image density and E: black paper density, respectively measured via a polyester adhesive tape. The evaluation was performed according to the following standard:

A: $T_{EF}\geqq 97\%$

B: $94\%\leqq T_{EF}<97\%$

C: $90\%\leqq T_{EF}<94\%$

D: $T_{EF}<90\%$ (4) Toner Consumption Tcsmp

After the continuous image formation on 2000 sheets, a decreased magnetic toner amount (mg) in the developer vessel was measured to calculate a toner consumption Tcsmp (mg/sheet).

The evaluation results are inclusively shown in Table 11 below.

TABLE 11

| Image-forming performances in 30° C./80% RH | | | | | | | | |
|---|---|---|---|---|---|---|---|---|
| Example | Magnetic toner | Initial I.D. | Initial Fog | Initial Transfer | After 2000 sheets I.D. | After 2000 sheets Fog | After 2000 sheets Transfer | $T_{csmp}$ (mg/sheet) |
| 60 | 1 | B | B | B | B | B | B | 52 |
| 61 | 2 | B | C | C | B | C | D | 55 |
| 62 | 3 | B | C | B | B | C | C | 53 |
| 63 | 4 | B | B | B | B | B | C | 53 |
| 64 | 20 | B | B | A | B | B | A | 51 |
| 65 | 21 | B | B | B | B | B | B | 52 |
| 66 | 22 | B | B | B | B | B | B | 53 |
| 67 | 23 | B | B | B | B | B | C | 53 |
| 68 | 24 | B | B | C | B | C | C | 54 |
| 69 | A1 | A | A | A | A | A | A | 47 |
| 70 | A2 | A | A | A | A | A | A | 47 |
| 71 | A3 | A | B | B | A | B | C | 51 |
| 72 | A4 | A | B | B | A | B | B | 50 |
| 73 | A5 | A | A | A | A | A | A | 47 |
| 74 | A6 | A | B | A | A | B | A | 48 |
| 75 | A7 | A | C | A | A | C | A | 50 |
| 76 | A8 | A | A | A | A | A | A | 47 |
| 77 | A9 | A | A | B | A | A | B | 48 |
| 78 | A10 | A | B | B | A | B | B | 50 |
| 79 | A11 | A | B | B | A | B | C | 52 |
| 80 | A12 | B | B | C | B | B | C | 54 |
| 81 | A13 | A | A | B | A | A | B | 48 |
| 82 | A14 | A | B | A | A | B | A | 48 |
| 83 | A15 | A | C | A | A | C | A | 50 |
| 84 | A16 | A | C | A | A | C | A | 51 |
| 85 | A22 | A | A | A | A | A | A | 47 |
| 86 | A26 | A | A | A | A | A | A | 47 |
| 87 | A31 | A | A | A | A | A | A | 46 |
| 88 | A32 | A | A | A | A | A | A | 47 |
| 89 | A33 | A | A | A | A | A | A | 47 |
| 90 | A34 | A | A | A | A | A | A | 47 |
| 91 | A35 | A | A | B | A | A | B | 49 |
| 92 | A1 | A | A | A | A | A | B | 49 |
| 93 | A36 | A | A | A | A | A | A | 47 |

What is claimed is:

1. A magnetic toner, comprising: magnetic toner particles each comprising at least a binder resin, an iron oxide and a sulfur-containing polymer, and inorganic fine powder blended with the magnetic toner particles; wherein the magnetic toner particles have a weight-average particle size (D4) of 3–10 $\mu$m, the magnetic toner particles have an average circularity of at least 0.970, the magnetic toner particles have a magnetization of 10–50 $Am^2/kg$ (emu/g) at a magnetic field of 79.6 kA/m (1000 oersted), and the magnetic toner particles retain carbon in an amount of A and sulfur in an amount of E at surfaces thereof as measured by X-ray photoelectron spectroscopy, giving a ratio E/A from 0.0003–0.0050.

2. The magnetic toner according to claim 1, wherein the magnetic toner particles retain carbon in an amount of A and iron in an amount of B at surfaces thereof as measured by X-ray photoelectron spectroscopy, satisfying: $B/A<0.001$, and the magnetic toner contains at least 50% by number of magnetic toner particles satisfying a relationship of $D/C\leqq 0.02$, wherein C represents a projection area-equivalent circle diameter of each magnetic toner particle, and D represents a minimum distance between a surface of the magnetic toner particle and iron oxide particles contained in the magnetic toner particle.

3. The magnetic toner according to claim 1, wherein the magnetic toner particles retain sulfur in an amount of E and nitrogen in an amount of F at surfaces thereof as measured by X-ray photoelectron spectroscopy, satisfying: $0.25\leqq F/E\leqq 4$.

4. The magnetic toner according to claim 3, wherein E and F satisfy: $0.8\leqq F/E\leqq 3.0$.

5. The magnetic toner according to claim 1, wherein the magnetic toner particles retain carbon in an amount of A and nitrogen in an amount of F at surfaces thereof as measured by X-ray photoelectron spectroscopy, giving a ratio F/A in a range of 0.0005–0.010.

6. The magnetic toner according to claim 1, wherein the magnetic toner particles retain carbon in an amount of A and iron in an amount of B at surfaces thereof as measured by X-ray photoelectron spectroscopy, satisfying: $B/A<0.0005$.

7. The magnetic toner according to claim 6, wherein A and B satisfy: $B/A<0.0003$.

8. The magnetic toner according to claim 1, wherein the magnetic toner particles contain iron-containing particles exposed at a surface of the toner particles in a proportion of 0.05 to 3.00% by number with respect to the toner particles.

9. The magnetic toner according to claim 1, wherein the magnetic toner contains at least 65% by number of magnetic toner particles satisfying a relationship of $D/C\leqq 0.02$, wherein C represents a projection area-equivalent circle diameter of each magnetic toner particle, and D represents a minimum distance between a surface of the magnetic toner particle and iron oxide particles contained in the magnetic toner particle.

10. The magnetic toner according to claim 9, wherein the magnetic toner contains at least 75% by number of magnetic toner particles satisfying the relationship of $D/C\leqq 0.02$.

11. The magnetic toner according to claim 1, wherein the sulfur-containing polymer is a polymer having a group $—SO_3X$, wherein X denotes hydrogen or an alkali metal.

12. The magnetic toner according to claim 11, wherein the sulfur-containing polymer is a polymerizate of a sulfonic acid group-containing (meth)acrylamide.

13. The magnetic toner according to claim 12, wherein the sulfur-containing polymer contains 0.01–20 wt. % thereof of polymerized units of the sulfonic acid group-containing (meth)acrylamide.

14. The magnetic toner according to claim 12, wherein the sulfur-containing polymer contains 0.05–10 wt. % thereof of polymerized units of the sulfonic acid group-containing (meth)acrylamide.

15. The magnetic toner according to claim 12, wherein the sulfur-containing polymer contains 0.1–5 wt. % thereof of polymerized units of the sulfonic acid group-containing (meth)acrylamide.

16. The magnetic toner according to claim 1, wherein the sulfur-containing polymer has a glass transition temperature (Tg) of 50–100° C.

17. The magnetic toner according to claim 1, wherein the sulfur-containing polymer has a weight-average molecular weight of 2,000–100,000.

18. The magnetic toner according to claim 1, wherein the sulfur-containing polymer is contained in 0.05–20 wt. parts per 100 wt. parts of the binder resin.

19. The magnetic toner according to claim 1, wherein the toner particles contain 0.5–50 wt. % of wax based on the binder resin.

20. The magnetic toner according to claim 19, wherein the wax shows a thermal behavior giving a maximum heat-absorption peak temperature in a range of 40–110° C. on a heat-absorption curve according to DSC (differential scanning calorimetry).

21. The magnetic toner according to claim 20, wherein the wax shows a maximum heat-absorption peak temperature in a range of 45–90° C.

22. The magnetic toner according to claim 1, wherein the iron oxide has been surface-treated with a coupling agent in an aqueous medium.

23. The magnetic toner according to claim 1, wherein the magnetic toner particles have a mode circularity of at least 0.99.

24. The magnetic toner according to claim 1, wherein the inorganic fine powder has an average primary particle size of 4–80 nm and is contained in a proportion of 0.1–4 wt. % of the magnetic toner.

25. The magnetic toner according to claim 24, wherein the inorganic fine powder comprises at least one species selected from the group consisting of silica, titanium oxide, alumina and complex oxides of these.

26. The magnetic toner according to claim 24, wherein the inorganic fine powder has been hydrophobized.

27. The magnetic toner according to claim 24, wherein the inorganic fine powder has been hydrophobized with at least silicone oil.

28. The magnetic toner according to claim 24, wherein the inorganic fine powder has been hydrophobized at least with a silane compound and silicone oil.

29. The magnetic toner according to claim 1, wherein the inorganic fine powder and electroconductive fine powder larger than the inorganic fine powder are carried on the toner particle surfaces.

30. The magnetic toner according to claim 29, wherein the electroconductive fine powder has a volume resistivity of at most $10^9$ ohm.cm.

31. The magnetic toner according to claim 29, wherein the electroconductive fine powder has a volume resistivity of at most $10^6$ ohm.cm.

32. The magnetic toner according to claim 29, wherein the electroconductive fine powder is non-magnetic.

33. A magnetic toner, comprising: magnetic toner particles each comprising at least a binder resin, an iron oxide and a sulfur-containing polymer, and inorganic fine powder blended with the magnetic toner particles; wherein the magnetic toner particles have a weight-average particle size (D4) of 3–10 $\mu$m, the magnetic toner particles retain carbon in an amount of A and iron in an amount of B at surfaces thereof as measured by X-ray photoelectron spectroscopy, satisfying: $B/A<0.001$, the magnetic toner particles retain carbon in an amount of A and sulfur in an amount of E at surfaces thereof as measured by X-ray photoelectron spectroscopy, giving a ratio E/A in a range of 0.0003–0.0050, and the magnetic toner contains at least 50% by number of magnetic toner particles satisfying a relationship of $D/C \leqq 0.02$, wherein C represents a projection area-equivalent circle diameter of each magnetic toner particle, and D represents a minimum distance between a surface of the magnetic toner particle and iron oxide particles contained in the magnetic toner.

34. The magnetic toner according to claim 33, wherein the magnetic toner particles retain sulfur in an amount of E and nitrogen in an amount of F at surfaces thereof as measured by X-ray photoelectron spectroscopy, satisfying: $0.25 \leqq F/E \leqq 4$.

35. The magnetic toner according to claim 34, wherein E and F satisfy: $0.8 \leqq F/E \leqq 3.0$.

36. The magnetic toner according to claim 33, wherein the magnetic toner particles retain carbon in an amount of A and nitrogen in an amount of F at surfaces thereof as measured by X-ray photoelectron spectroscopy, giving a ratio F/A in a range of 0.0005–0.010.

37. The magnetic toner according to claim 33, wherein the magnetic toner particles retain carbon in an amount of A and iron in an amount of B at surfaces thereof as measured by X-ray photoelectron spectroscopy, satisfying: $B/A<0.0005$.

38. The magnetic toner according to claim 37, wherein A and B satisfy: $B/A<0.0003$.

39. The magnetic toner according to claim 33, wherein the magnetic toner particles contain iron-containing particles exposed at a surface of the toner particles in a proportion of 0.05 to 3.00% by number with respect to the toner particles.

40. The magnetic toner according to claim 33, wherein the magnetic toner contains at least 65% by number of magnetic toner particles satisfying a relationship of $D/C \leqq 0.02$, wherein C represents a projection area-equivalent circle diameter of each magnetic toner particle, and D represents a minimum distance between a surface of the magnetic toner particle and iron oxide particles contained in the magnetic toner particle.

41. The magnetic toner according to claim 40, wherein the magnetic toner contains at least 75% by number of magnetic toner particles satisfying the relationship of $D/C \leqq 0.02$.

42. The magnetic toner according to claim 33, wherein the sulfur-containing polymer is a polymer having a group $—SO_3X$, wherein X denotes hydrogen or an alkali metal.

43. The magnetic toner according to claim 42, wherein the sulfur-containing polymer is a polymerizate of a sulfonic acid group-containing (meth)acrylamide.

44. The magnetic toner according to claim 43, wherein the sulfur-containing polymer contains 0.01–20 wt. % thereof of polymerized units of the sulfonic acid group-containing (meth)acrylamide.

45. The magnetic toner according to claim 43, wherein the sulfur-containing polymer contains 0.05–10 wt. % thereof of polymerized units of the sulfonic acid group-containing (meth)acrylamide.

46. The magnetic toner according to claim 43, wherein the sulfur-containing polymer contains 0.1–5 wt. % thereof of polymerized units of the sulfonic acid group-containing (meth)acrylamide.

47. The magnetic toner according to claim 33, wherein the sulfur-containing polymer has a glass transition temperature (Tg) of 50–100° C.

48. The magnetic toner according to claim 33, wherein the sulfur-containing polymer has a weight-average molecular weight of 2,000–100,000.

49. The magnetic toner according to claim 33, wherein the sulfur-containing polymer is contained in 0.05–20 wt. parts per 100 wt. parts of the binder resin.

50. The magnetic toner according to claim 33, wherein the toner particles contain 0.5–50 wt. % of wax based on the binder resin.

51. The magnetic toner according to claim 50, wherein the wax shows a thermal behavior giving a maximum heat-absorption peak temperature in a range of 40–110° C. on a heat-absorption curve according to DSC (differential scanning calorimetry).

52. The magnetic toner according to claim 51, wherein the wax shows a maximum heat-absorption peak temperature in a range of 45–90° C.

53. The magnetic toner according to claim 33, wherein the iron oxide has been surface-treated with a coupling agent in an aqueous medium.

54. The magnetic toner according to claim 33, wherein the magnetic toner particles have a mode circularity of at least 0.99.

55. The magnetic toner according to claim 33, wherein the inorganic fine powder has a average primary particle size of 4–80 nm and is contained in a proportion of 0.1–4 wt. % of the magnetic toner.

56. The magnetic toner according to claim 55, wherein the inorganic fine powder comprises at least one species selected from the group consisting of silica, titanium oxide, alumina and complex oxides of these.

57. The magnetic toner according to claim 55, wherein the inorganic fine powder has been hydrophobized.

58. The magnetic toner according to claim 55, wherein the inorganic fine powder has been hydrophobized with at least silicone oil.

59. The magnetic toner according to claim 55, wherein the inorganic fine powder has been hydrophobized at least with a silane compound and silicone oil.

60. The magnetic toner according to claim 33, wherein the inorganic fine powder and electroconductive fine powder larger than the inorganic fine powder are carried on the toner particle surfaces.

61. The magnetic toner according to claim 60, wherein the electroconductive fine powder has a volume resistivity of at most $10^9$ ohm.cm.

62. The magnetic toner according to claim 60, wherein the electroconductive fine powder has a volume resistivity of at most $10^6$ ohm.cm.

63. The magnetic toner according to claim 60, wherein the electroconductive fine powder is non-magnetic.

* * * * *

UNITED STATES PATENT AND TRADEMARK OFFICE

CERTIFICATE OF CORRECTION

PATENT NO. : 6,638,674 B2
DATED : October 28, 2003
INVENTOR(S) : Keiji Komoto et al.

It is certified that error appears in the above-identified patent and that said Letters Patent is hereby corrected as shown below:

Title page,
Item [75], Inventors, "Tatsuhiko Chiba, Kaamakura" shoud read -- Tatsuhiko Chiba, Kamakura --.

Column 8,
Line 33, "$X(SO_3^-)_n.mY^{k+}$," should read -- $X(SO_3^-)_n \bullet mY^{k+}$, --.

Column 11,
Line 28, "Measurement" should read -- ¶Measurement --.

Column 35,
Line 66, "5 kvpp" should read -- 5 kVpp --.

Signed and Sealed this

Thirteenth Day of April, 2004

JON W. DUDAS
*Acting Director of the United States Patent and Trademark Office*